US009208657B2

(12) United States Patent
Fujisawa et al.

(10) Patent No.: US 9,208,657 B2
(45) Date of Patent: Dec. 8, 2015

(54) SLOT MACHINE INCLUDING A PLURALITY OF VIDEO REELS

(71) Applicants: Universal Entertainment Corporation, Tokyo (JP); Aruze Gaming America, Inc., Las Vegas, NV (US)

(72) Inventors: Masumi Fujisawa, Tokyo (JP); Kenta Kitamura, Tokyo (JP); Kensaku Yoshikawa, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 162 days.

(21) Appl. No.: 14/018,703

(22) Filed: Sep. 5, 2013

(65) Prior Publication Data

US 2014/0094251 A1 Apr. 3, 2014

(30) Foreign Application Priority Data

Oct. 1, 2012 (JP) ..... 2012-219782

(51) Int. Cl.
*G07F 17/34* (2006.01)

(52) U.S. Cl.
CPC ..... *G07F 17/34* (2013.01)

(58) Field of Classification Search
USPC ..... 463/20
See application file for complete search history.

(56) References Cited

U.S. PATENT DOCUMENTS

2011/0009185 A1* 1/2011 Kojima ..... G07F 17/3267 463/20
2012/0172106 A1 7/2012 Caputo
2013/0337885 A1* 12/2013 Suda ..... G07F 17/3286 463/20
2014/0106882 A1* 4/2014 Munakata ..... G07F 17/3211 463/31
2014/0274292 A1* 9/2014 Suda ..... G07F 17/32 463/20

* cited by examiner

*Primary Examiner* — Pierre E Elisca
(74) *Attorney, Agent, or Firm* — Lex IP Meister, PLLC

(57) ABSTRACT

Provided is a slot machine which prevents two continuous symbols from coming to be continuous even by conducting a rewriting process. In a case where the one part of the symbol columns is stopped and displayed in the display frame of a symbol display area 4, when a continuous symbol (CHANCE symbol 403) stopped displayed in the display frame of the symbol display area 4 is present in an upstream direction of the scrolling display outside of the display frame of the symbol display area 4, conducted is a delay process in which the rewriting process is conducted for a portion of the symbol column which is present upstream of a position P1 of the continuous symbol (CHANCE symbol 403) in the scrolling display being present in the upstream direction of the scrolling display outside of the display frame of the symbol display area 4.

6 Claims, 78 Drawing Sheets

FIG.6

| | FIRST VIDEO REEL | SECOND VIDEO REEL | THIRD VIDEO REEL | FOURTH VIDEO REEL | FIFTH VIDEO REEL |
|---|---|---|---|---|---|
| CODE NO. | SYMBOL | SYMBOL | SYMBOL | SYMBOL | SYMBOL |
| 00 | JACKPOT 7 | JACKPOT 7 | JACKPOT 7 | JACKPOT 7 | JACKPOT 7 |
| 01 | PLUM | BELL | CHERRY | ORANGE | APPLE |
| 02 | ORANGE | APPLE | ORANGE | PLUM | ORANGE |
| 03 | PLUM | BELL | APPLE | STRAWBERRY | BELL |
| 04 | ORANGE | CHERRY | ORANGE | BELL | PLUM |
| 05 | PLUM | ORANGE | PLUM | PLUM | BLUE 7 |
| 06 | ORANGE | PLUM | ORANGE | APPLE | ORANGE |
| 07 | PLUM | CHERRY | PLUM | BLUE 7 | APPLE |
| 08 | BLUE 7 | BELL | ORANGE | PLUM | PLUM |
| 09 | CHERRY | APPLE | PLUM | ORANGE | BELL |
| 10 | ORANGE | BELL | ORANGE | BELL | CHERRY |
| 11 | BELL | STRAWBERRY | PLUM | ORANGE | PLUM |
| 12 | ORANGE | PLUM | BELL | PLUM | BELL |
| 13 | STRAWBERRY | BLUE 7 | STRAWBERRY | CHERRY | ORANGE |
| 14 | BLUE 7 | BELL | BLUE 7 | APPLE | APPLE |
| 15 | ORANGE | APPLE | BELL | STRAWBERRY | PLUM |
| 16 | APPLE | BELL | CHERRY | CHERRY | CHERRY |
| 17 | PLUM | STRAWBERRY | PLUM | BELL | ORANGE |
| 18 | ORANGE | PLUM | ORANGE | PLUM | BELL |
| 19 | PLUM | CHERRY | PLUM | ORANGE | ORANGE |
| 20 | BLUE 7 | BELL | ORANGE | CHERRY | PLUM |
| 21 | CHERRY | APPLE | PLUM | PLUM | STRAWBERRY |

FIG. 20

SYMBOL COMBINATION TABLE

| SYMBOL COMBINATION | | | | | NUMBER OF PAYOUT | WINNING COMBINATION |
|---|---|---|---|---|---|---|
| FIRST VIDEO REEL | SECOND VIDEO REEL | THIRD VIDEO REEL | FOURTH VIDEO REEL | FIFTH VIDEO REEL | | |
| JACKPOT 7 | JACKPOT 7 | JACKPOT 7 | JACKPOT 7 | JACKPOT 7 | JACKPOT AMOUNT | JACKPOT |
| APPLE | APPLE | APPLE | APPLE | APPLE | BONUS GAME ※ | BONUS GAME TRIGGER |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY 3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE 3 |
| CHERRY | CHERRY | CHERRY | (ANY) | (ANY) | 2 | CHERRY 2 |
| ORANGE | ORANGE | ORANGE | (ANY) | (ANY) | 2 | ORANGE 2 |
| CHERRY | (ANY) | (ANY) | (ANY) | (ANY) | 1 | CHERRY 1 |
| ORANGE | (ANY) | (ANY) | (ANY) | (ANY) | 1 | ORANGE 1 |

※FREE GAMES WHOSE NUMBER IS DETERMINED BY A DRAWING ARE CONDUCTED.

FIG. 34
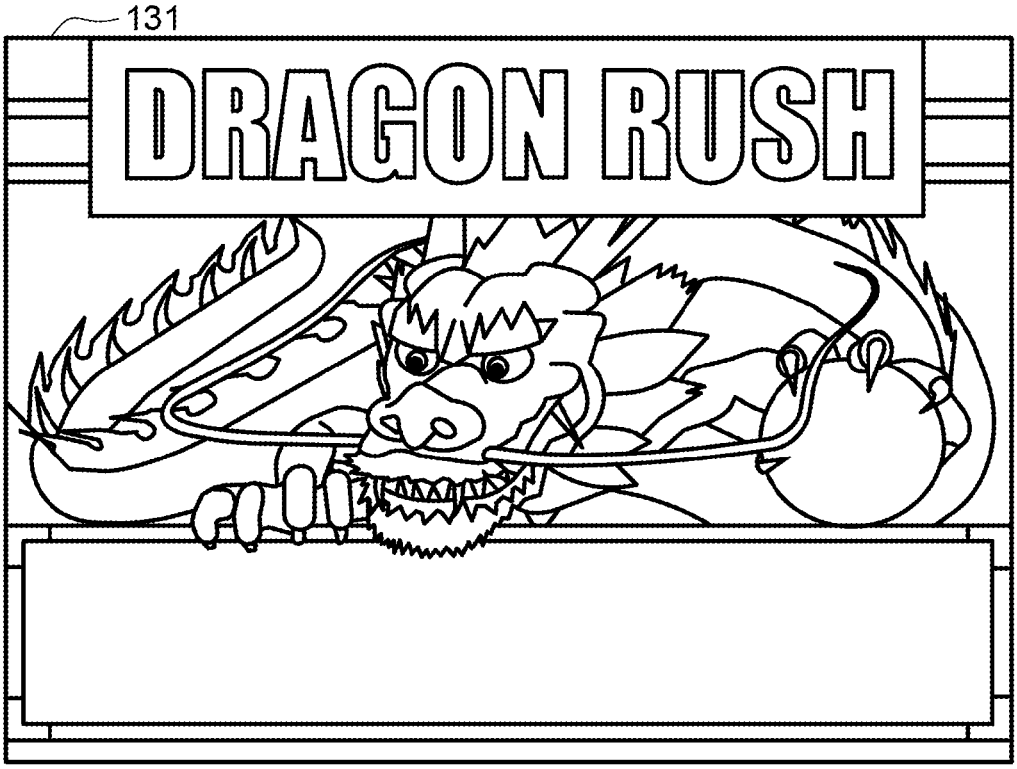
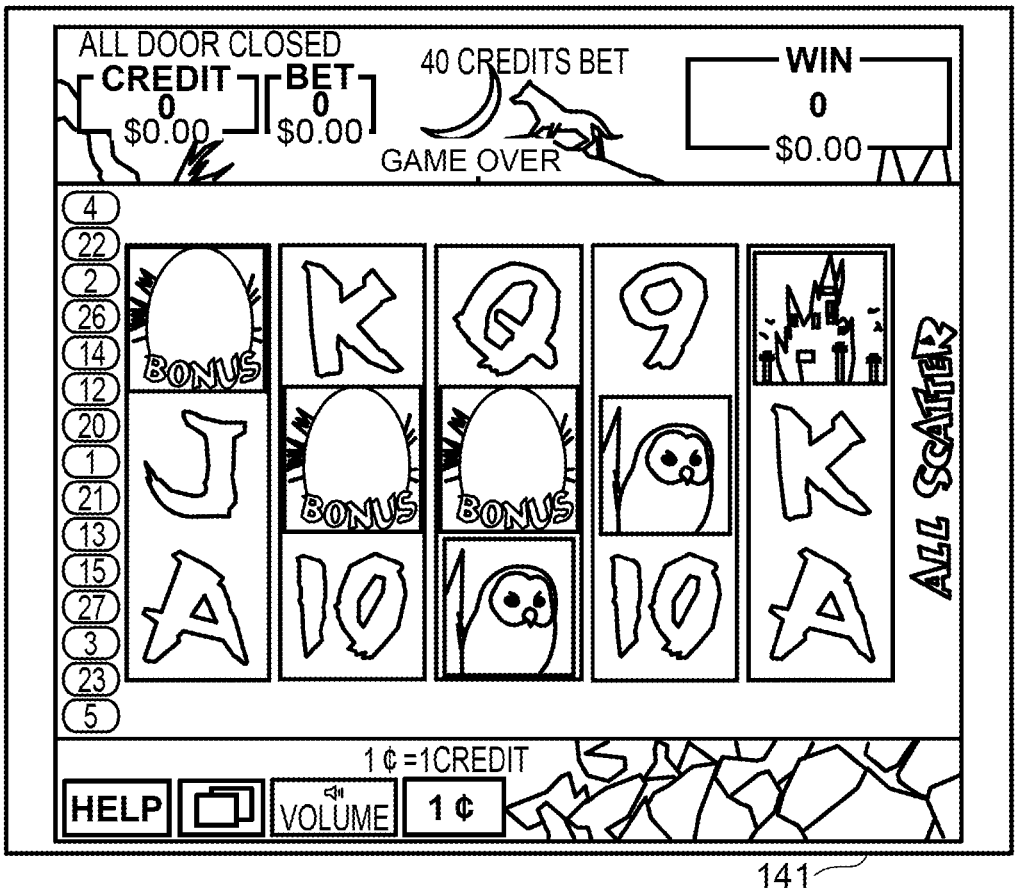

FIG. 35
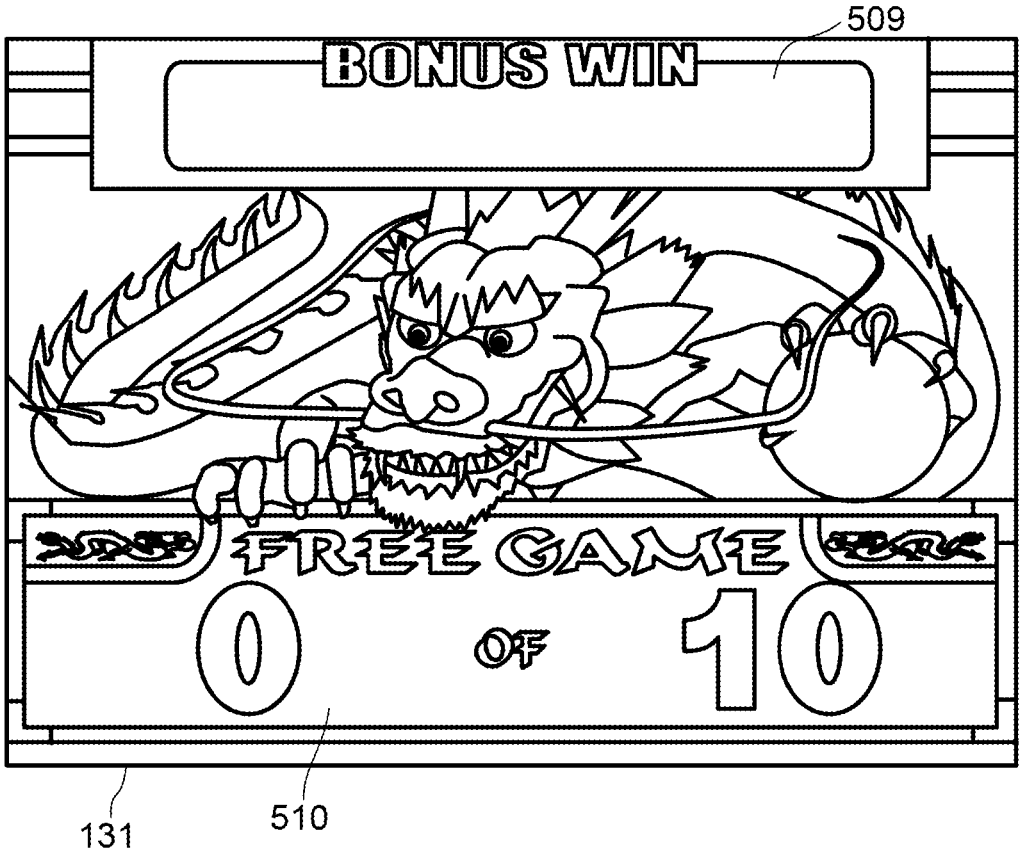
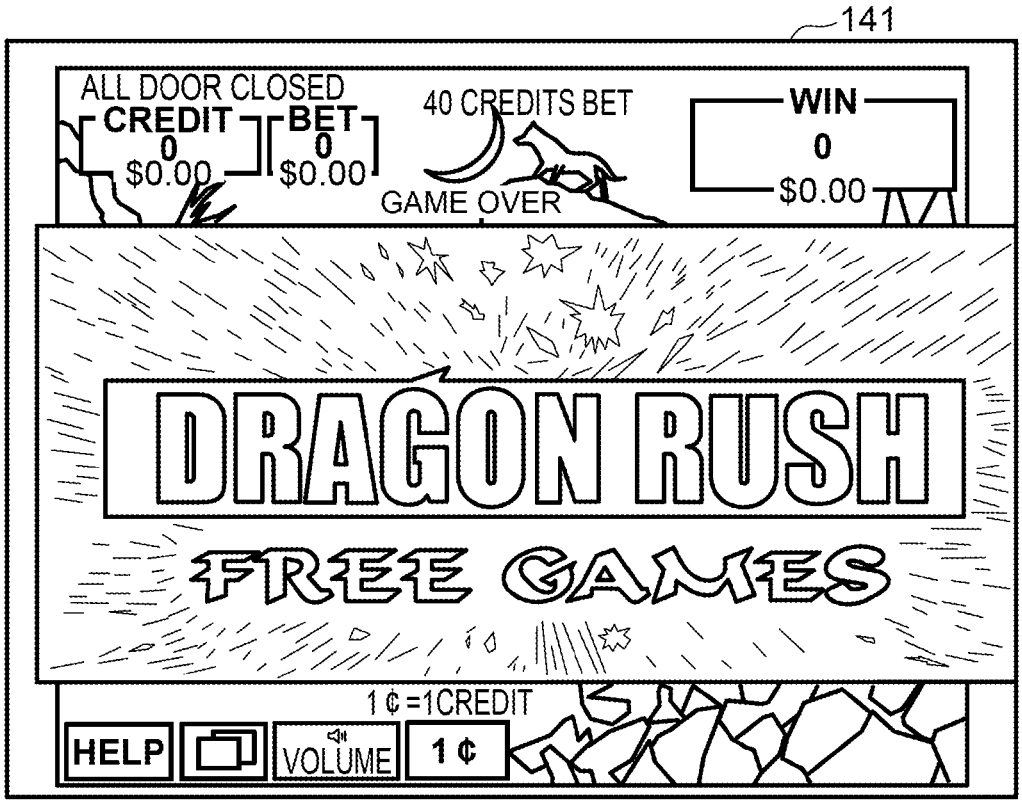

FIG. 44
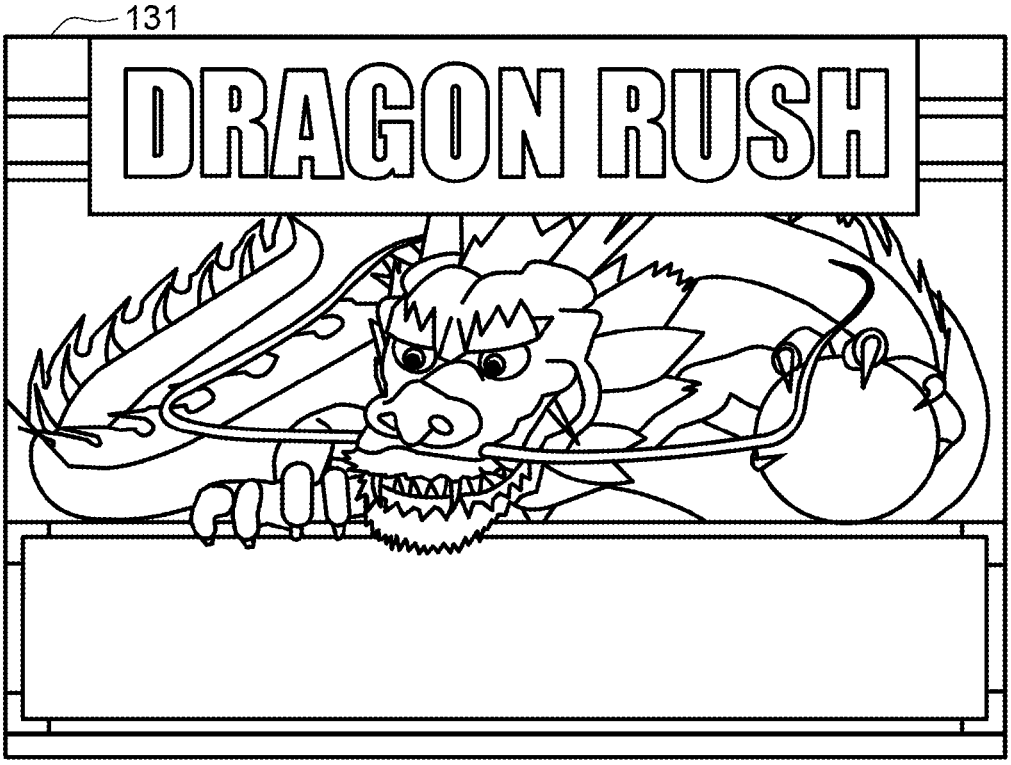
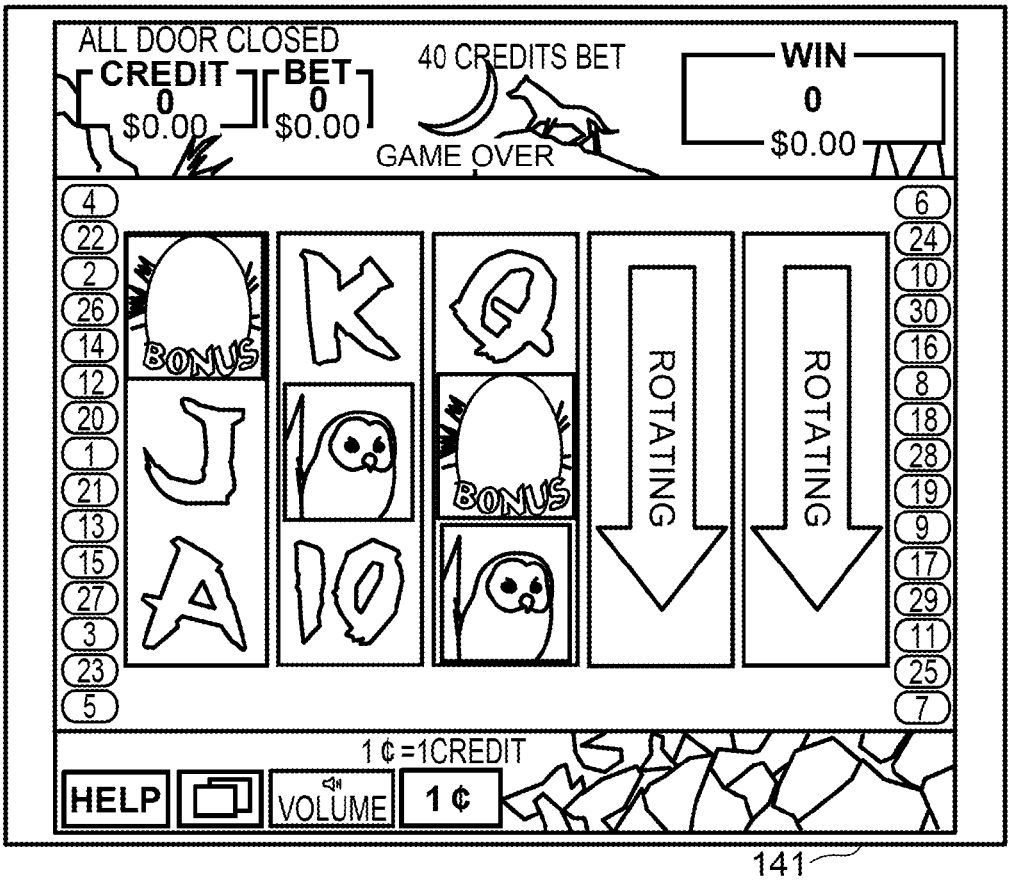

FIG. 46
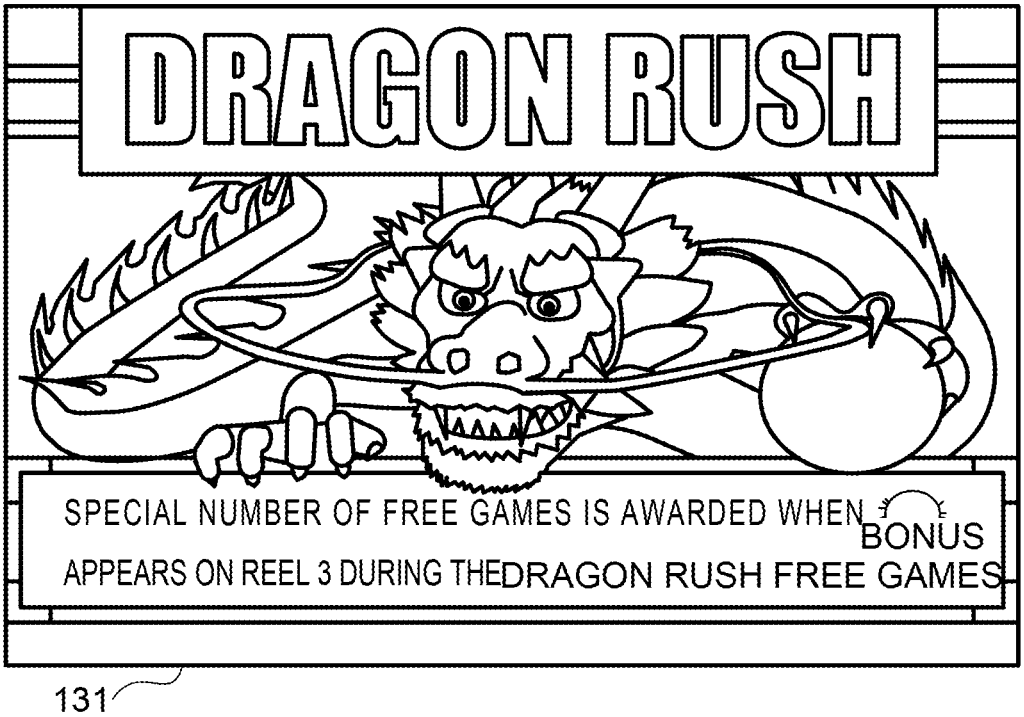
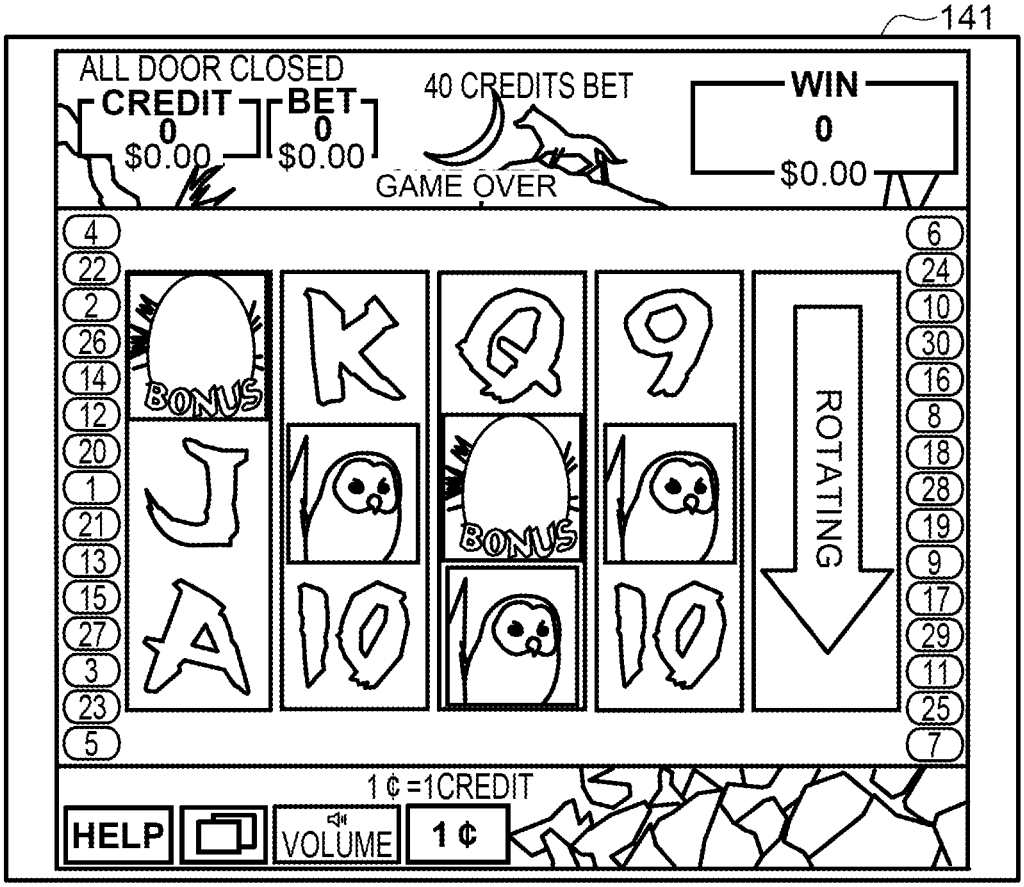

FIG. 48
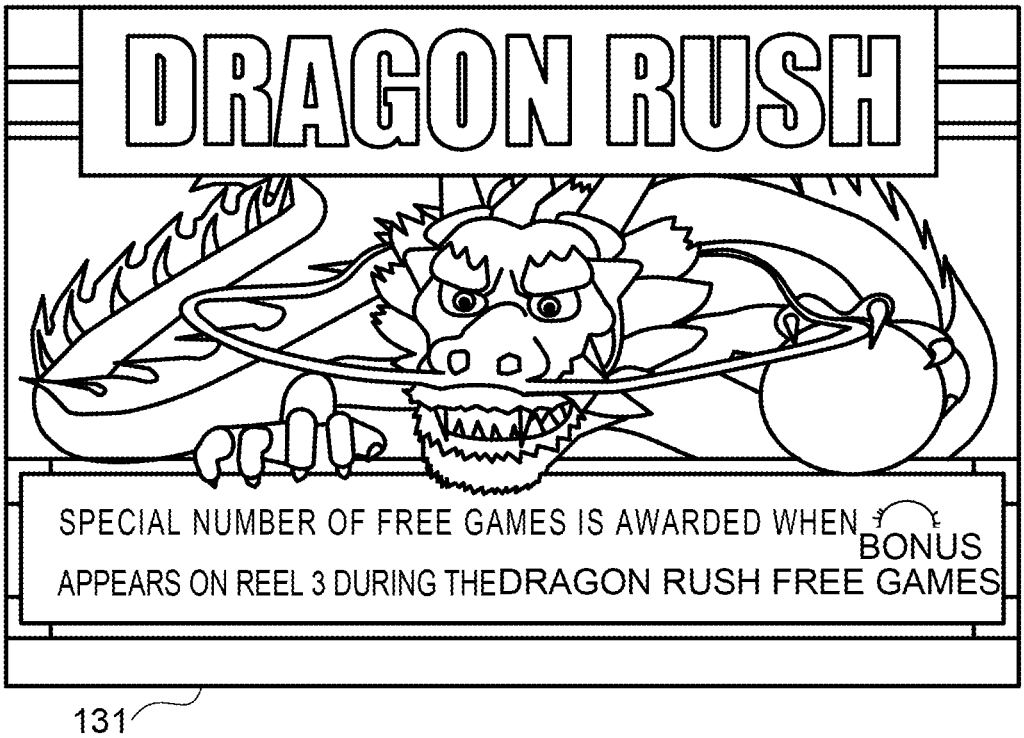
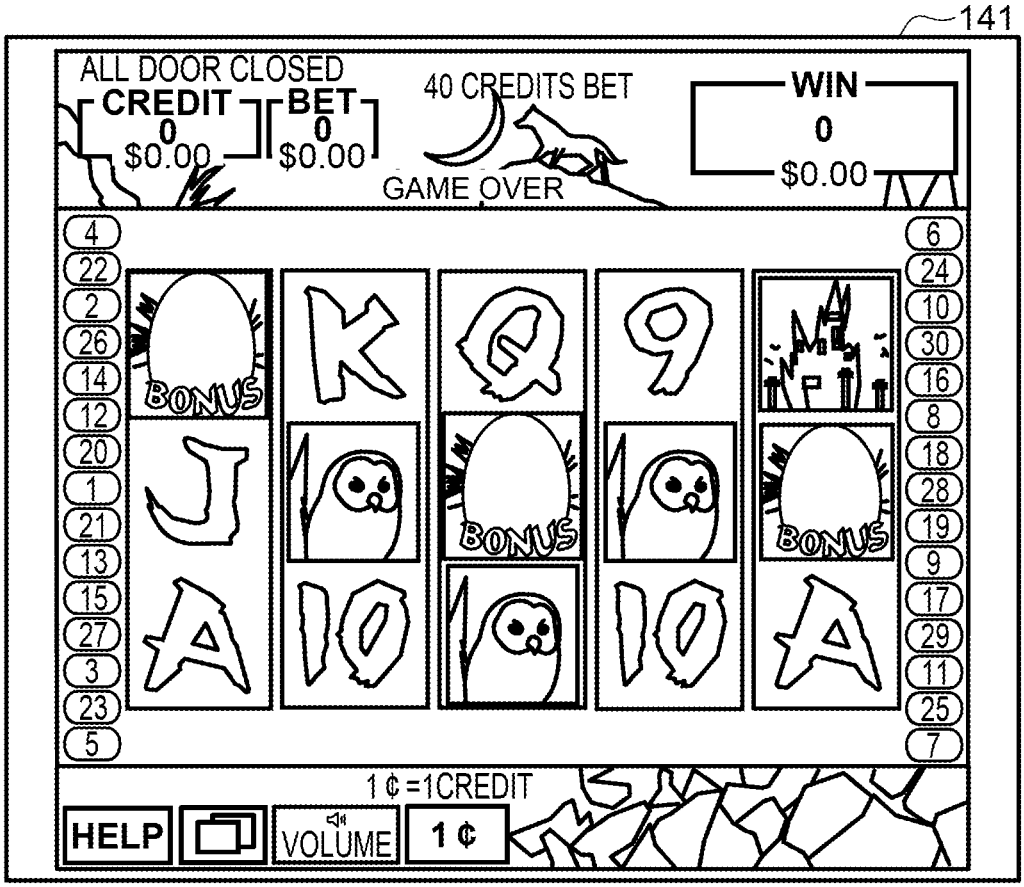

FIG. 49
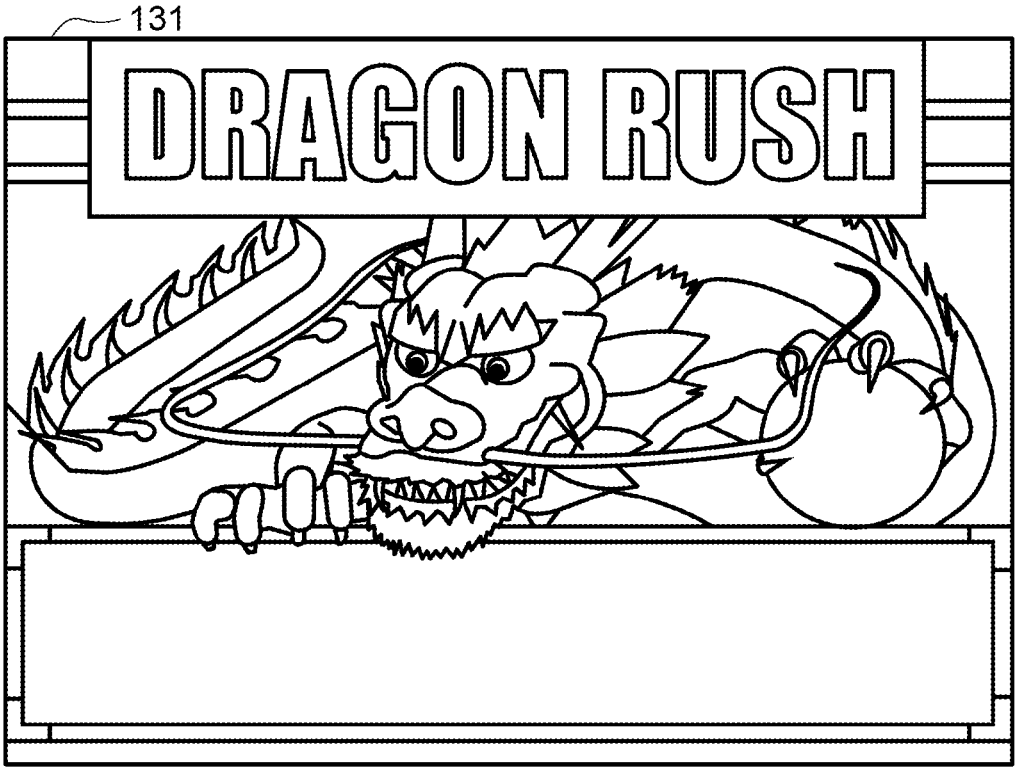
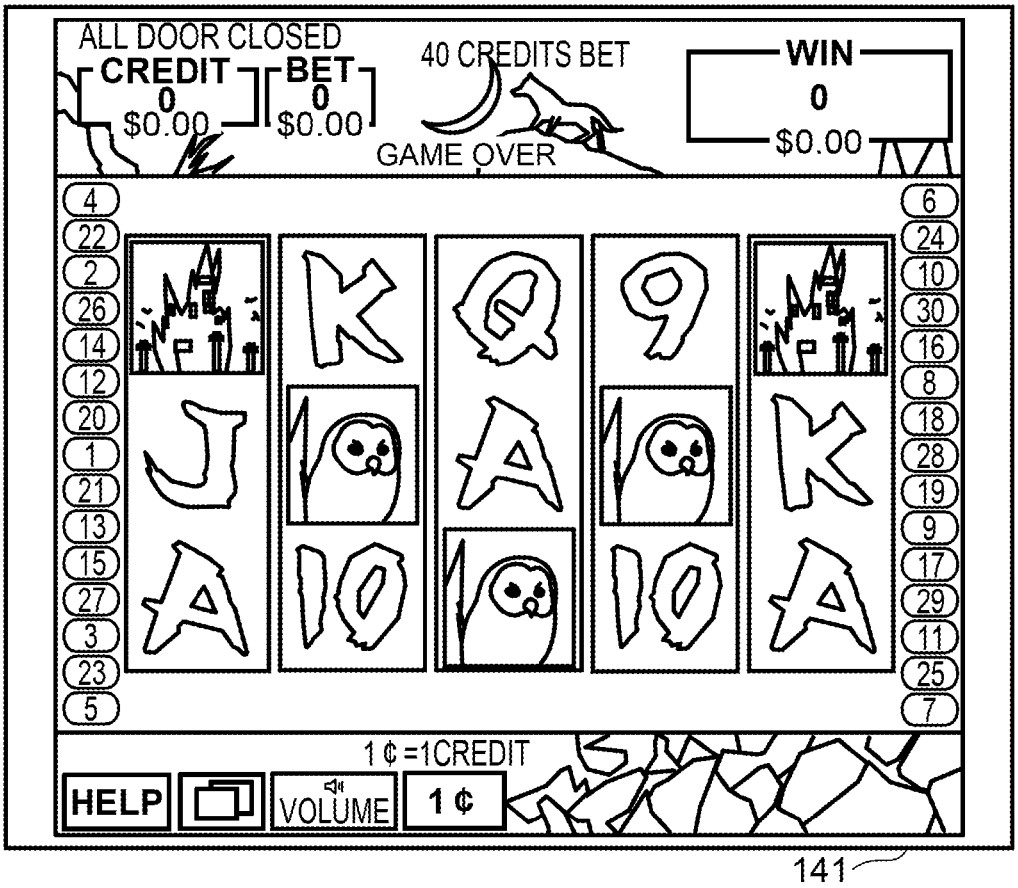

FIG. 51
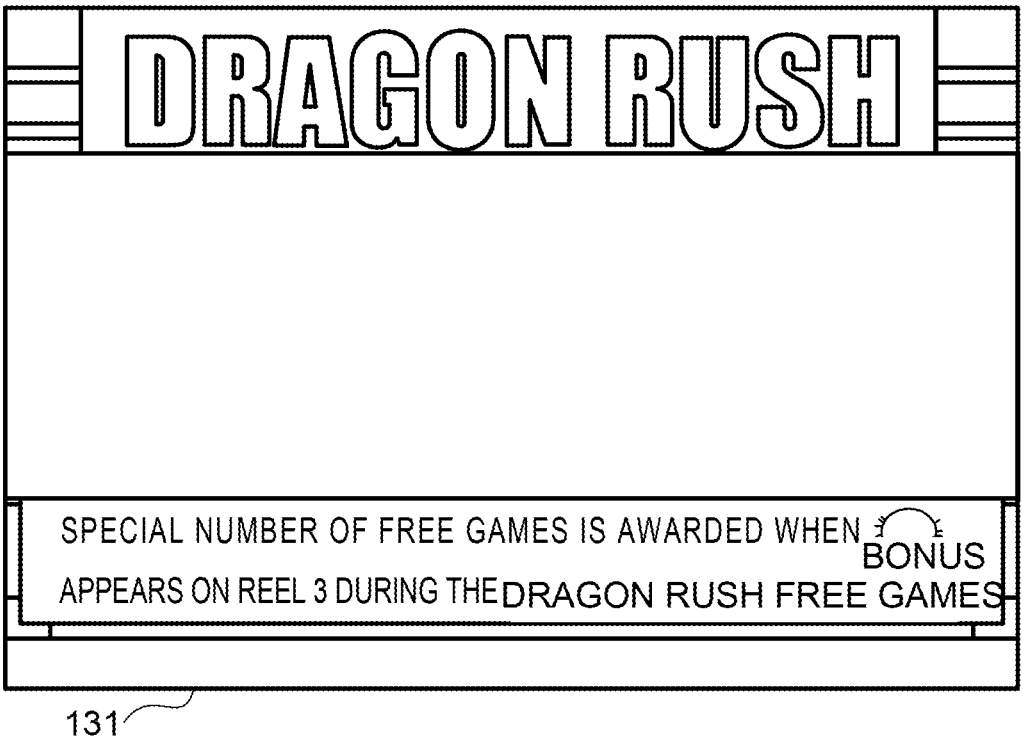
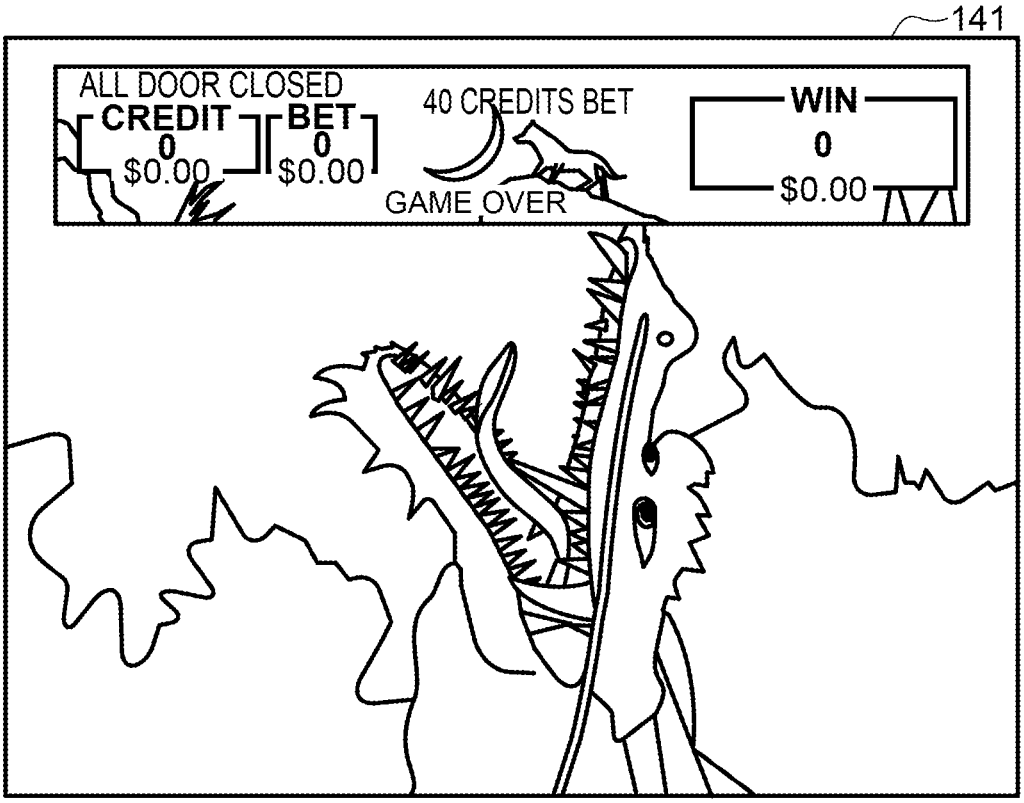

FIG. 53
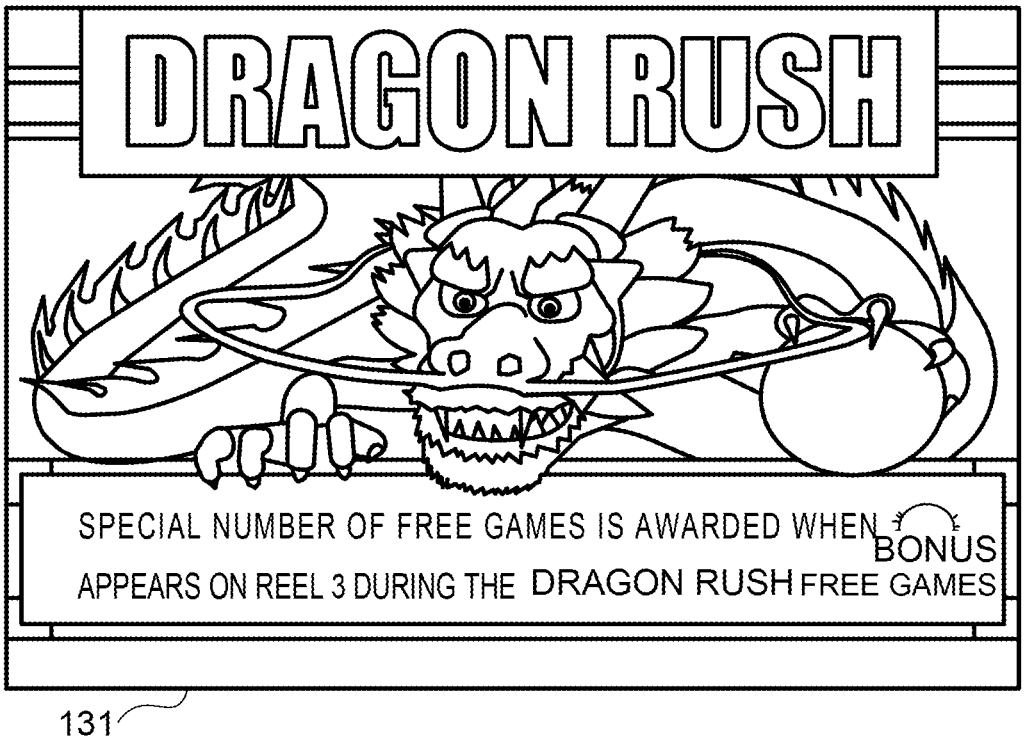
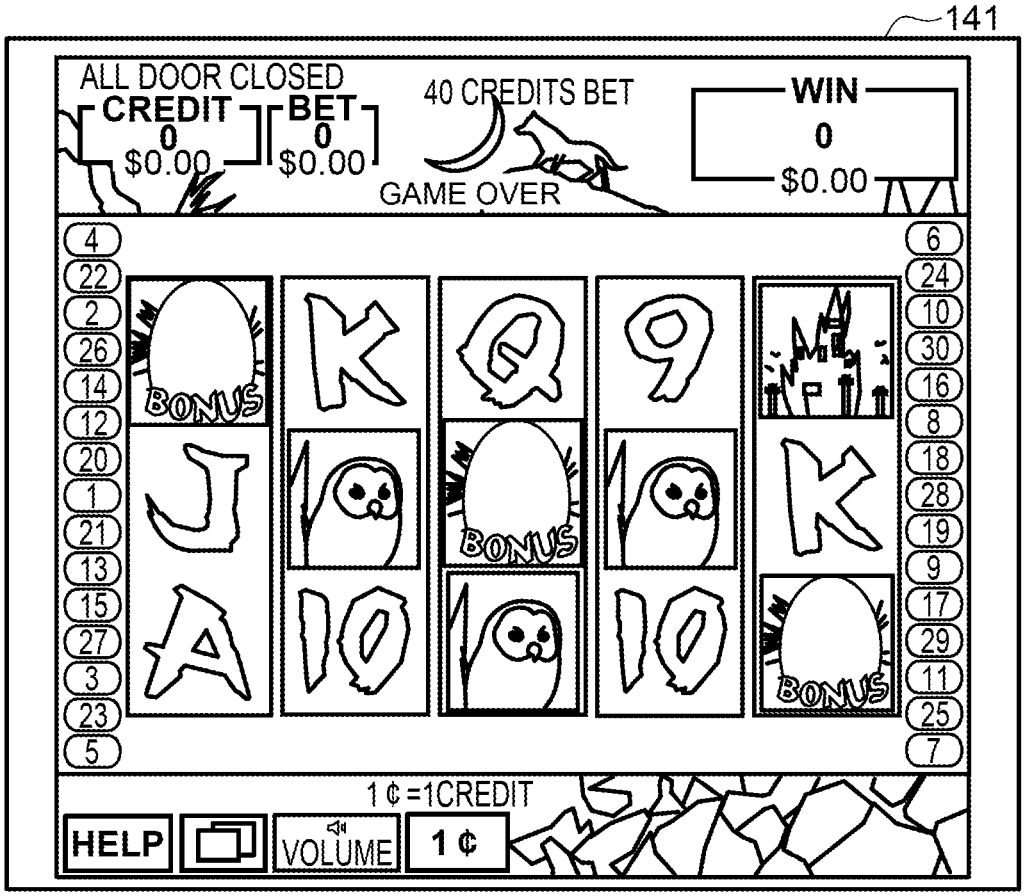

FIG. 55
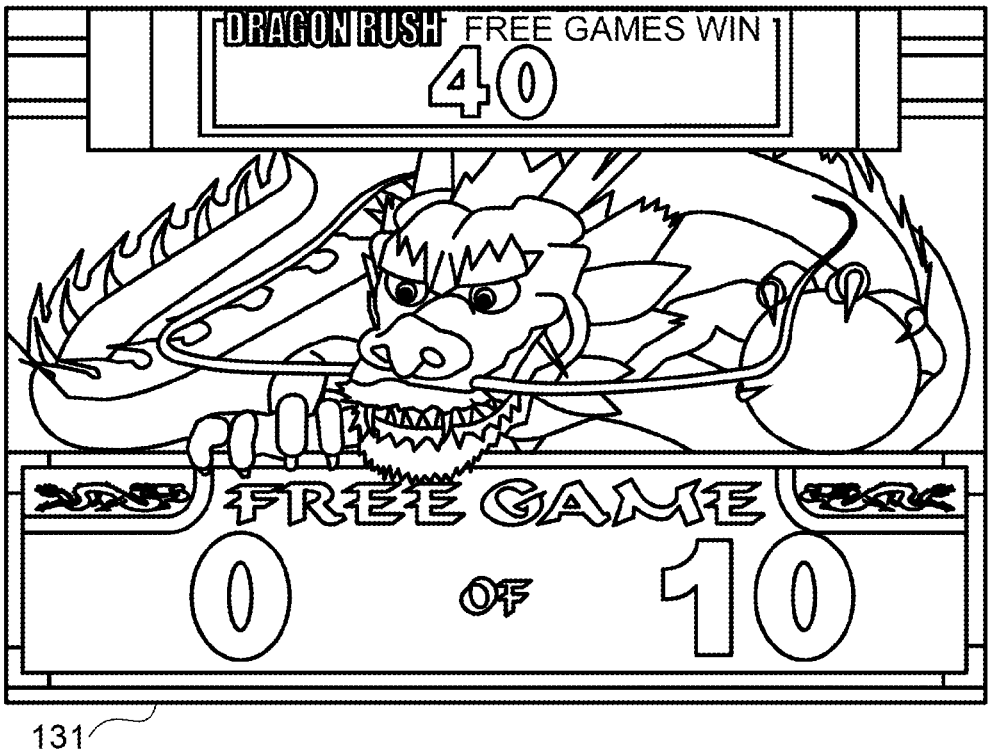
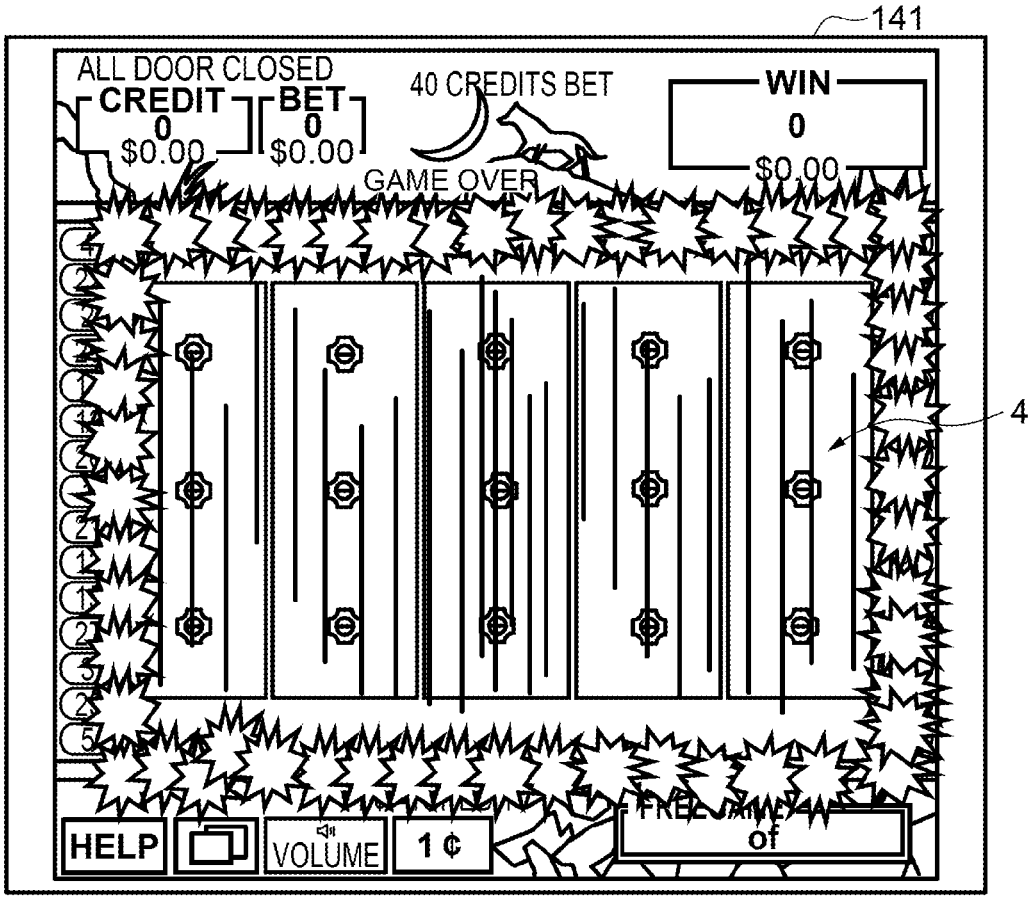

FIG. 66

| | GAMBLE ON | GAMBLE OFF |
|---|---|---|
| CASH OUT | TAKE WIN | TAKE WIN |
| GAMBLE | GAMBLE START | — |
| MAX BET | INACTIVE | GAMBLE START |
| SPIN | TO BASE GAME | TO BASE GAME |

SLOT MACHINE INCLUDING A PLURALITY OF VIDEO REELS

CROSS REFERENCE TO RELATED APPLICATIONS

This application claims priority of Japanese Patent Application No. 2012-219782 filed on Oct. 1, 2012. The contents of this application are incorporated herein by reference in their entirety.

BACKGROUND OF THE INVENTION

1. Field of the Invention

The present invention relates to a slot machine which includes video reels.

2. Description of the Background Art

Conventionally, as a slot machine including a plurality of video reels, for example, there is a model which has the below-mentioned technology. In the technology which such a model has, symbols constituting each symbol column of each of the video reels are stopped and displayed in display areas on a one-by-one basis (for example, refer to US patent application publication 2012/0172106).

However, there may be a case where as the symbols constituting the symbol column of each of the video reels, as shown in FIG. 68, not only a BLANK symbol 401 but also a DRAGON symbol 402 and a CHANCE symbol 403 are present. A size of the BLANK symbol 401 corresponds to that of one display area. Each size of the DRAGON symbol 402 and the CHANCE symbol 403 corresponds to that of a plurality of display areas.

Specifically, as shown in FIG. 69, each size of the DRAGON symbol 402 and the CHANCE symbol 403 corresponds to five display areas. The DRAGON symbol 402 is constituted of a continuous symbol including two symbol arrangement spaces 402B located above a character symbol 402A and two symbol arrangement spaces 402B located below the character symbol 402A which are used as effect spaces. Similarly, the CHANCE symbol 403 is constituted of continuous symbol including two symbol arrangement spaces 403B located above a character symbol 403A and two symbol arrangement spaces 403B located below the character symbol 403A which are used as effect spaces.

In the above-described case, as shown in FIG. 70, when a symbol display area 404 is sized so as to stop and display three symbols in vertical one column, only a part of the CHANCE symbol 403 as the continuous symbol is stopped and displayed in the symbol display area 404. The same applies the DRAGON symbol 402 as the continuous symbol.

Accordingly, when a rewriting process for moving symbols being present upstream in a scrolling display outside of a frame of the symbol display area 404 based on a position where the next scrolling display of the video reels is conducted, it may occur that the CHANCE symbol 403 and the DRAGON symbol 402 as the continuous symbols come to be continuous in midstream.

As shown in FIG. 71, also when a part of the CHANCE symbol 403 as the continuous symbol is stopped and displayed in the symbol display area 404, the same may occur, and also when the above-mentioned rewriting process for moving a scrolling display of the CHANCE symbol 403 starting from an end portion thereof being present upstream is conducted, it may occur that the CHANCE symbol 403 and the DRAGON symbol 402 as the continuous symbols come to be continuous in midstream.

In other words, in the conventional technology, as shown in FIG. 72, when one part of the CHANCE symbol 403 as the continuous symbol is stopped and displayed in the symbol display area 404, a position of an arrangement of the symbol column being present upstream of the scrolling display is moved from the frame of the symbol display area 404 or the vicinity of the frame thereof being upstream of the scrolling display, and therefore, it may occur that the CHANCE symbol 403 and the DRAGON symbol 402 as the continuous symbols come to be continuous in midstream.

Therefore, in view of the above-described respect, the present invention was made. An object of the present invention is to provide a slot machine which prevents two continuous symbols from coming to be continuous even by conducting a rewriting process, that is, even by moving a position of an arrangement of one part of the symbol columns being present in an upstream direction of a scrolling display outside of a display frame when the one part of the symbol columns of video reels is stopped and displayed, based on a position where the next scrolling display of the video reels is stopped.

SUMMARY OF THE INVENTION

In order to achieve the above-mentioned object, the invention according to claim 1 is a slot machine including: a first display for displaying video reels respectively having symbol columns in a scrolling manner and displaying one part of the symbol columns of the video reels in a display frame in a stopped manner by repeating a scrolling display of the video reels and a stopped display of the scrolling display; and a processor for, when the one part of the symbol columns is stopped and displayed in the display frame of the first display, conducting a rewriting process to move a position of an arrangement of one part of the symbol columns being present in an upstream direction of the scrolling display outside of the display frame of the first display, based on a position where a next scrolling display of the video reels is stopped, each of the symbol columns including a continuous symbol using as effect spaces symbol arrangement spaces located above a special symbol and symbol arrangement spaces located below the special symbol, a number of the symbol arrangement spaces located above the special symbol and a number of the symbol arrangement spaces located below the special symbols being the same as each other, the processor being programmed to executed a process (1) described below. (1) A process in which the rewriting process is conducted for a portion of the symbol columns being present upstream of a position where a portion for arranging the continuous symbol in the upstream direction of the scrolling display from the display frame of the first display is allocated.

The slot machine according to claim 1 includes the above-described configuration, thereby conducting the above-mentioned rewriting process. By conducting the above-mentioned rewriting process, when the one part of the symbol columns is displayed in the scrolling manner or displayed in the stopped manner in the display frame of the first display, two continuous symbols can be prevented from coming to be continuous.

In other words, in the above-mentioned rewriting process, when the one part of the symbol columns is stopped and displayed in the display frame of the first display, based on the position where the next scrolling display of the video reels is stopped, the position of the arrangement of the one part of the symbol columns being present in the upstream direction of the scrolling display outside of the display frame of the first display is moved. Here, when each of the symbol columns includes the continuous symbol using as the effect spaces the symbol arrangement spaces located above the special symbol and the symbol arrangement spaces located below the special symbol, the number of the symbol arrangement spaces located above the special symbol and the number of the symbol arrangement spaces located below the special symbols being the same as each other, the rewriting process is conducted for the portion of the symbol columns being present upstream of the position where the portion for arranging the continuous symbol in the upstream direction of the scrolling display from the display frame of the first display is allocated.

In addition, the invention according to claim 2 is the slot machine according to claim 1 in which the processor is programmed to execute processes (A) to (B) described below. (A) A process in which in a case where the one part of the symbol columns is stopped and displayed in the display frame of the first display, when the continuous symbol stopped and displayed in the display frame of the first display is present in the upstream direction of the scrolling display outside of the display frame of the first display, conducted is a delay process in which the rewriting process is conducted for a portion of the symbol column being present further upstream of the continuous symbol in the scrolling display being present in the upstream direction of the scrolling display outside of the display frame of the first display. (B) A process in which when by conducting the process (A), the continuous symbol comes to be present in the upstream direction of the scrolling display so as to be continuous with the continuous symbol being present in the upstream direction of the scrolling display outside of the display frame of the first display, conducted is another delay process in which the rewriting process is conducted for a portion of the symbol column being present upstream of a position where a portion for arranging the continuous symbol in the upstream direction of the scrolling display from the display frame of the first display is allocated.

The slot machine according to claim 2 includes the above-described configuration and thus, the above-mentioned delay process is conducted twice as described below, thereby allowing the two continuous symbols to be prevented from coming to be continuous. First, in the case where the one part of the symbol columns is stopped and displayed in the display frame of the first display, when the continuous symbol stopped and displayed in the display frame of the first display is present in the upstream direction of the scrolling display outside of the display frame of the first display, conducted is the delay process in which the rewriting process is conducted for a portion of the symbol column being present further upstream of the continuous symbol in the scrolling display being present in the upstream direction of the scrolling display outside of the display frame of the first display. Thereafter, when the continuous symbol comes to be present in the upstream direction of the scrolling display so as to be continuous with the continuous symbol being present in the upstream direction of the scrolling display outside of the display frame of the first display, conducted is another delay process in which the rewriting process is conducted for the portion of the symbol column being present upstream of the position where the portion for arranging the continuous symbol in the upstream direction of the scrolling display from the display frame of the first display is allocated.

In addition, the invention according to claim 3 is the slot machine according to claim 2 in which each of the symbol columns includes a blank symbol in addition to the continuous symbol, and the processor is programmed to execute a process (C) described below. (C) A process in which in a case where the one part of the symbol columns is stopped and displayed in the display frame of the first display, when the one part of the symbol columns stopped and displayed in the display frame of the first display is constituted of only the blank symbol, the rewriting process is conducted by moving the symbol columns so as to reach a position where a continuous arrangement of the blank symbols is started.

The slot machine according to claim 3 includes the above-described configuration, whereby in the case where the one part of the symbol columns is stopped and displayed in the display frame of the first display, when the one part of the symbol columns stopped and displayed in the display frame of the first display is constituted of only the blank symbol, the above-mentioned rewriting process is conducted by moving the symbol columns so as to reach the position where the continuous arrangement of the blank symbols is started.

In addition, the invention according to claim 4 is the slot machine according to any one of claims 1 to 3 in which the processor is programmed to execute processes (D) to (E) described below. (D) A process in which a slot game having free games using the video reels is caused to proceed on the first display. (E) A process in which upon causing the free games to proceed, as the special symbol, used is a character symbol which increases a first predetermined number of times with respect to a number of times of the free games when stopped and displayed in the display frame of the first display or a chance symbol which increases a second predetermined number or more of times with respect to the number of times of the free games when stopped and displayed in the display frame of the first display.

The slot machine according to claim 4 includes the above-described configuration, thereby allowing a diversity to be imparted to the slot game having the free games using the video reels on the first display. In other words, upon causing the free games to proceed, as the special symbol, the character symbol or the chance symbol is used. The character symbol increases the first predetermined number of times with respect to the number of times of the free games when stopped and displayed in the display frame of the first display. The chance symbol increases the second predetermined number or more of times with respect to the number of times of the free games when stopped and displayed in the display frame of the first display.

In addition, the invention according to claim 5 is the slot machine according to claim 4, including a second display being provided so as to neighbor the first display, in which the processor is programmed to execute a process (F) described below. (F) A process in which predictive presentation effects of the slot game are conducted such that an image gradually stretching from a character of the character symbol displayed on the second display toward the first display is displayed, with the first display and the second display being in conjunction with each other to gradually stretch the image.

The slot machine according to claim 5 includes the above-described configuration, thereby allowing a diversity to be imparted to the predictive presentation effects of the slot game. In other words, as the predictive presentation effects of the slot game, the image gradually stretching from the character of the character symbol displayed on the second display toward the first display is displayed, with the first display and the second display being in conjunction with each other to gradually stretch the image.

In addition, the invention according to claim 6 is the slot machine according to claim 4, including the second display being provided so as to neighbor the first display, in which the processor is programmed to execute a process (G) described below. (G) A process in which predictive presentation effects of the slot game are conducted such that the image of the character of the character symbol displayed on the second display is moved and displayed onto the second display and the first display.

The slot machine according to claim 6 includes the above-described configuration, thereby allowing a diversity to be imparted to the predictive presentation effects of the slot game. In other words, as the predictive presentation effects of the slot game, the image of the character of the character symbol displayed on the second display is moved and displayed onto the second display and the first display.

In some countries and manufactures, the bonus game in the present specification may be referred to as a feature game.

Hence, according to the present invention, provided is a slot machine which prevents two continuous symbols from coming to be continuous even by conducting a rewriting process, that is, even by moving a position of an arrangement of a symbol column being present in an upstream direction of a scrolling display outside of a display frame in which one part of the symbol columns of video reels, based on a position where the next scrolling display of the video reels is stopped.

BRIEF DESCRIPTION OF THE DRAWINGS

FIG. 6 shows arrangements of symbols depicted on the peripheries of the base game reels in the slot machine according to the embodiment of the present invention;

FIG. 20 shows a base game symbol combination table of the slot machine according to the embodiment of the present invention;

FIG. 34 is a diagram illustrating an image specification of the slot machine according to the embodiment of the present invention;

FIG. 35 is a diagram illustrating an image specification of the slot machine according to the embodiment of the present invention;

FIG. 44 is a diagram illustrating first predictive presentation effects of the slot machine according to the embodiment of the present invention;

FIG. 46 is a diagram illustrating first predictive presentation effects of the slot machine according to the embodiment of the present invention;

FIG. 48 is a diagram illustrating first predictive presentation effects of the slot machine according to the embodiment of the present invention;

FIG. 49 is a diagram illustrating second predictive presentation effects of the slot machine according to the embodiment of the present invention;

FIG. 51 is a diagram illustrating second predictive presentation effects of the slot machine according to the embodiment of the present invention;

FIG. 53 is a diagram illustrating second predictive presentation effects of the slot machine according to the embodiment of the present invention;

FIG. 55 is a diagram illustrating third predictive presentation effects of the slot machine according to the embodiment of the present invention;

FIG. 66 is a diagram explaining RESIDUAL GAMBLE of the slot machine according to the embodiment of the present invention;

DESCRIPTION OF THE PREFERRED EMBODIMENT

Outline of the Present Invention

Figure 1:
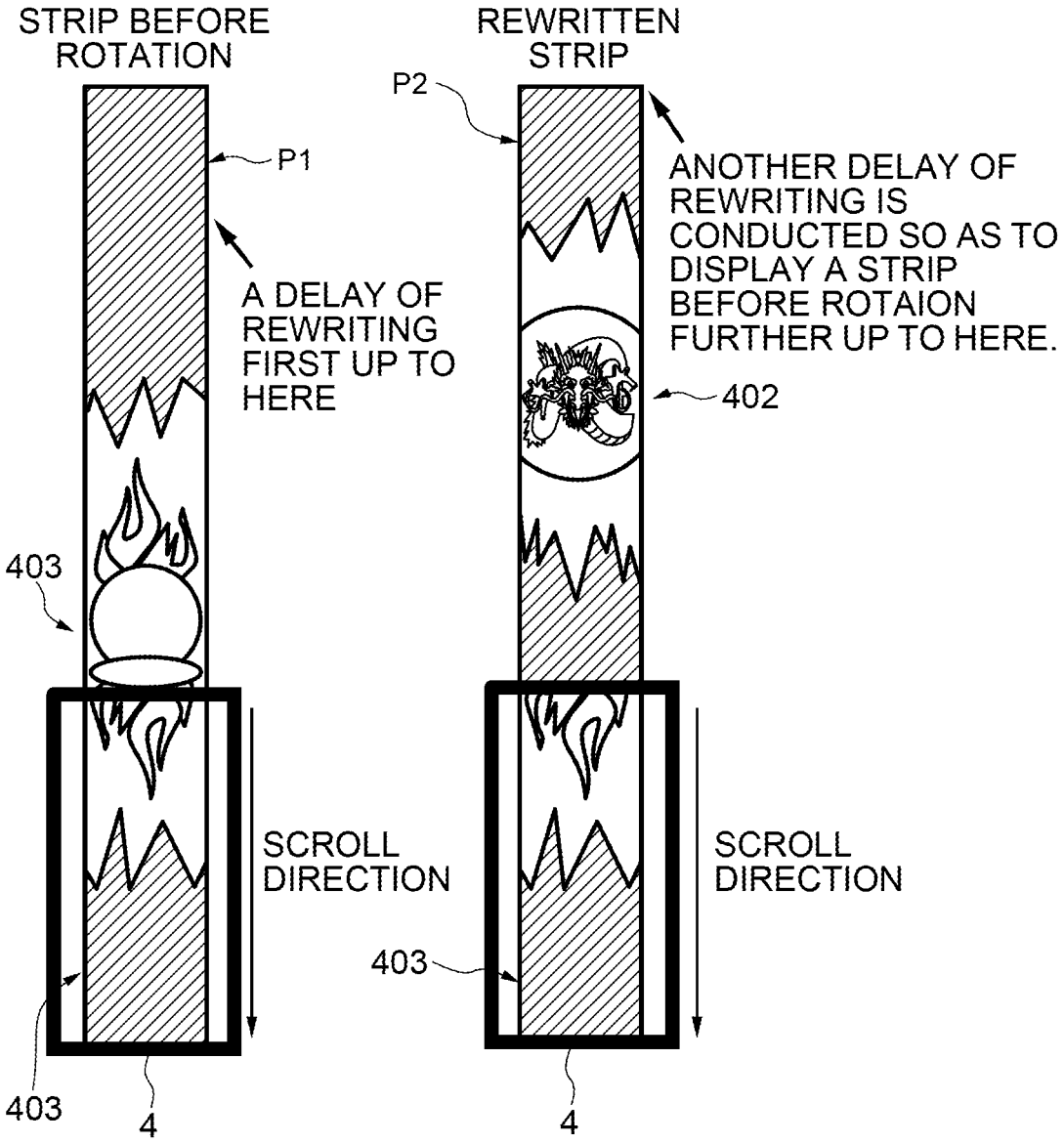
FIG. 1 is a diagram illustrating characteristics of a rewriting process of a slot machine according to an embodiment of the present invention.
Figure 2:
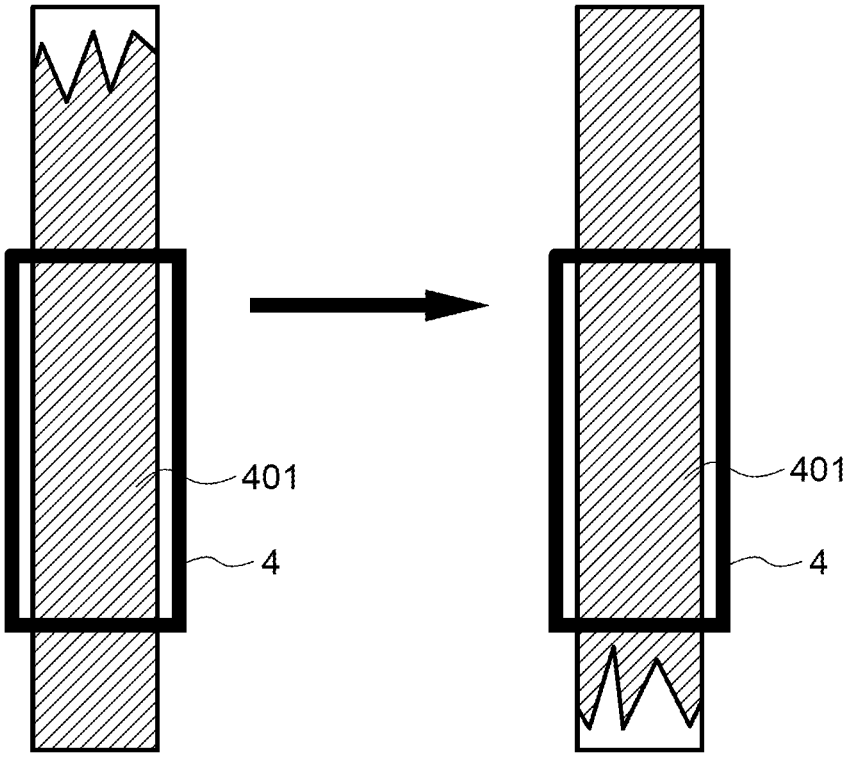
FIG. 2 is a diagram illustrating the characteristics of the rewriting process of the slot machine according to the embodiment of the present invention.
Figure 73:
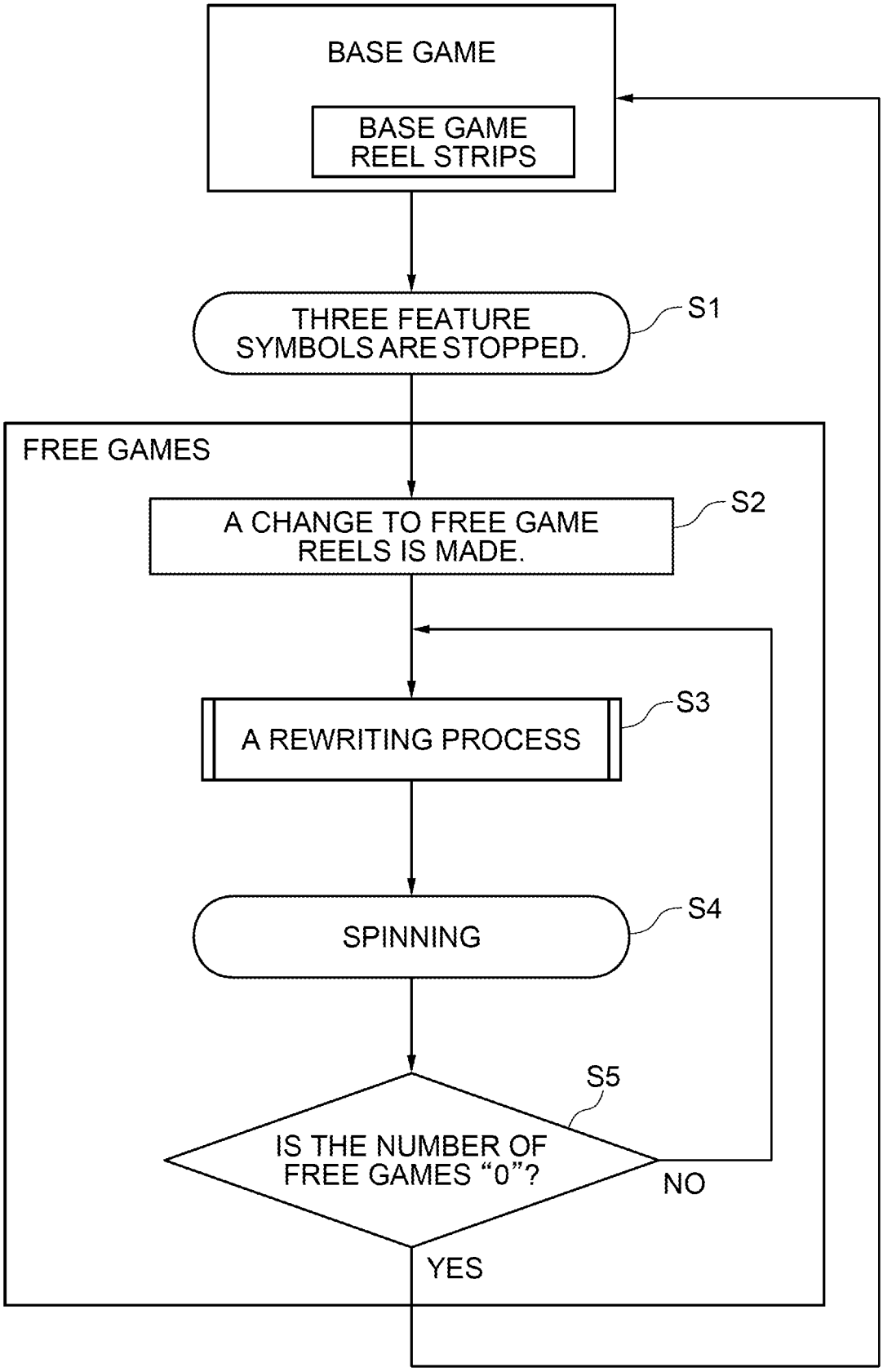
FIG. 73 shows a flowchart of a process including the rewriting process.
Figure 74:
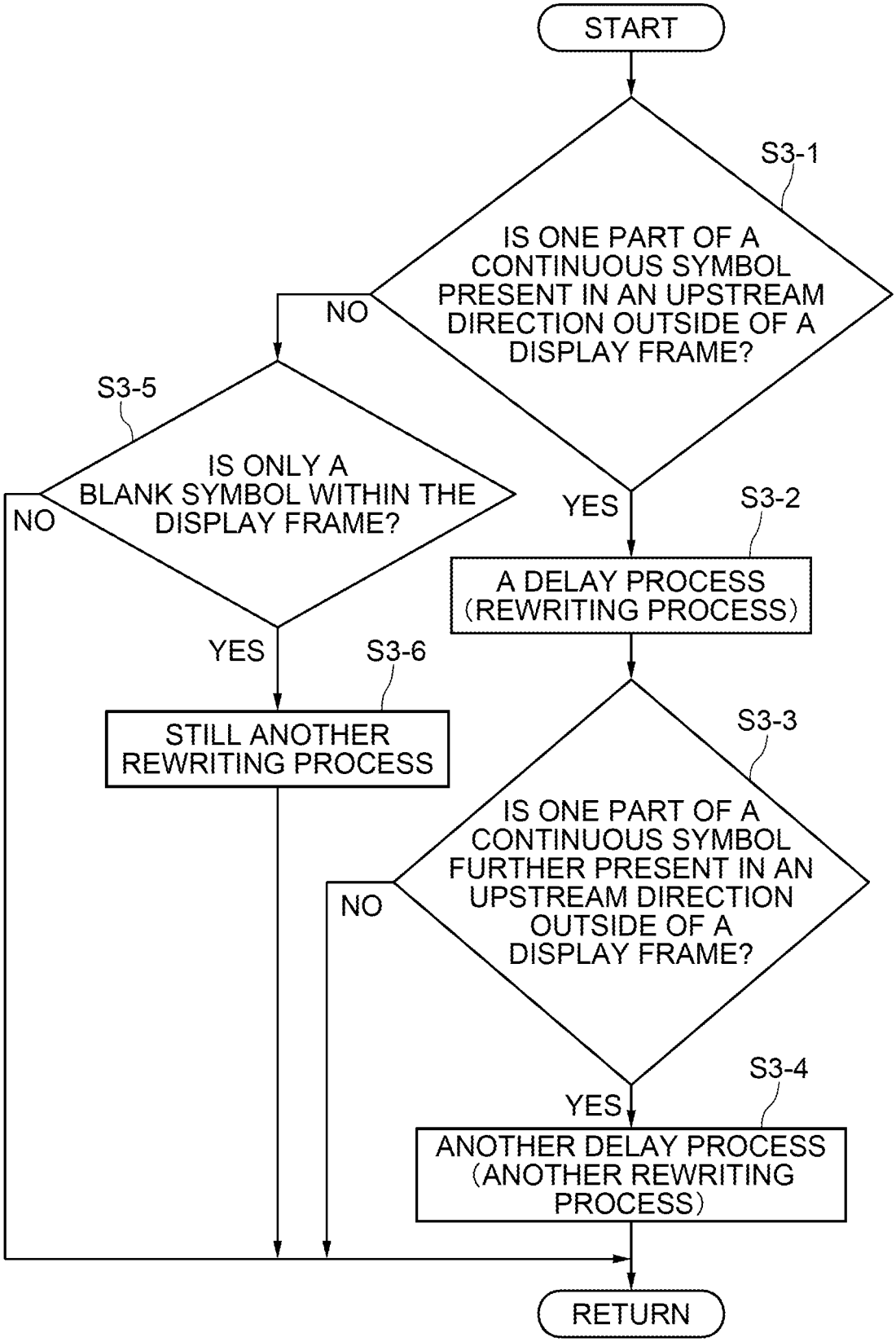
FIG. 74 shows a flowchart of a process including the rewriting process.

Hereinafter, an embodiment of the present invention will be described with reference to the accompanying drawings. Each of FIG. 1 and FIG. 2 is a diagram illustrating characteristics of a rewriting process of a slot machine according to the embodiment of the present invention. In addition, each of FIG. 73 and FIG. 74 shows a process flow including the rewriting process. In each of these FIG. 73 and FIG. 74, the flow of only the rewriting process of reels is described. In a base game, reel strips for the base game (BASE game reel strips) are used to execute the base game and three FEATURE symbols are stopped (step S1), and thereafter, in free games constituted of a set of a plurality of free games, the rewriting process is executed.

The free games constituted of the set of the plurality of free games may be referred to as a feature game or a bonus game.

When each of the free games is triggered, a setting is made such that the reel strips for the base game are changed to reel strips for the free games (S2).

In accordance with a player's operation, spinning is executed using the reel strips for the free games (S4).

To facilitate understanding, the BLANK symbol 401, the DRAGON symbol 402, and the CHANCE symbol 403 used in the "Description of the Background Art" are also used in the "DESCRIPTION OF THE PREFERRED EMBODIMENT".

In the slot machine according to the embodiment of the present invention, as shown on a left side of FIG. 1, in a display frame of a symbol display area 4 of a first display (lower side image display panel), there may be a case where one part of a symbol column is stopped and displayed. In such a case, a continuous symbol (CHANCE symbol 403) stopped and displayed in the display frame of the symbol display area 4 of the first display (lower side image display panel) may be present in an upstream direction of a scrolling display outside of the display frame of the symbol display area 4 of the first display (lower side image display panel). As in the above-described case, when the one part of the symbol column is stopped and displayed in the display frame of the symbol display area 4 of the first display (lower side image display panel), the rewriting process based on FIG. 74 is executed. In other words, at step S3-1, a processor determines whether or not the one part of the symbol column is stopped and displayed in the display frame of the symbol display area 4 of the first display (lower side image display panel).

At step S3-1, when it is determined that the one part of the symbol column is stopped and displayed in the display frame of the symbol display area 4 of the first display (lower side image display panel) (S3-1: YES), the processor conducts a delay process in which the rewriting process is conducted for a portion of the symbol column being present further upstream in a scrolling display of the continuous symbol (CHANCE symbol 403) being present in the upstream direction of the scrolling display outside of the display frame of the symbol display area 4 of the first display (lower side image display panel). In other words, by conducting the delay process, the rewriting process is conducted for the portion of the symbol column being present upstream of a position P1 in the scrolling display.

Even after conducting the above-described rewriting process, as shown on a right side of FIG. 1, a continuous symbol (DRAGON symbol 402) may be present in the upstream direction of the scrolling display so as to be continuous with the continuous symbol (CHANCE symbol 403) being present in the upstream direction of the scrolling display outside of the display frame of the symbol display area 4 of the first display (lower side image display panel). Accordingly, in the present embodiment, after conducting the first delay process, it is determined whether or not the continuous symbol (DRAGON symbol 402) is present in the upstream direction of the scrolling display so as to be continuous with the continuous symbol (CHANCE symbol 403) being present in the upstream direction of the scrolling display outside of the display frame of the symbol display area 4 of the first display (lower side image display panel) (step S3-3).

At step S3-1, when it is determined that the continuous symbol (DRAGON symbol 402) is present in the upstream direction of the scrolling display so as to be continuous with the continuous symbol (CHANCE symbol 403) being present in the upstream direction of the scrolling display outside of the display frame of the symbol display area 4 of the first display (lower side image display panel) (S3-3: YES), the processor conducts another delay process (step S3-4) in which the rewriting process is conducted for a portion of the symbol column being present upstream of a position P2 where a portion for arranging the continuous symbol (the DRAGON symbol 402 or the CHANCE symbol 403) in the upstream direction of the scrolling display from the display frame of the symbol display area 4 of the first display (lower side image display panel) is allocated.

Further, in the slot machine according to the embodiment of the present invention, as shown on a left side of FIG. 2, there may be a case where one part of the symbol column is stopped and displayed in the display frame of the symbol display area 4 of the first display (lower side image display panel). In such a case, the one part of the symbol column stopped and displayed in the display frame of the symbol display area 4 of the first display (lower side image display panel) may be constituted of only the BLANK symbol 401.

Therefore, in the present embodiment, at step S3-5, the processor determines whether or not the one part of the symbol column stopped and displayed in the display frame of the symbol display area 4 of the first display (lower side image display panel) is constituted of only the BLANK symbol 401.

When it is determined as a result of this determination that the one part of the symbol column stopped and displayed in the display frame of the symbol display area 4 of the first display (lower side image display panel) is constituted of only the BLANK symbol 401 (S3-5: YES), as shown on a right side of FIG. 2, still another rewriting process (step S3-6) is conducted by moving the symbol column so as to reach a position where a continuous arrangement of the BLANK symbols 401 is started.

Until the set number of free games is reduced to "0 (zero)", the free games are executed (step S5: NO). When the number of free games is reduced to zero, the processor returns to the base game (S5: YES).

[Explanation of a Function Flow]

With reference to FIG. 2, a basic function of the slot machine according to the embodiment of the present invention will be described. FIG. 2 is a diagram showing a function flow of the slot machine according to the embodiment of the present invention.

<Coin-In/Start-Check>

First, the slot machine checks whether or not any BET button is pressed by a player and subsequently checks whether or not a SPIN button is pressed by a player.

<Determination of Symbols>

Next, when the SPIN button is pressed by a player, the slot machine extracts random number values for determining symbols and determines symbols to be displayed to a player upon stopping of scrolling of symbol columns in accordance with the plurality of video reels displayed on the display.

<Display of Symbols>

Next, the slot machine starts the scrolling of the symbol columns of the respective video reels and stops the scrolling so as to display the determined symbols to a player.

<Winning Determination>

Next, upon stopping the scrolling of the symbol columns of the respective video reels, the slot machine determines whether or not a combination of the symbols displayed to a player is associated with a winning combination.

<Paying-Out>

Next, when the combination of the symbols displayed to a player is the winning combination, the slot machine awards a benefit in accordance with a kind of the combination of these symbols to a player. For example, when a combination of symbols related to a payout of coins is displayed, the slot machine pays out, to a player, coins whose number is in accordance with the combination of the symbols.

In addition, when the combination related to triggering of the bonus game is displayed, the slot machine initiates the bonus game. In the embodiment of the present invention, as the bonus game, without consuming coins, a set of a plurality of games (free games), in each of which a drawing for determining the above-described symbols scheduled to be stopped is conducted at a predetermined number of times, is conducted.

In addition, when a combination of symbols related to triggering of a jackpot is displayed, the slot machine pays out coins corresponding to a jackpot amount to a player. The jackpot functions such that portions of coins consumed by a player on respective slot machines are accumulated as jackpot amounts and, when the triggering of a jackpot has been achieved on any slot machine, coins corresponding to the accumulated jackpot amounts are paid out to such a slot machine. The slot machine calculates an amount to be accumulated as the jackpot amount each time one game is played (cumulative amount) and transmits the calculated amount to an external control apparatus. The external control apparatus accumulates cumulative amounts transmitted from the respective slot machines as the jackpot amounts.

In addition, in the slot machine, besides the above-mentioned benefit, benefits such as a mystery bonus and insurance are provided. The mystery bonus is to pay out coins corresponding to a predetermined amount upon the occurrence of winning in a dedicated drawing. When the SPIN button is pressed, the slot machine extracts random number values for the mystery bonus and determines, through the drawing, whether or not the triggering of the mystery bonus is to be achieved.

The insurance is a function provided for the purpose of helping a player who is in the situation where any bonus game is not conducted for a long period of time. In the embodiment of the present invention, whether or not the insurance is made active can be arbitrarily selected by a player. In exchange for a predetermined insurance purchase amount, the insurance is made active. When the insurance is made active, the slot machine starts counting of the number of times of games played. When without a large amount being paid out by the bonus game and the like, the counted number of times of the games played reaches a predetermined number of times, the slot machine pays out coins corresponding to an amount which has been set for the insurance.

<Determination of Presentation Effects>

The slot machine performs presentation effects through displaying of images using the display, outputting of light using a lamp, and outputting of sound using a loudspeaker. The slot machine extracts random number values for the presentation effects and based on symbols, determined through a drawing, and the like, determines contents of the presentation effects.

[The Whole of Game System]

Figure 3:
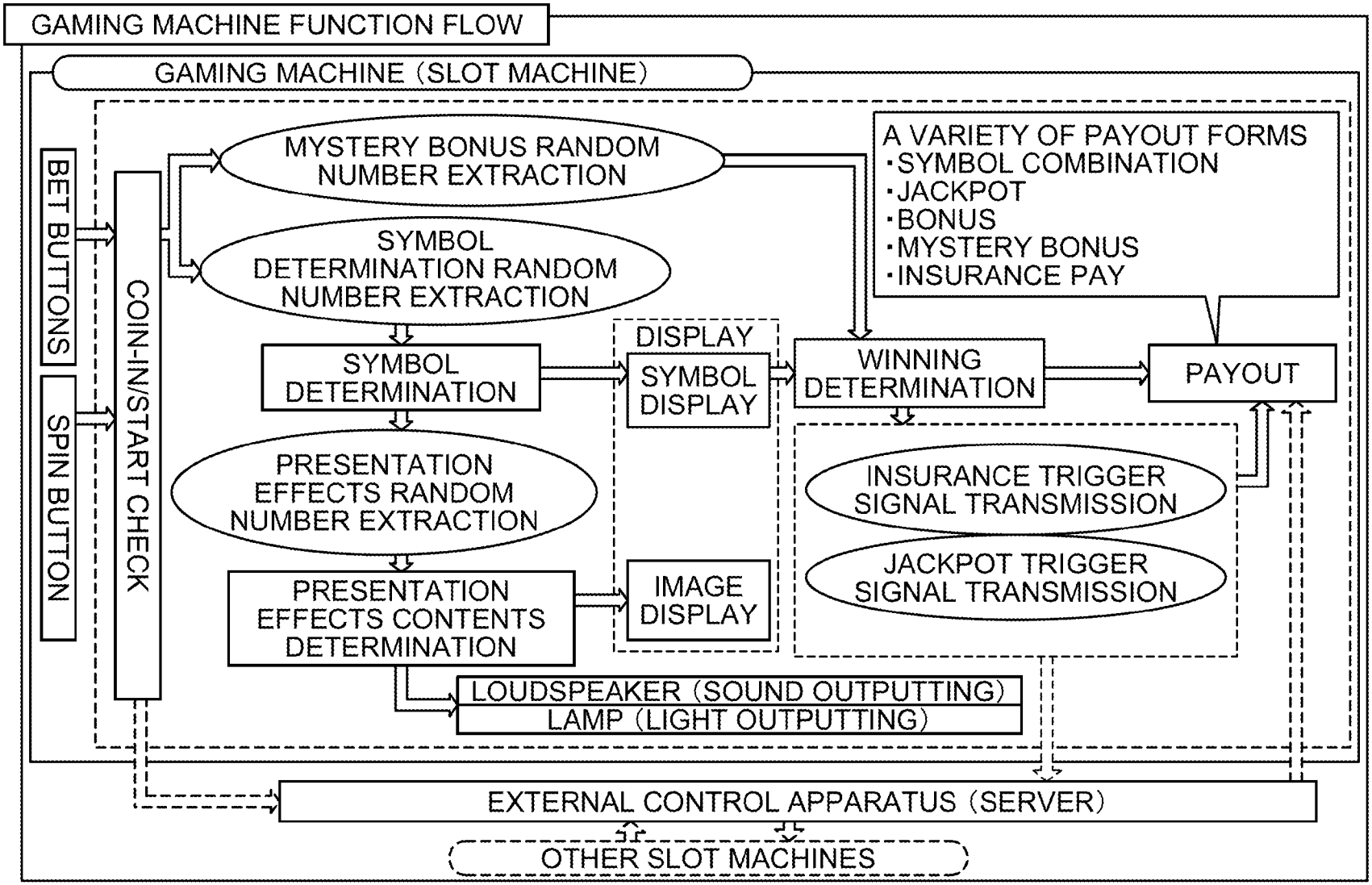
FIG. 3 is a diagram illustrating the game system including the slot machine according to the embodiment of the present invention.

The basic function of the slot machine is as described above. Next, with reference to FIG. 3, a game system including the slot machines will be described. FIG. 3 is a diagram illustrating the game system including the slot machines according to the embodiment of the present invention.

The game system 300 includes: a plurality of slot machines 1 and an external control apparatus 200 connected to the respective slot machines 1 via a communication line 301.

The external control apparatus 200 controls the plurality of slot machines 1. In the embodiment of the present invention, the external control apparatus 200 is the so-called hall server installed in a gaming house having the plurality of slot machines 1. Each of the slot machines 1 is provided with a unique identification number, and the external control apparatus 200 identifies a source of data transmitted from each of the slot machines 1 using each of the identification numbers. In addition, also when data is transmitted from the external control apparatus 200 to each of the slot machines 1, each of the identification numbers is used to designate a destination.

The game system 300 may be structured in one gaming house such as a casino or may be structured among a plurality of gaming houses. In addition, when the game system 300 is structured in one gaming house, the game system 300 may be structured in each floor or section of the gaming house. The communication line 301 may be either wired or wireless, and a dedicated line, a switched line, or the like can be employed as the communication line.

[Overall Structure of Slot Machine]

Figure 4:
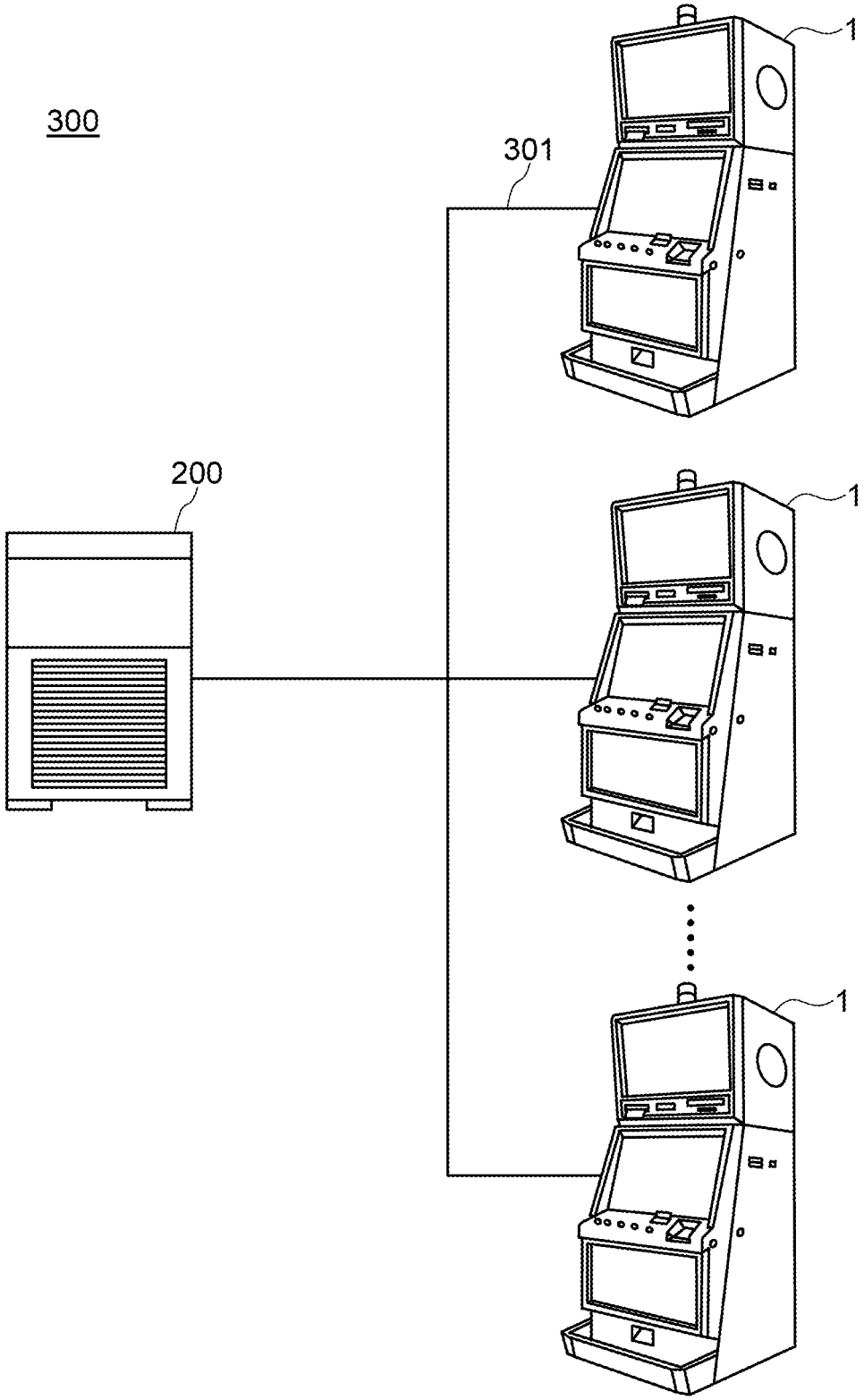
FIG. 4 is a diagram illustrating an overall structure of the slot machine according to the embodiment of the present invention
Figure 5:
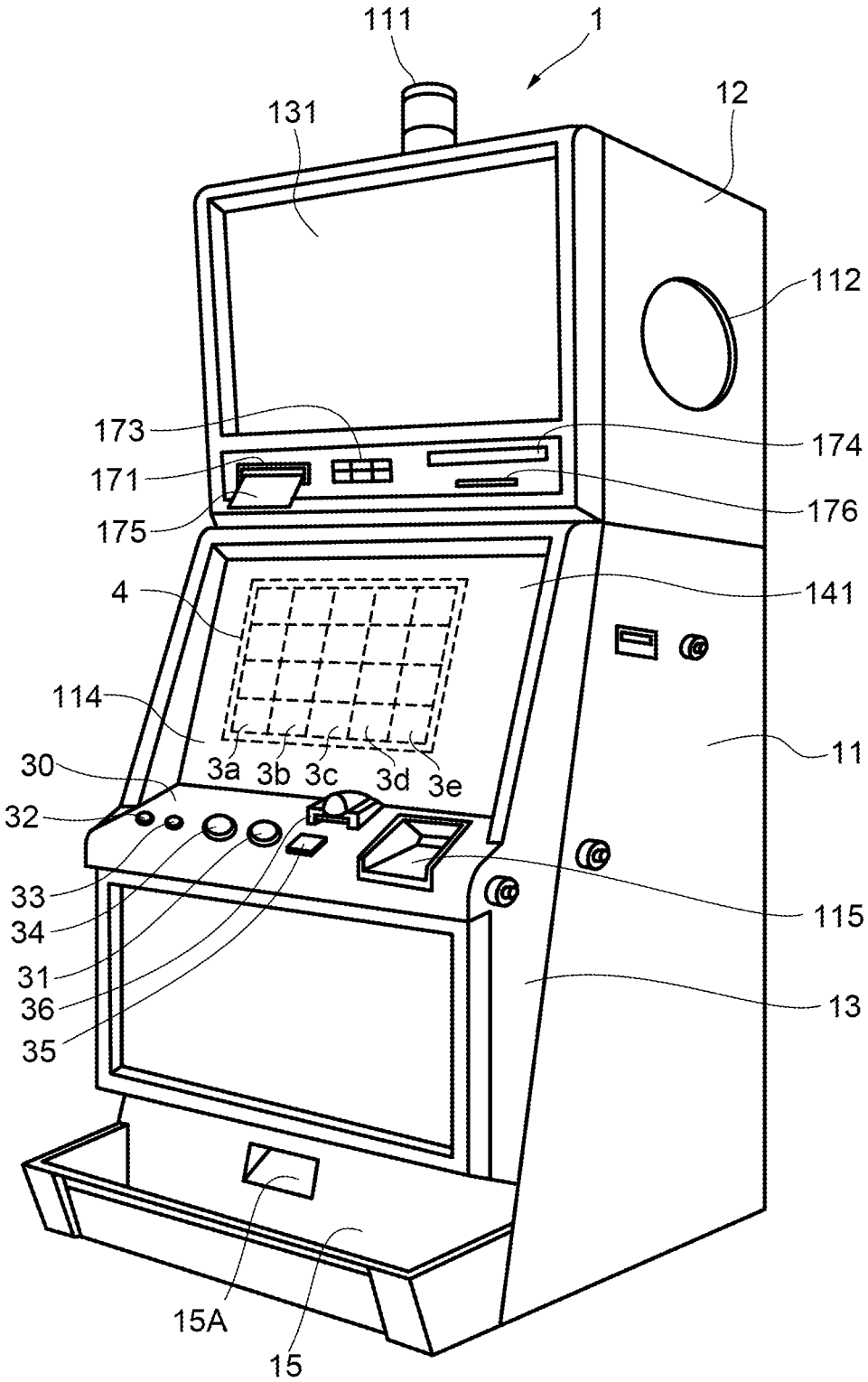
FIG. 5 shows arrangements of symbols depicted on peripheries of base game reels in the slot machine according to the embodiment of the present invention.

The game system according to the embodiment of the present invention is as described above. Next, with reference to FIG. 4, an overall structure of the slot machine 1 will be described. FIG. 4 is a drawing illustrating the overall structure of the slot machine according to the embodiment of the present invention.

On the slot machine 1, as gaming media, coins, bills, or electronic valuable information corresponding the coins or the bills is used. In addition, in the embodiment of the present invention, the later-described ticket having a bar code is also used. The gaming media are not limited thereto, and for example, medals, tokens, and electronic money may be adopted.

The slot machine 1 includes: a cabinet 11; a top box 12 installed on an upper side of the cabinet 11; and a main door 13 provided on a front face of the cabinet 11.

In the central portion of the main door 13, a lower side image display panel 141 is provided. The lower side image display panel 141 is formed of a liquid crystal panel, constituting the display. The lower side image display panel 141 has a symbol display area 4. In the symbol display area 4, five video reels 3 (3*a*, 3*b*, 3*c*, 3*d*, and 3*e*) are displayed. In the embodiment of the present invention, the video reels are to represent, with images, motions of rotation and stoppage of mechanical reels whose peripheries have a plurality of symbols depicted thereon. Each of respective symbol columns composed of a predetermined plurality of symbols is assigned to each of the video reels 3 (refer to FIG. 6 later described).

In the symbol display area 4, the respective symbol columns assigned to the respective video reels 3 are each scrolled and after a predetermined lapse of time, are stopped. As a result, a part of each of the respective symbol columns (in the embodiment of the present invention, four symbols) are displayed to a player. In the symbol display area 4, on each of the video reels 3, each one symbol is displayed in each of four areas in an upper row, a middle upper row, a middle lower row, and a lower row. In other words, in the symbol display area 4, 20 symbols, 4 symbols/column×5 symbols/row, are displayed.

In the embodiment of the present invention, any of the above-mentioned four areas is selected in accordance with each of the respective video reels 3, and the respective selected areas are connected to form a line, which is defined as a payline. A specific form of the payline can be arbitrarily adopted. However, for example, besides a linear line formed by connecting the respective areas in the middle upper row in accordance with the respective video reels 3, a V-shaped line, a bent-shape line, and the like can be adopted. In addition, as to the number of paylines, although in the embodiment of the present invention, the number of paylines are 30, as the number of paylines, for example, 50 and the like can be arbitrarily adopted.

In the embodiment of the present invention, since the number of paylines is 30, a LINE display and LINE presentation effects are switched at 1.0-second intervals.

In addition, in the lower side image display panel 141, a touch panel 114 is built-in. A player can input a variety of instructions by touching the lower side image display panel 141.

Below the lower side image display panel 141, a variety of buttons placed on a control panel 30 and a variety of devices to be operated by a player are located.

A SPIN button 31 is used upon starting the scrolling of the symbol columns of the respective video reels 3. A CHANGE button 32 is used upon requesting exchange from a gaming house employee. A CASHOUT button 33 is used upon paying out coins deposited inside the slot machine 1 to a coin tray 15.

A 1-BET button 34 and a MAX BET button 35 are to determine the number of coins (hereinafter, referred to as the number of BETs) used in gaming from coins deposited inside the slot machine 1. The 1-BET button 34 is used upon determining the above-mentioned number of BETs in a unit of one coin. The MAX BET button 35 is used upon selecting a predefined upper limit number as the above-mentioned number of BETs.

A coin receiving slot 36 is provided to receive coins. A bill validator 115 is provided to receive bills. A bill validator 115 identifies whether or not each bill is legitimate and receives legitimate bills into the cabinet 11. The bill validator 115 may be configured to be capable of reading the later-described ticket having a bar code 175.

On a front face of the top box 12, an upper side image display panel 131 is provided. The upper side image display panel 131 is composed of a liquid crystal panel, constituting the display. On the upper side image display panel 131, images related to the presentation effects and images which indicate introduction of contents of games and explanation of rules of the games are displayed. In addition, on the top box 12, a loudspeaker 112 and a lamp 111 are provided. On the slot machine 1, the presentation effects are conducted by displaying images, outputting sound, and outputting light.

Below the upper side image display panel 131, a ticket printer 171, a card slot 176, a data indicator 174, and a keypad 173 are provided.

The ticket printer 171 is to print onto a ticket a bar code in which data such as the number of credit, time and date, and an identification number of a slot machine 1 is coded and output the ticket as a ticket having a bar code 175. A player can cause the slot machine to read out the ticket having a bar code 175 to play a game and can exchange the ticket having a bar code 175 for bills and the like at a predetermined place of a gaming house (for example, a cashier within a casino), The card slot 176 is to insert a card having predetermined data stored thereon thereinto. For example, a card has stored thereon data for identifying a player and data related to a history of games played by a player. On the card inserted into the card slot 176, data reading and data writing are conducted by the later-described card reader 172. The card may have data corresponding to coins, bills, or a credit stored thereon.

The data indicator 174 is composed of a fluorescent display, an LED, or the like and is to display, for example, data read by the card reader 172 and data inputted by a player via the keypad 173. The keypad 173 is to input instructions and data related to issuance of a ticket and the like.

[Symbol Columns of Video Reels]

The overall structure of the slot machine 1 is as described above. Next, with reference to FIG. 6 to FIG. 18, a configuration of the symbol columns which the video reels 3 of the slot machine 1 have will be described. FIG. 6 shows arrangements of symbols depicted on the peripheries of the base game reel strips in the slot machine according to the embodiment of the present invention. Each of FIG. 7 to FIG. 18 shows arrangements of symbols depicted on the peripheries of the free game reel strips in the slot machine according to the embodiment of the present invention.

As shown in FIG. 6, on the base game reels, to a first video reels 3*a*, a second video reels 3*b*, a third video reels 3*c*, a fourth video reels 3*d*, and a fifth video reels 3*e*, symbol columns, each of which is constituted of 22 symbols corresponding to code Nos. "00" to "21", are assigned, respectively.

As kinds of symbols depicted on peripheries of the base game reels, symbols "JACKPOT 7", "BLUE 7", "BELL", "CHERRY", "STRAWBERRY", "PLUM", "ORANGE", and "APPLE" are provided.

Figure 7:
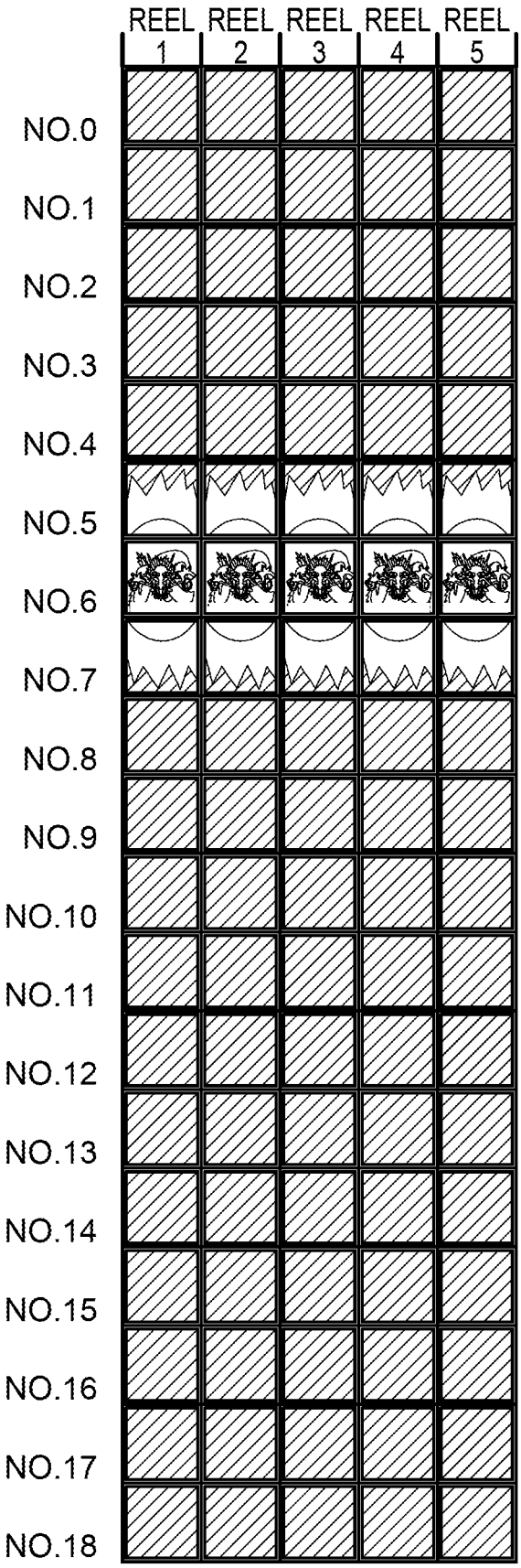
FIG. 7 shows arrangements of symbols depicted on peripheries of free game reels in the slot machine according to the embodiment of the present invention.
Figure 8:
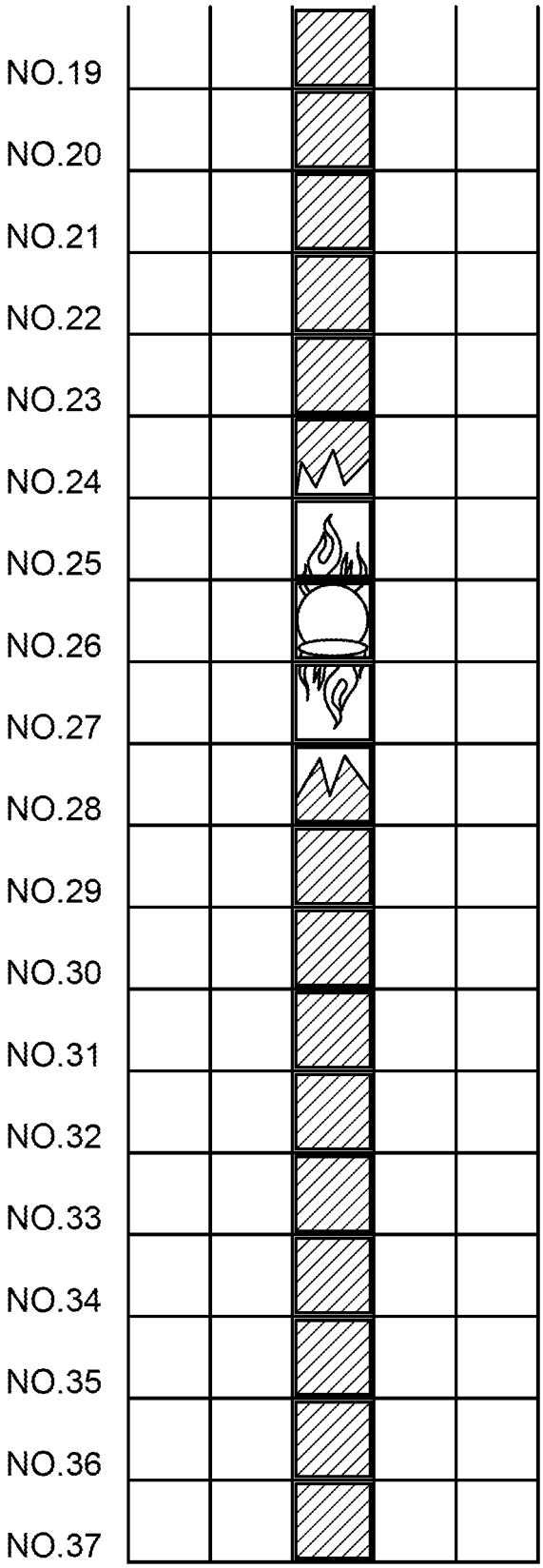
FIG. 8 shows arrangements of symbols depicted on peripheries of free game reels in the slot machine according to the embodiment of the present invention.
Figure 9:
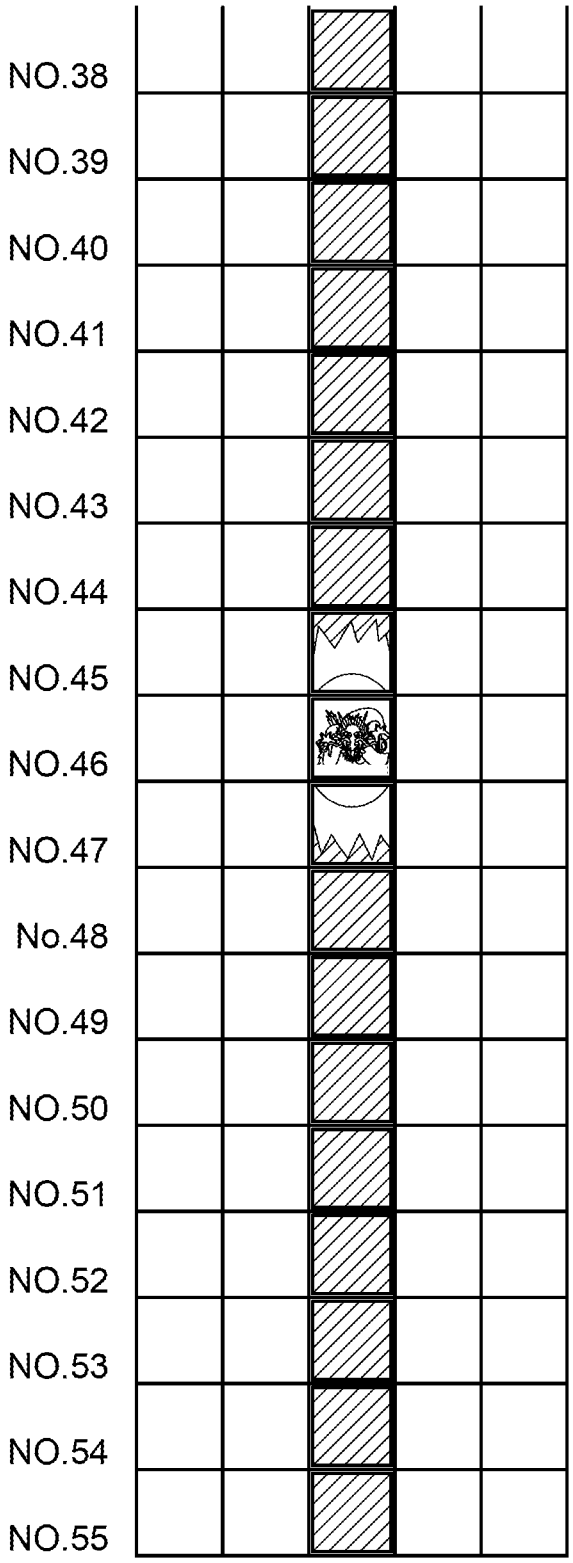
FIG. 9 shows arrangements of symbols depicted on peripheries of free game reels in the slot machine according to the embodiment of the present invention.
Figure 10:
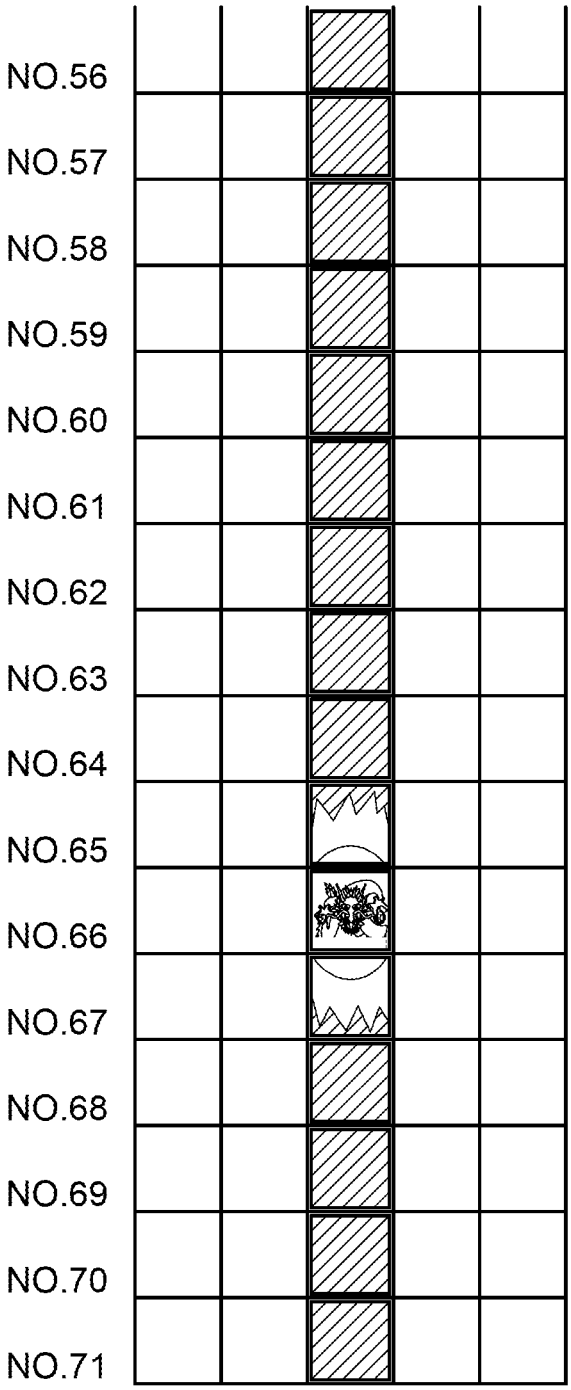
FIG. 10 shows arrangements of symbols depicted on peripheries of free game reels in the slot machine according to the embodiment of the present invention.
Figure 11:
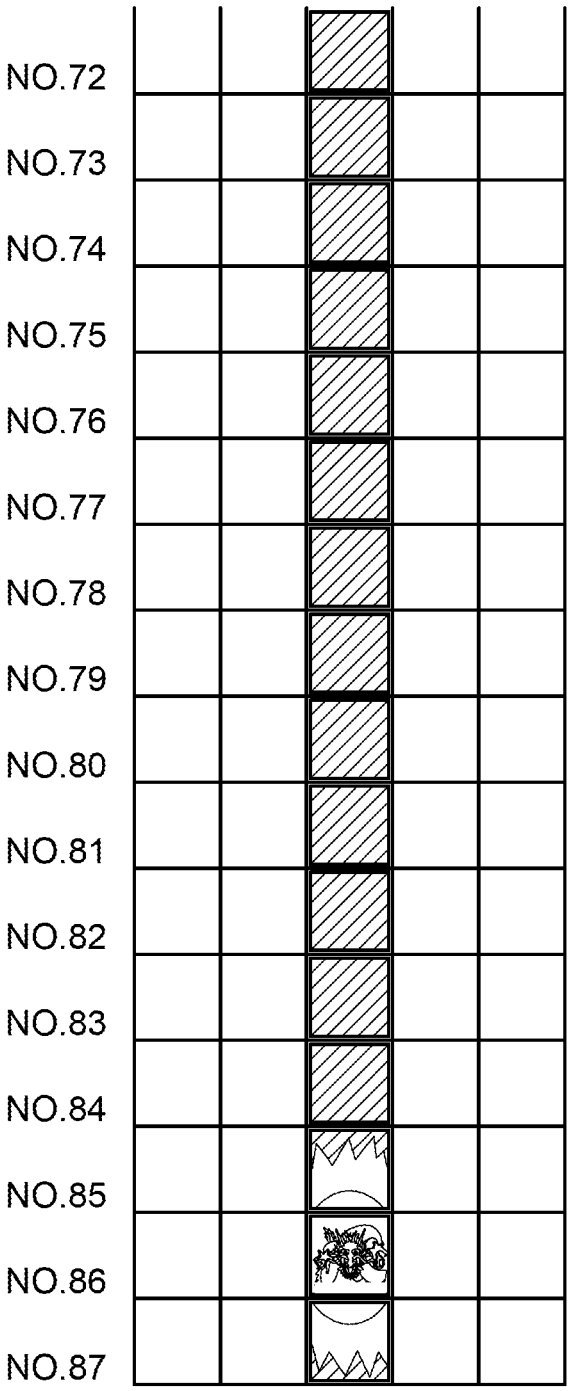
FIG. 11 shows arrangements of symbols depicted on peripheries of free game reels in the slot machine according to the embodiment of the present invention.
Figure 12:
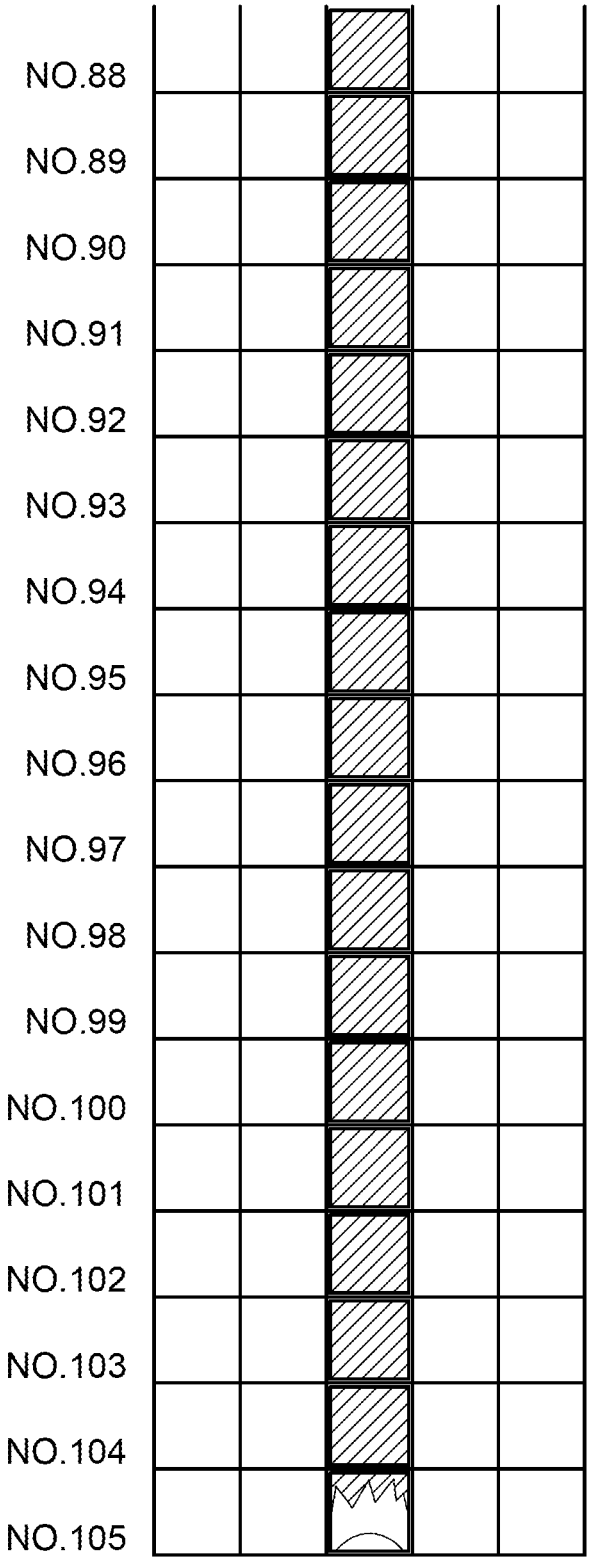
FIG. 12 shows arrangements of symbols depicted on peripheries of free game reels in the slot machine according to the embodiment of the present invention.
Figure 13:
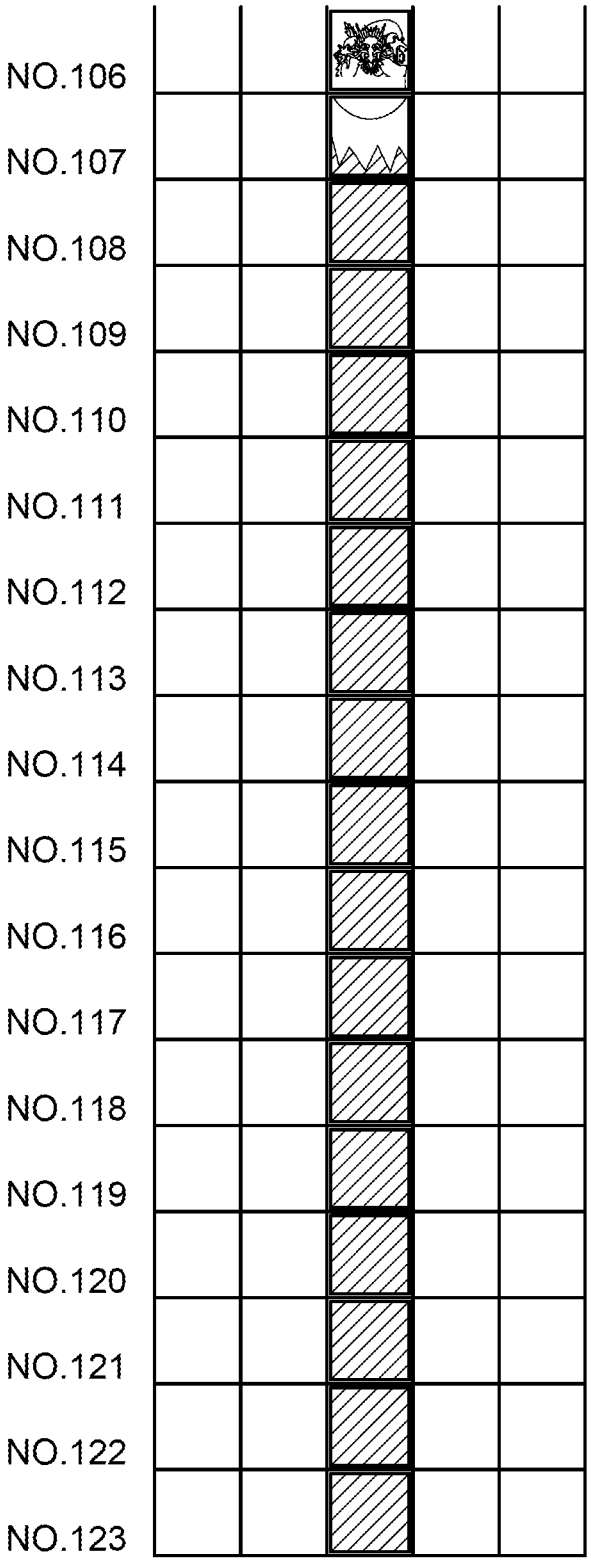
FIG. 13 shows arrangements of symbols depicted on peripheries of free game reels in the slot machine according to the embodiment of the present invention.
Figure 14:
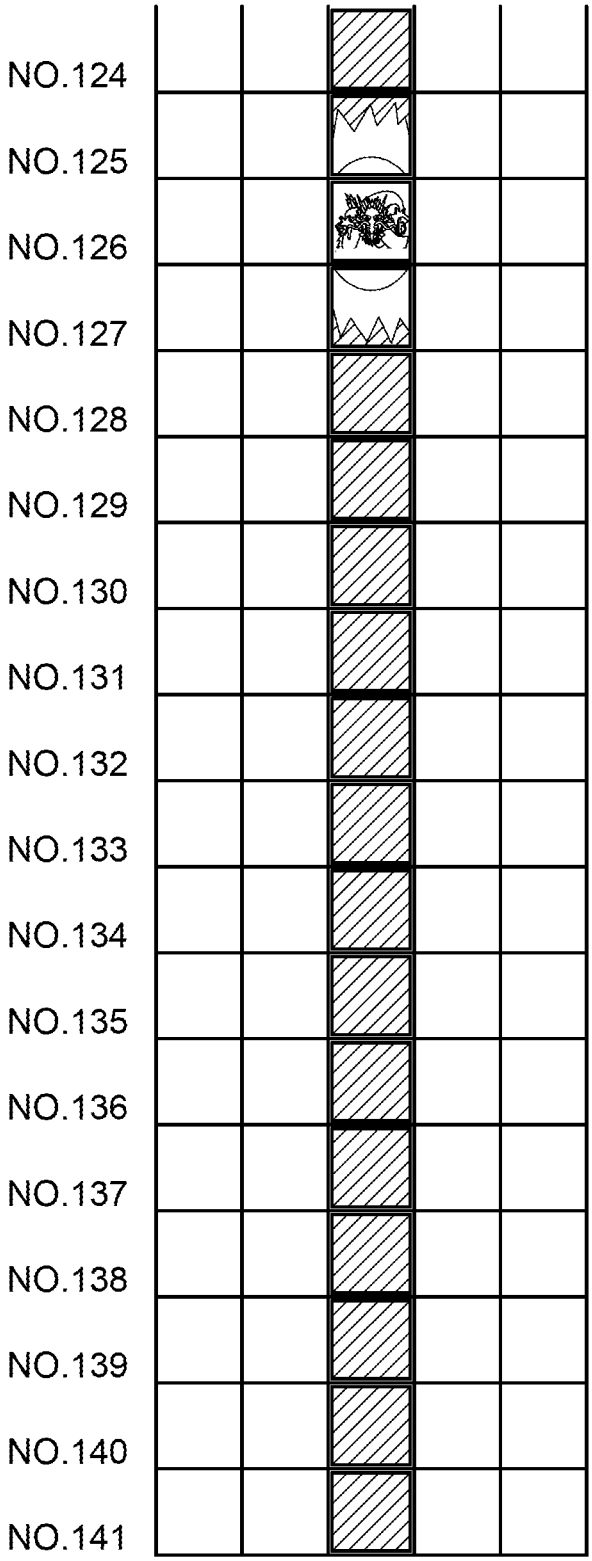
FIG. 14 shows arrangements of symbols depicted on peripheries of free game reels in the slot machine according to the embodiment of the present invention.
Figure 15:
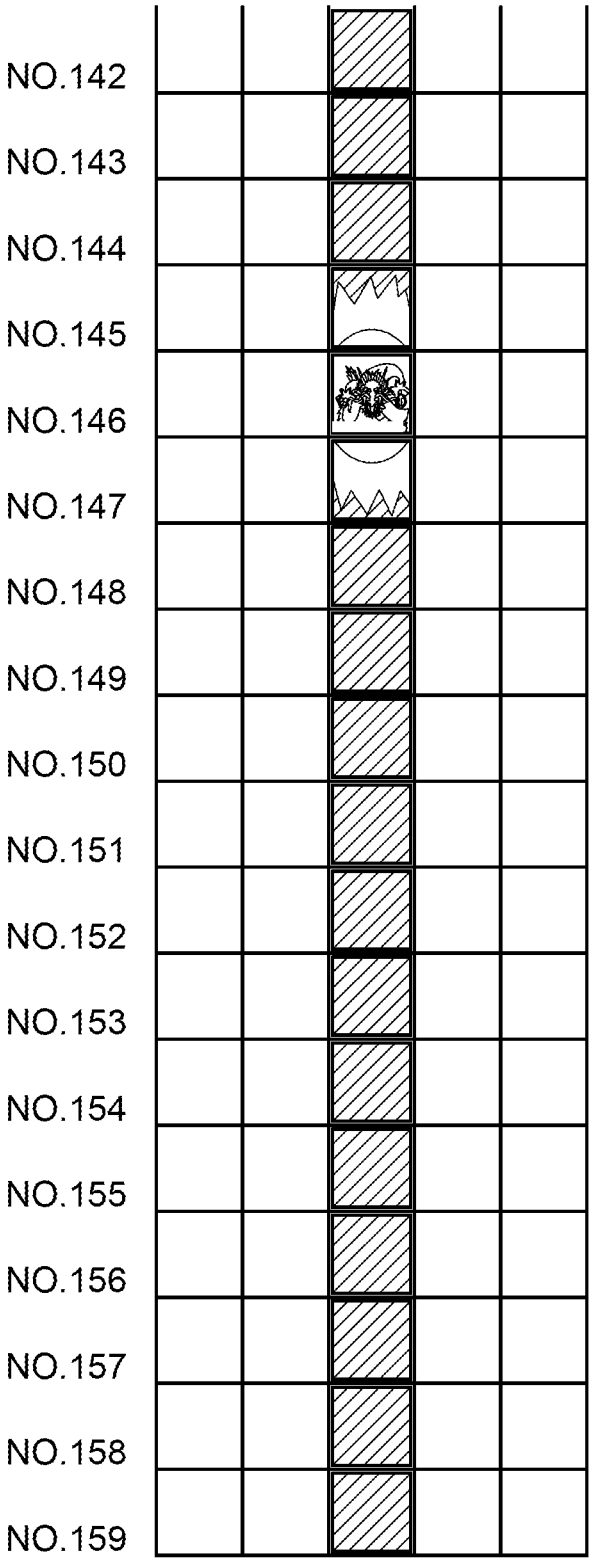
FIG. 15 shows arrangements of symbols depicted on peripheries of free game reels in the slot machine according to the embodiment of the present invention.
Figure 16:
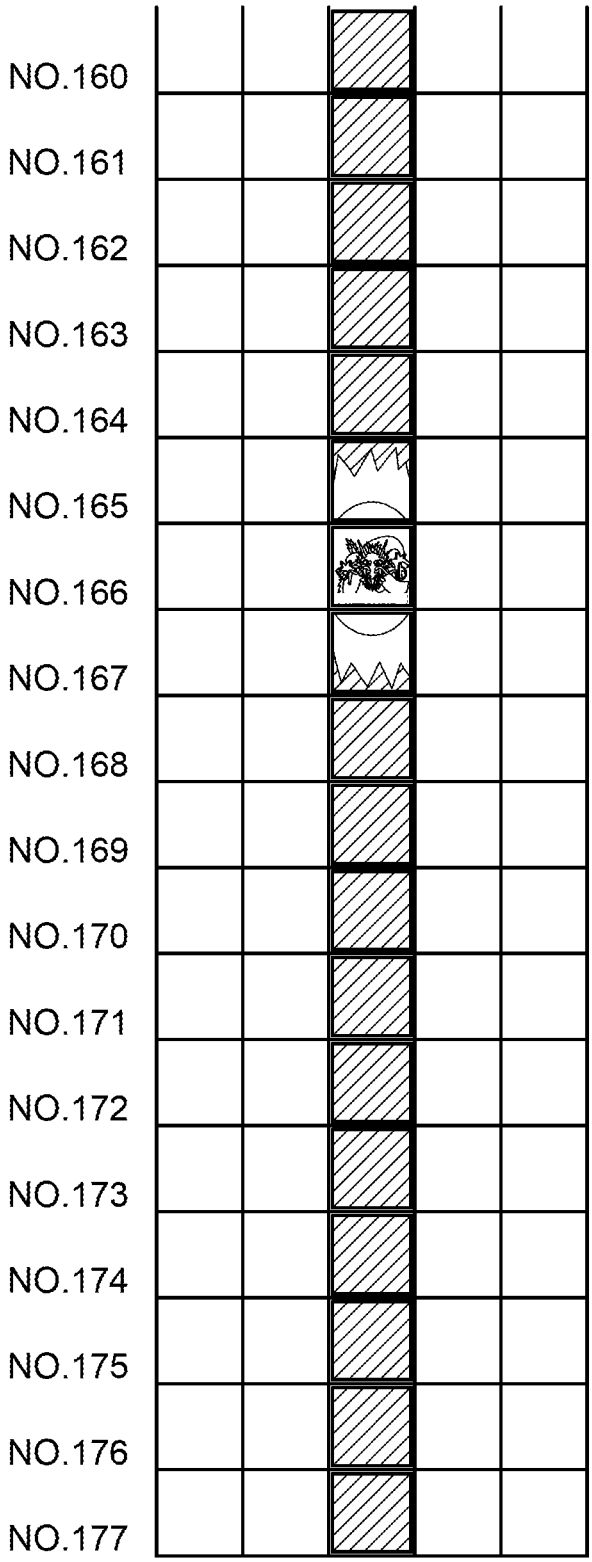
FIG. 16 shows arrangements of symbols depicted on peripheries of free game reels in the slot machine according to the embodiment of the present invention.
Figure 17:
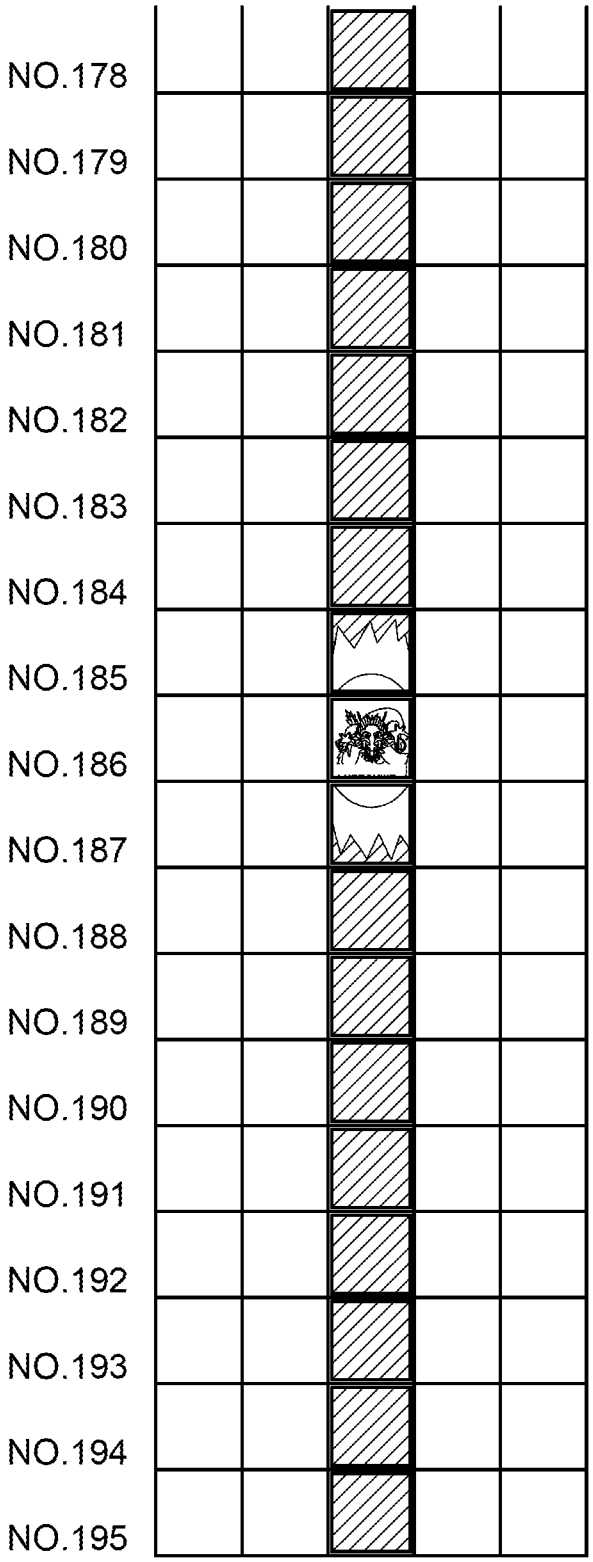
FIG. 17 shows arrangements of symbols depicted on peripheries of free game reels in the slot machine according to the embodiment of the present invention.
Figure 18:
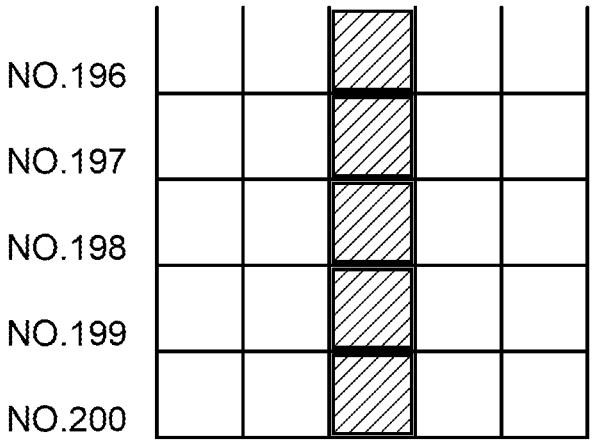
FIG. 18 shows arrangements of symbols depicted on peripheries of free game reels in the slot machine according to the embodiment of the present invention.

As shown in FIG. 7, on the free game reels, to a first video reel (REEL 1) 3*a*, a second video reel (REEL 2) 3*b*, a third video reel (REEL 3), a fourth video reel (REEL 4) 3*d*, and a fifth video reel (REEL 5) 3*e*, symbol columns, each of which is constituted of 19 symbols corresponding to code Nos. "0" to "18", are assigned, respectively.

As shown in FIG. 7 to FIG. 18, on the free game reels, to the third video reel (REEL 3) 3*c*, a symbol column which is constituted of 201 symbols corresponding to code Nos. "0" to "200" is assigned.

As kinds of symbols depicted on peripheries of the free game reels, symbols "BLANK", "DRAGON", and "CHANCE" are provided. In other words, the above-described BLANK symbol 401, DRAGON symbol 402, and CHANCE symbol 403 are provided.

[Configuration of Circuitry included in Slot Machine]

Figure 19:
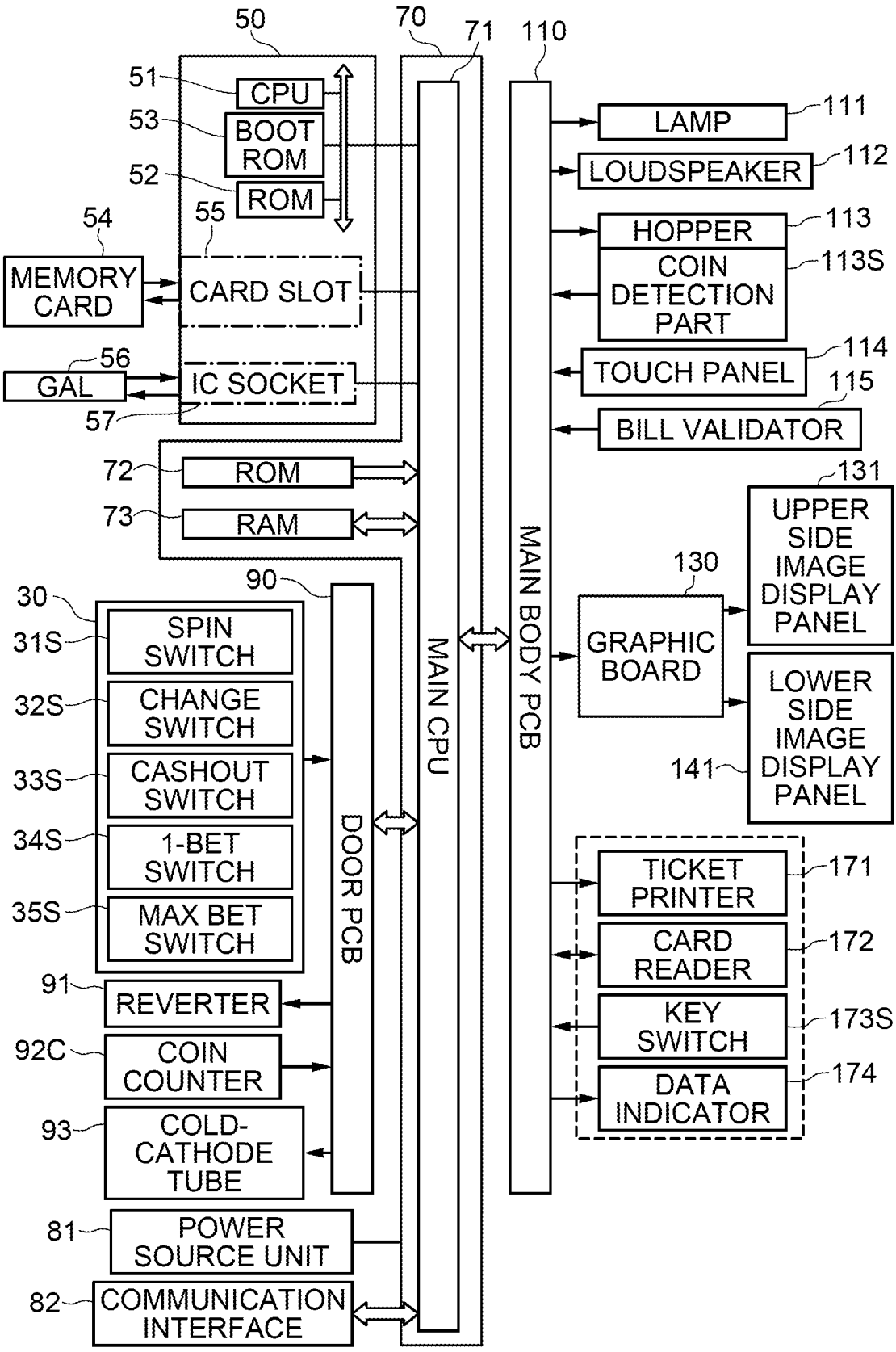
FIG. 19 is a block diagram illustrating an internal configuration of the slot machine according to the embodiment of the present invention.

The configuration of the symbol columns which the video reels 3 of the slot machine 1 have is as described above. Next, with reference to FIG. 19, a configuration of circuitry which the slot machine 1 includes will be described. FIG. 19 is a block diagram illustrating an internal configuration of the slot machine according to the embodiment of the present invention.

A gaming board 50 includes: a CPU 51, a ROM 52, and a boot ROM 53, which are connected to one another by an internal bus; a card slot 55 associated with a memory card 54; and an IC socket 57 associated with a GAL (Generic Array Logic) 56.

The memory card 54 is composed of a nonvolatile memory and has a game program and a game system program stored thereon. The game program includes a program related to game proceeding, a drawing program, and a program for executing presentation effects by images and sounds (for example, refer to FIG. 32 to FIG. 41B described later). In addition, the above-mentioned game program includes data (refer to FIG. 6 to FIG. 18) which defines the configuration of the symbol columns assigned to the respective video reels 3.

The drawing program is to determine symbols on the respective video reels 3, which are scheduled to be stopped, by a drawing. The data pertinent to the symbols scheduled to be stopped is data for determining three symbols displayed in the symbol display area 4 from the plurality of symbols constituting each of the symbol columns. The slot machine 1 according to the embodiment of the present invention determines symbols displayed in predetermined areas (for example, the areas in the upper row) among the four areas associated with each of the video reels 3 as the symbols scheduled to be stopped.

The above-mentioned drawing program includes symbol determination data. The symbol determination data is to define random number values in accordance with each of the video reels 3 such that each of the plurality of symbols constituting each of the symbol columns is determined with an equal probability. For example, in a case of the first video reel 3*a* for the base game, by using the symbol determination data, random number values are determined such that each of the 22 symbols (code Nos. "00" to "21") is determined with the equal probability (specifically, 1/22). However, since the numbers of the respective kinds of the symbols included in the 22 symbols are different, probabilities with which the respective kinds of the symbols are determined are different from one another (in other words, weights are yielded). For example, with reference to FIG. 6, the number of the symbols "JACKPOT 7" included in the symbol column of the first video reel 3*a* for the base game is 1 whereas the number of the symbols "ORANGE" included in the symbol column of the first video reel 3*a* for the base game is 7. Accordingly, the former is determined with a probability of "1/22" whereas the latter is determined with a probability of "7/22".

In the embodiment of the present invention, the data is defined such that the numbers of symbols constituting the symbol columns of the respective video reels 3 for the base game are the same as one another. However, as on the respective video reels 3 for the free games, the numbers of the kinds of the symbols constituting the respective symbol columns may be different from one another. For example, as on the respective video reels 3 for the free games, the number of symbols constituting the symbol column of only the video reel 3*c* may be 201, and the number of symbols constituting each of the other video reels 3*a*, 3*b*, 3*d*, and 3*e* may be 19. Thus, a degree of freedom upon setting probabilities with which the respective kinds of symbols are determined in accordance with each of the video reels 3 is increased.

In addition, in the present embodiment, the video reels for the base game and the video reels for the bonus game are configured such that a memory card 54 has stored thereon previously prepared images of base game video reel strips and previously prepared images of bonus game video reel strips, and the processor including a CPU executes programs stored on the memory card 54, thereby triggering the bonus game, and at this timing, the images of the base game video reel strips are replaced with the images of the bonus game video reel strips.

In FIG. 7 to FIG. 18, arrangements of the symbols depicted on the peripheries of the above-described free game reels are illustrated. As is clearly seen by the comparison with FIG. 6, in the area in which the three symbols are stopped and displayed in one column of each of the base game video reels, each of the continuous symbols (the later-described CHANCE symbol and DRAGON symbol) whose each number is smaller than the number of symbols used in the base game and whose kinds are different from the kinds of symbols used in the base game is used. In other words, in the base game, with reference to FIG. 6, eight kinds of the symbols "JACKPOT 7", "PLUM", "ORANGE", "BLUE 7", "CHERRY", "BELL", "STRAWBERRY", and "APPLE" are arranged. In the free games in the bonus game, the reel strips on which three kinds of the symbols "BLANK", "CHANCE", and "DRAGON" are arranged are used.

As in the above-described present embodiment, the number of kinds of the symbols used in the free games in the bonus game is made smaller than that in the base game, thereby allowing a player to easily determine presence or absence of winning, and thus, it is made easy for a player to confirm the occurrence of winning in the unit free games in the bonus game whose likelihood of obtaining a payout is higher than that in the base game.

In addition, the number of kinds of the symbols is reduced and the plurality of the symbol arrangement areas in the plurality of symbol arrangement areas in the base game are utilized to arrange the one vertically long continuous symbol in the plurality of symbol arrangement areas, thereby avoiding a problem in that the number of the symbols "BLANK" on the reel strips is increased and the appearance of the reel strips is thereby likely to be worsened.

In addition, the card slot 55 is configured such that the memory card 54 can be inserted thereto and pulled out therefrom and is connected to a mother board 70 by an IDE bus.

The GAL 56 is a kind of a PLD (Programmable Logic Device) having a fixed OR array architecture. The GAL 56 includes a plurality of input ports and output ports and when each of the input ports has received a predetermined input, corresponding data is outputted from each of the output ports.

In addition, the IC socket 57 is configured such that the GAL 56 is detachable and is connected to the mother board 70 by a PCI bus. The memory card 54 is replaced with a memory card having another program written thereon or the program written on the memory card 54 is replaced with another program, thereby allowing the contents of a game played on each of the slot machines 1 to be changed.

The CPU 51, the ROM 52, and the boot ROM 53 connected to one another by the internal bus are connected to the mother board 70 by the PCI bus. The PCI bus transmits signals between the mother board 70 and the gaming board 50 and supplies power from the mother board 70 to the gaming board 50.

The ROM 52 has an authentication program stored thereon. The boot ROM 53 has stored thereon an auxiliary authentication program, a program (boot code) for allowing the CPU 51 to activate the auxiliary authentication program, and the like. The authentication program is a program (tampering check program) for authenticating the game program and the game system program. The auxiliary authentication program is a program for authenticating the above-mentioned authentication program. The authentication program and the auxiliary authentication program are written along a procedure (authentication procedure) for authenticating that a targeted program is not tampered.

The mother board 70 includes: a main CPU 71, a ROM 72, a RAM 73, and a communication interface 82.

The ROM 72 is composed of a memory device such as a flash memory and has stored thereon a program such as a BIOS (Basic Input/Output System) executed by the main CPU 71 and permanent data. When the BIOS is executed by the main CPU 71, an initialization process for predetermined peripheral devices is conducted. In addition, via the gaming board 50, a process for loading the game program and the game system program stored on the memory card 54 is started.

The RAM 73 has stored thereon data and programs used when the main CPU 71 operates. For example, when the process for loading the above-described game program and game system program and the authentication program is conducted, these can be stored thereon. In addition, the RAM 73 is provided with working areas for executing each of the above-mentioned programs. For example, provided are an area for storing the number of games, the number of BETs, the number of payouts, the number of credits, and the like and an area for storing symbols (code Nos.) determined by a drawing.

A communication interface 82 is to communicate with the external control apparatus 200 such as a server via the communication line 301. In addition, connected to the mother board 70 by USBs are the later-described door PCB (Printed Circuit Board) 90 and main body PCB 110. Further, connected to the mother board 70 is a power source unit 81. When power is supplied from the power source unit 81 to the mother board 70, the main CPU 71 of the mother board 70 is activated and the power is supplied to the gaming board 50 via the PCI bus, thereby activating the CPU 51.

Connected to the door PCB 90 and the main body PCB 110 are input devices such as switches and sensors; and peripheral devices whose operations are controlled by the main CPU 71. Connected to the door PCB 90 are a control panel 30, a reverter 91, a coin counter 92C, and a cold-cathode tube 93.

The control panel 30 is provided with a SPIN switch 31S, a CHANGE switch 32S, a CASHOUT switch 33S, a 1-BET switch 34S, and a MAX BET switch 35S so as to correspond to the above-described respective buttons. Each of the switches detects that each of the corresponding buttons is pressed by a player and outputs a signal to the main CPU 71.

A coin counter 92C makes a selection to determine whether or not a material, a shape, and the like of each of the coins inputted into the coin receiving slot 36 are appropriate. Upon detecting each appropriate coin, the coin counter 92C outputs a signal to the main CPU 71. In addition, inappropriate coins are discharged from a coin payout opening 15A.

The reverter 91 operates based on a control signal outputted from the main CPU 71 and distributes the appropriate coins selected by the coin counter 92C to a hopper 113 or a cashbox (not shown). When the hopper 113 is not filled with the coins, the appropriate coins are distributed to the hopper 113 and when the hopper 113 is filled with the coins, the appropriate coins are distributed to the cashbox.

A cold-cathode tube 93 functions as a backlight installed on a side of back surfaces of the upper side image display panel 131 and the lower side image display panel 141 and lights up based on a control signal outputted from the main CPU 71.

Connected to the main body PCB 110 are the lamp 111, the loudspeaker 112, the hopper 113, a coin detection part 113S, the touch panel 114, the bill validator 115, a graphic board 130, the ticket printer 171, the card reader 172, a key switch 173S, and the data indicator 174.

The lamp 111 lights up based on a control signal outputted from the main CPU 71. The loudspeaker 112 outputs sound such as BGM based on a control signal outputted from the main CPU 71.

The hopper 113 operates based on a control signal outputted from the main CPU 71 and pays out coins, whose payout number is designated, from the coin payout opening 15A to the coin tray 15. The coin detection part 113S detects the coins provided by the hopper 113 and outputs a signal to the main CPU 71.

The touch panel 114 detects a position touched by a finger or the like of a player on the lower side image display panel and outputs a signal corresponding to the detected position to the main CPU 71. The bill validator 115, upon accepting each legitimate bill, outputs a signal in accordance with an amount of the accepted bill to the main CPU 71.

The graphic board 130 controls a display of images, performed by each of the upper side image display panel 131 and the lower image display panel 141, based on a control signal outputted from the main CPU 71. In the symbol display area 4 of the lower side image display panel 141, the five video reels 3 are displayed, and motions of the scrolling and the stoppage of the symbol columns which the respective video reels 3 have are displayed. The graphic board 130 includes a VDP for generating image data, a video RAM for storing the image data generated by the VDP, and the like.

In addition, the graphic board 130 includes the VDP (Video Display Processor) for generating image data based on a control signal outputted from the main CPU 71, the video RAM for temporarily storing the image data generated by the VDP, and the like. The image data used when the image data is generated by the VDP is included in the game program read out from the memory card 54 and stored in the RAM 73.

The ticket printer 171 prints onto a ticket a bar code, in which data such as the number of credits stored on the RAM 73, time and date, and an identification number of a slot machine 1 is coded, based on a control signal outputted from the main CPU 71 and outputs the ticket as a ticket having a bar code 175.

The card reader 172 reads out data stored on a card inserted into the card slot 176, transmits the data to the main CPU 71, and writes the data based on a control signal from the main CPU 71.

The key switch 173S is provided on the keypad 173 and, when the keypad 173 is operated by a player, outputs a predetermined signal to the main CPU 71.

The data indicator 174 displays the data read out by the card reader 172 and the data inputted by a player via the keypad 173, based on a control signal outputted from the main CPU 71.

[Configuration of Symbol Combination Table]

The configuration of the circuitry of the slot machine 1 is as described above. Next, with reference to FIG. 20, a symbol combination table will be described. FIG. 20 shows the base game symbol combination table of the slot machine according to the embodiment of the present invention.

The base game symbol combination table defines symbol combinations and the numbers of payouts associated with winning. On the slot machine 1, when the scrolling of the symbol columns of the respective video reels 3 is stopped and a combination of symbols displayed on a payline matches any combination of symbols defined in the symbol combination table, winning occurs. In accordance with the winning, a player is provided with a benefit such as a payout of coins or an initiation of the bonus game. When a combination of symbols displayed on a payline does not match any of the combinations of symbols defined in the symbol combination table, no winning occurs (that is, losing occurs).

Basically, when all of the symbols displayed on a payline by the respective video reels 3 are symbols whose kind is one of the kinds of the symbols "JACKPOT 7", "APPLE", "BLUE 7", "BELL", "CHERRY", "STRAWBERRY", "PLUM", and "ORANGE", winning occurs. However, with respect to the kinds of the symbols "CHERRY" and "ORANGE", also when one or three symbols of one of the kinds thereof are displayed on a payline by the video reels 3, winning occurs. For example, when the symbols "BLUE 7" are displayed together on a payline by all of the video reels 3, a winning combination results in "BLUE" and "10" is determined as the number of a payout. Coins whose number is based on the determined number of a payout are paid out. The paying-out of the coins is conducted by actually discharging the coins from a coin payout opening 15A, by performing an addition to the number of credits, or by issuing a bar code ticket.

The symbols "JACKPOT 7" are symbols associated with a jackpot trigger. When the symbols "JACKPOT 7" are displayed together on a payline by all of the video reels 3, a winning combination results in a "jackpot" and a jackpot amount is determined as the number of a payout. The symbols "APPLE" are symbols associated with a bonus game trigger. When the symbols "APPLE" are displayed together on a payline by all of the video reels 3, a winning combination result in a "bonus game trigger" and starting from the next game, the bonus game (free games) is initiated.

Figure 31:
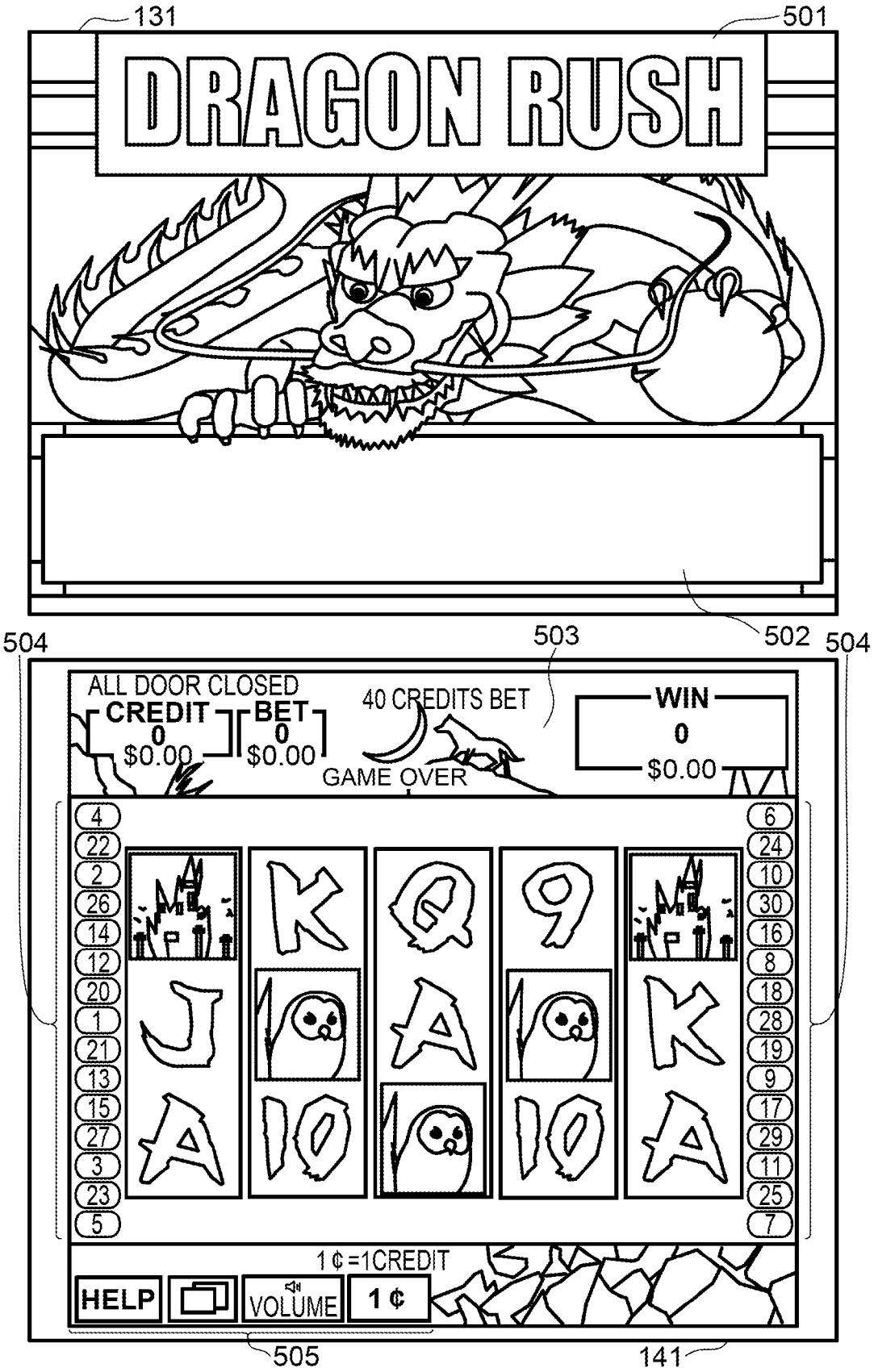
FIG. 31 is a diagram illustrating an image specification of the slot machine according to the embodiment of the present invention.

However, in the present embodiment, to facilitate understanding, the symbols illustrated in and after FIG. 31 are different from those described above. For example, symbols associated with the bonus game trigger are symbols "BONUS", when three or more symbols "BONUS" have appeared, a winning combination results in a "bonus game trigger" and starting from the next game, the bonus game (free games) is initiated. When each of the symbol "BONUS" and a symbol "SCATTER" is stopped on a payline without the arrangement of a plurality of these symbols of each of thereof in succession, a payout is provided. In contrast to this, when a plurality of the symbols of each of the kinds of symbols other than the symbol "BONUS" and the symbol "SCATTER" are not arranged in succession at least LEFT TO RIGHT, no payout is provided. In addition, as the winning combinations, there are "5 OF A KIND", "BIG WIN", "GREAT", and the like.

In addition, for the symbols whose each payout is normal, frame/line presentation effects are conducted. In contrast to this, for the symbols "BONUS", a symbol frame is not displayed, and because of the symbol "SCATTER", no line presentation effects are conducted.

As to a free game symbol combination table, when the DRAGON symbol 402 or the CHANCE symbol 403 is displayed, a payout amount is determined by a dedicated drawing.

[Contents of Programs]

The symbol combination tables are as described above. Next, with reference to FIG. 16 to FIG. 25, programs executed by the slot machine 1 will be described.

<Main Control Processes>

Figure 21:
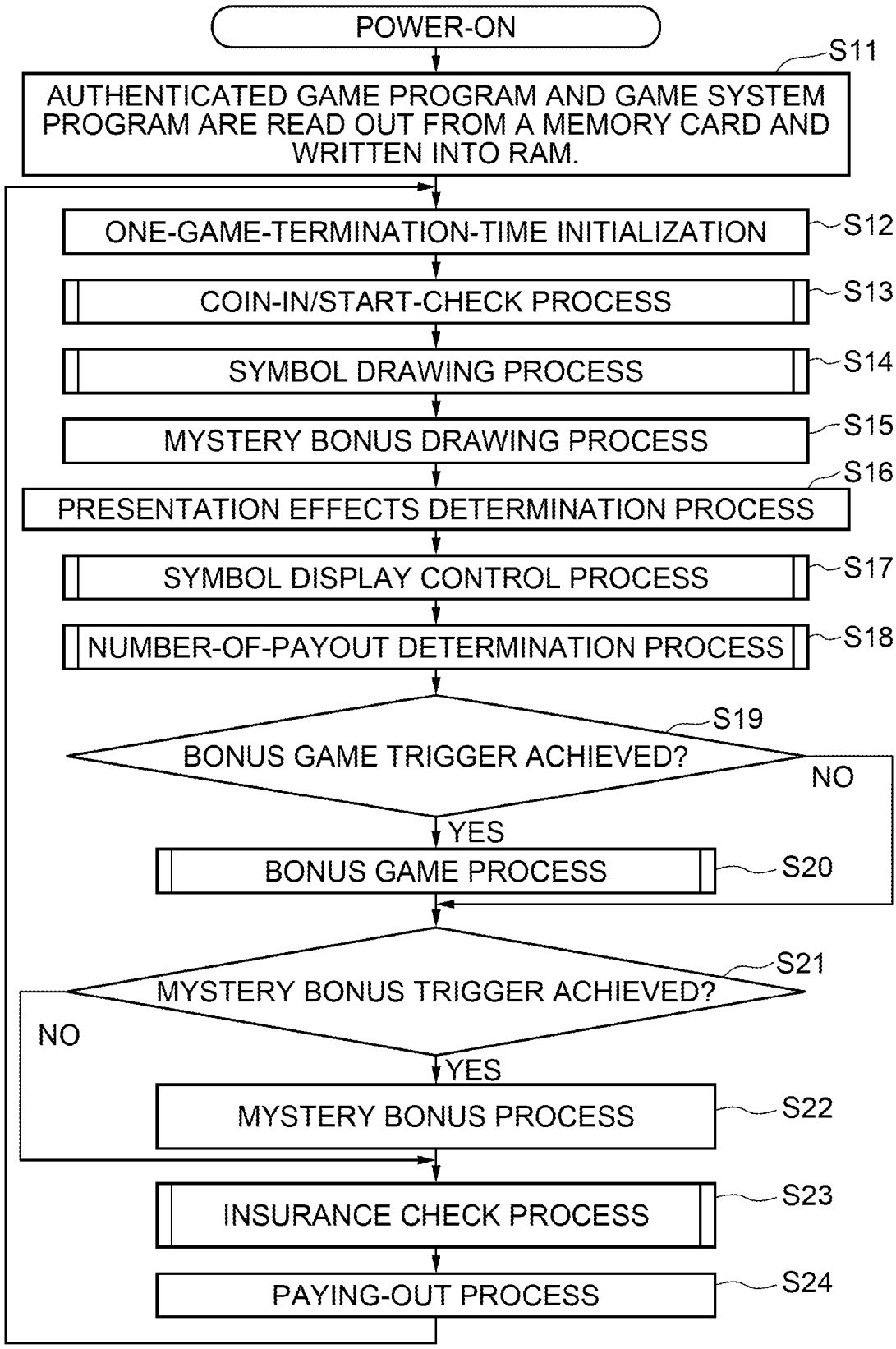
FIG. 21 shows a flowchart of a main control process in the slot machine according to the embodiment of the present invention.

First, with reference to FIG. 21, main control processes will be described. FIG. 21 shows a flowchart of the main control processes of the slot machine according to the embodiment of the present invention.

First, when the slot machine 1 is powered on, the main CPU 71 reads out an authenticated game program and an authenticated game system program from the memory card 54 via the gaming board 50 and writes the programs into the RAM 73 (step S11).

Next, the main CPU 71 conducts a one-game-termination-time initialization process (step S12). For example, data such as symbols determined by the number of BETs and a drawing, which becomes unnecessary in a work area of the RAM 73 upon the termination of each one game played, is cleared.

Figure 22:
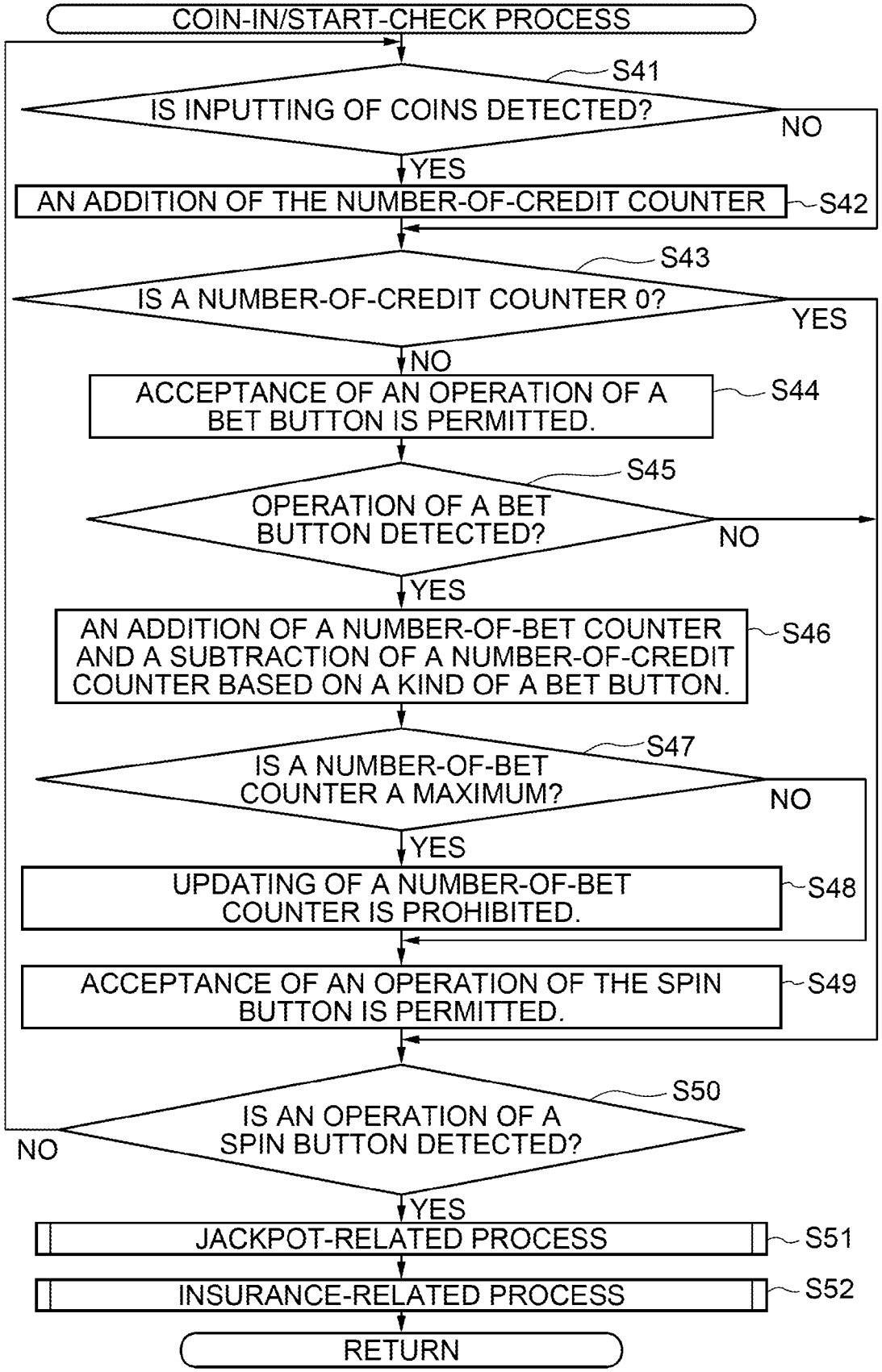
FIG. 22 shows a flowchart of a coin-in/start-check process in the slot machine according to the embodiment of the present invention.

Next, the main CPU 71 conducts a coin-in/start-check process described later with reference to FIG. 22 (step S13). In this process, inputting of the BET switch and the SPIN switch is checked.

Figure 25:
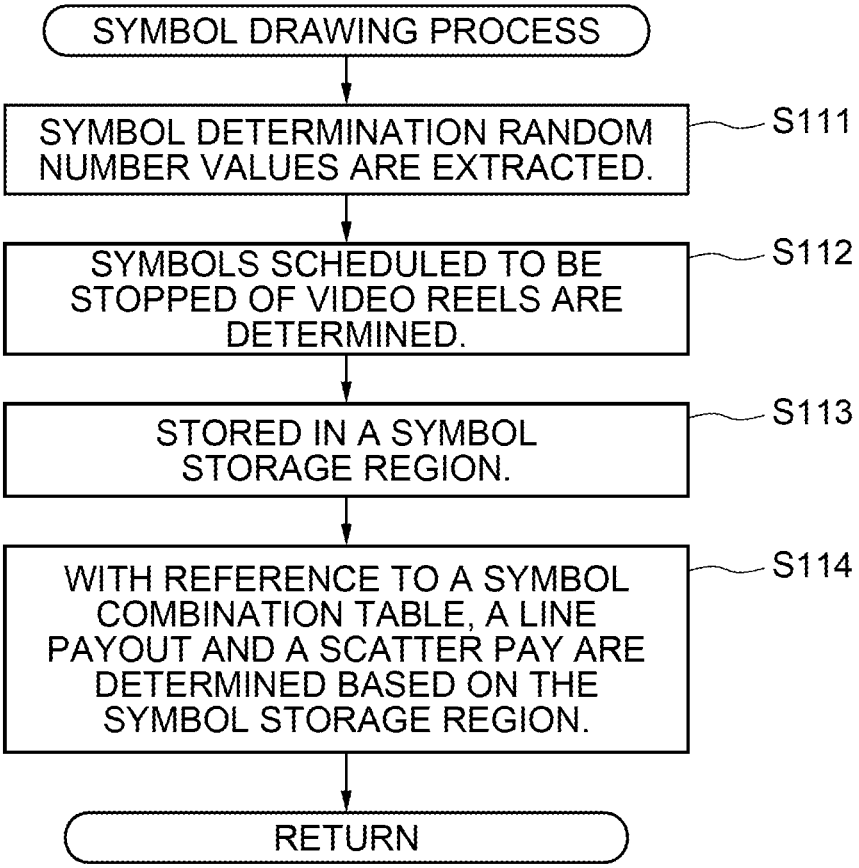
FIG. 25 shows a flowchart of a symbol drawing process in the slot machine according to the embodiment of the present invention.

Next, the main CPU 71 conducts a symbol drawing process described later with reference to FIG. 25 (step S14). In this process, based on symbol determination random number values, symbols scheduled to be stopped are determined.

Next, the main CPU 71 conducts a mystery bonus drawing process (step S15). In this process, a drawing to determine whether or not a mystery bonus trigger is achieved is conducted. For example, the main CPU 71 extracts a mystery bonus random number value from a range of "0 to 99" and, when the extracted random number value is "0", it is determined that the mystery bonus trigger is achieved.

Next, the main CPU 71 conducts a presentation effects contents determination process (step S16). The main CPU 71 extracts a presentation effects random number value and determines any of a predetermined plurality of presentation effects contents by a drawing.

Figure 26:
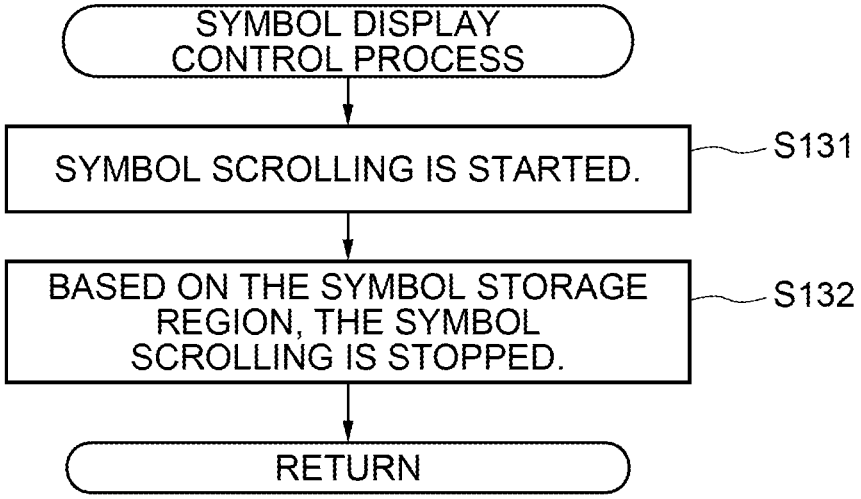
FIG. 26 shows a flowchart of a symbol display control process in the slot machine according to the embodiment of the present invention.

Next, the main CPU 71 conducts a symbol display control process described later with reference to FIG. 26 (step S17). In this process, the scrolling of the symbol columns of the respective video reels 3 is started and the symbols scheduled to be stopped, which are determined in the symbol drawing process at step S14, are stopped in predetermined positions (for example, areas in the upper row of the symbol display area 4). In other words, three symbols including the symbol scheduled to be stopped are displayed in the symbol display area 4. For example, when the symbol scheduled to be stopped is a symbol associated with a code number "10" and is to be displayed in the upper row, symbols associated with code Nos. "11" and "12" are displayed in the middle row and the lower row in the symbol display area 4.

Figure 27:
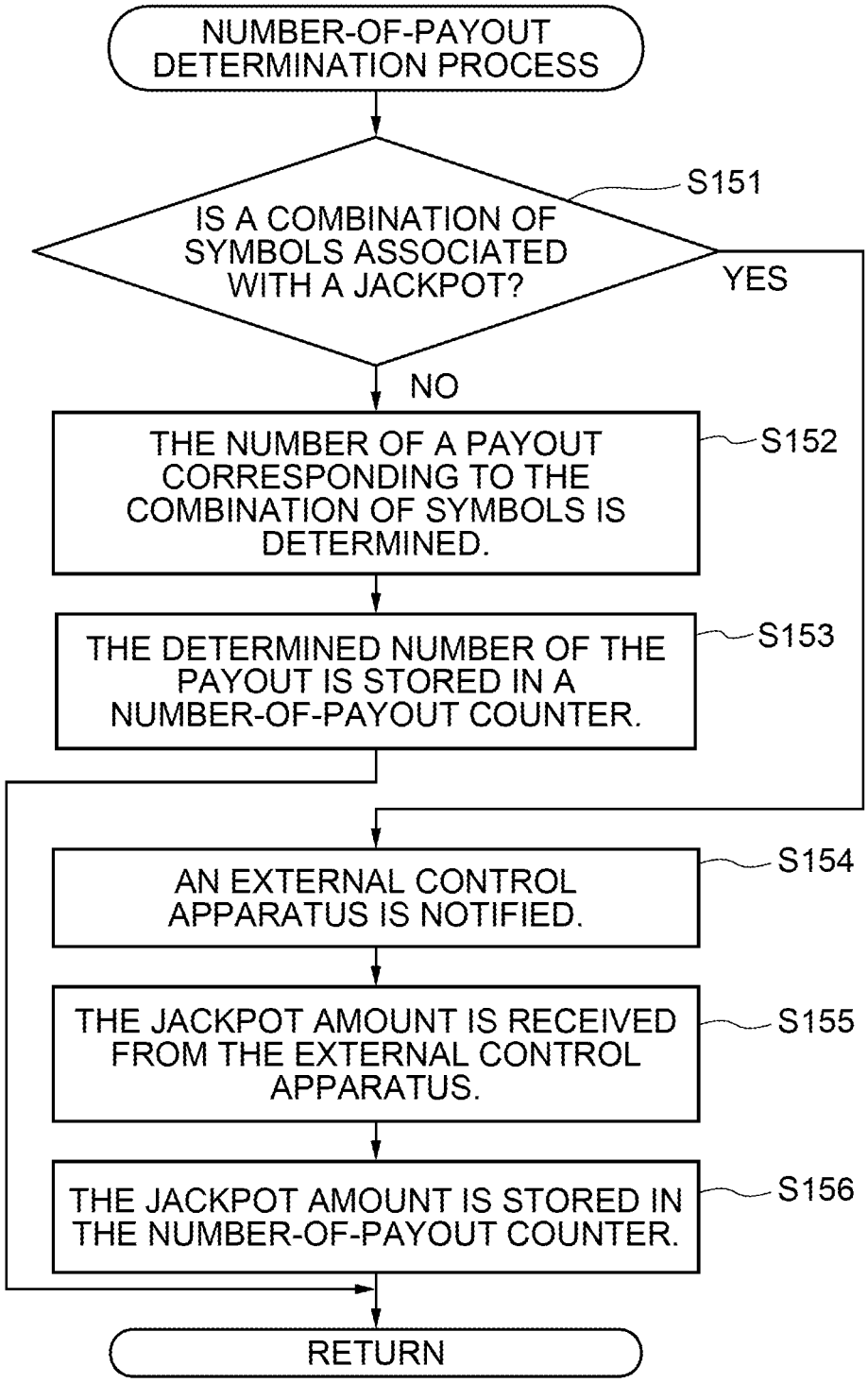
FIG. 27 shows a flowchart of a number-of-payout determination process in the slot machine according to the embodiment of the present invention.

Next, the main CPU 71 conducts a number-of-payout determination process described later with reference to FIG. 27 (step S18). In this process, based on a combination of symbols displayed on a payline, the number of a payout is determined and stored on a number-of-payout counter provided in the RAM 73.

Figure 29:
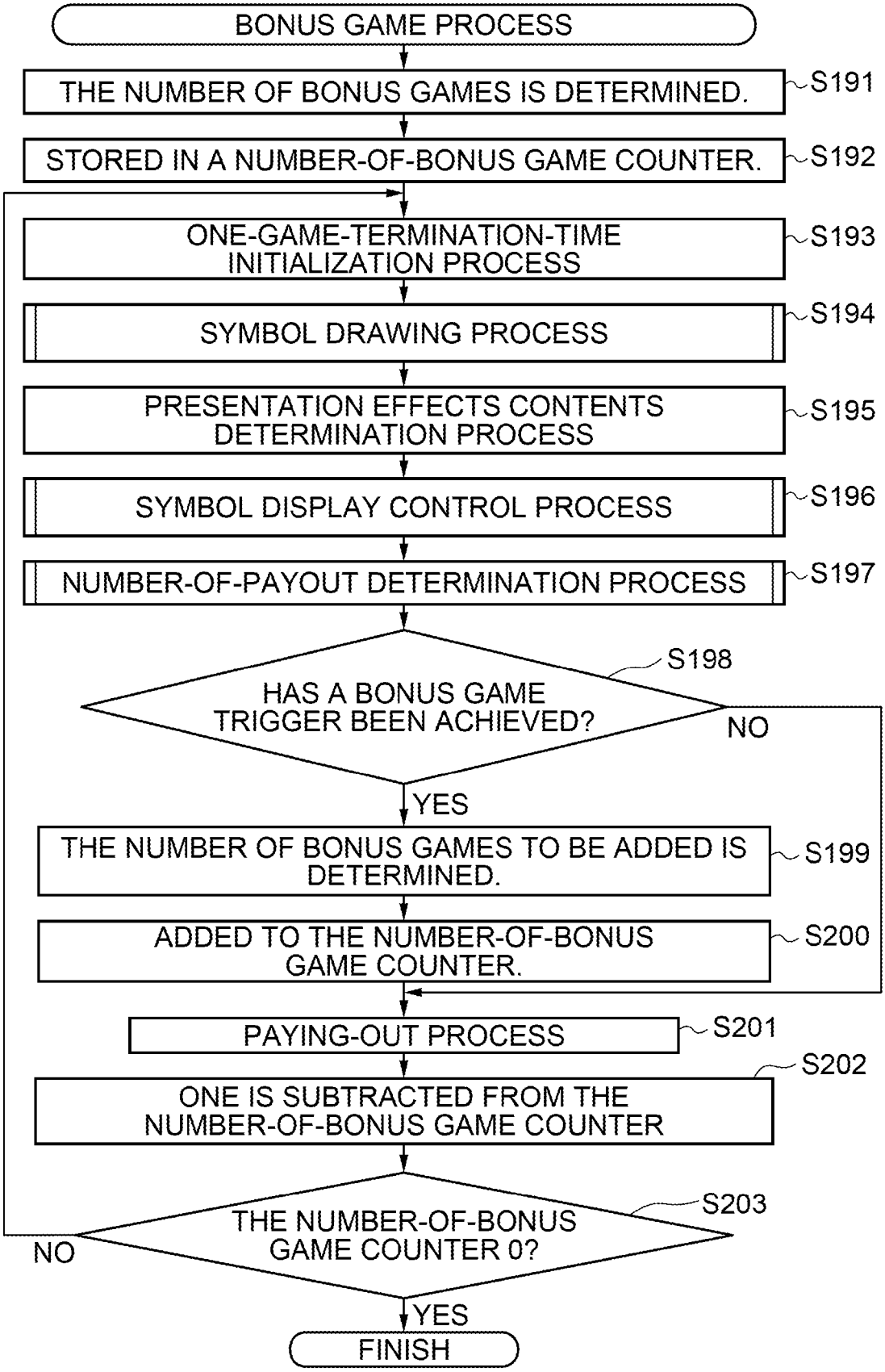
FIG. 29 shows a flowchart of a bonus game process in the slot machine according to the embodiment of the present invention.

Next, the main CPU 71 determines whether or not the bonus game trigger has been achieved (step S19). When determining that the bonus game trigger has been achieved, the main CPU 71 conducts the later described first predictive presentation effects or second predictive presentation effects based on a result of the dedicated drawing. Thereafter, a bonus game process described with reference to FIG. 29 is conducted (step S20). In the present invention, the bonus game is the free games.

Next, after the process at step S20 or upon determining at step S19 that the bonus game trigger has not been achieved, the main CPU 71 determines whether or not a mystery bonus trigger has been achieved (step S21). When determining that the mystery bonus trigger has been achieved, the main CPU 71 conducts a mystery bonus process (step S22). In this process, the number of a payout (for example, 300) set for the mystery bonus is stored on the number-of-payout counter provided in the RAM 73.

Figure 28:
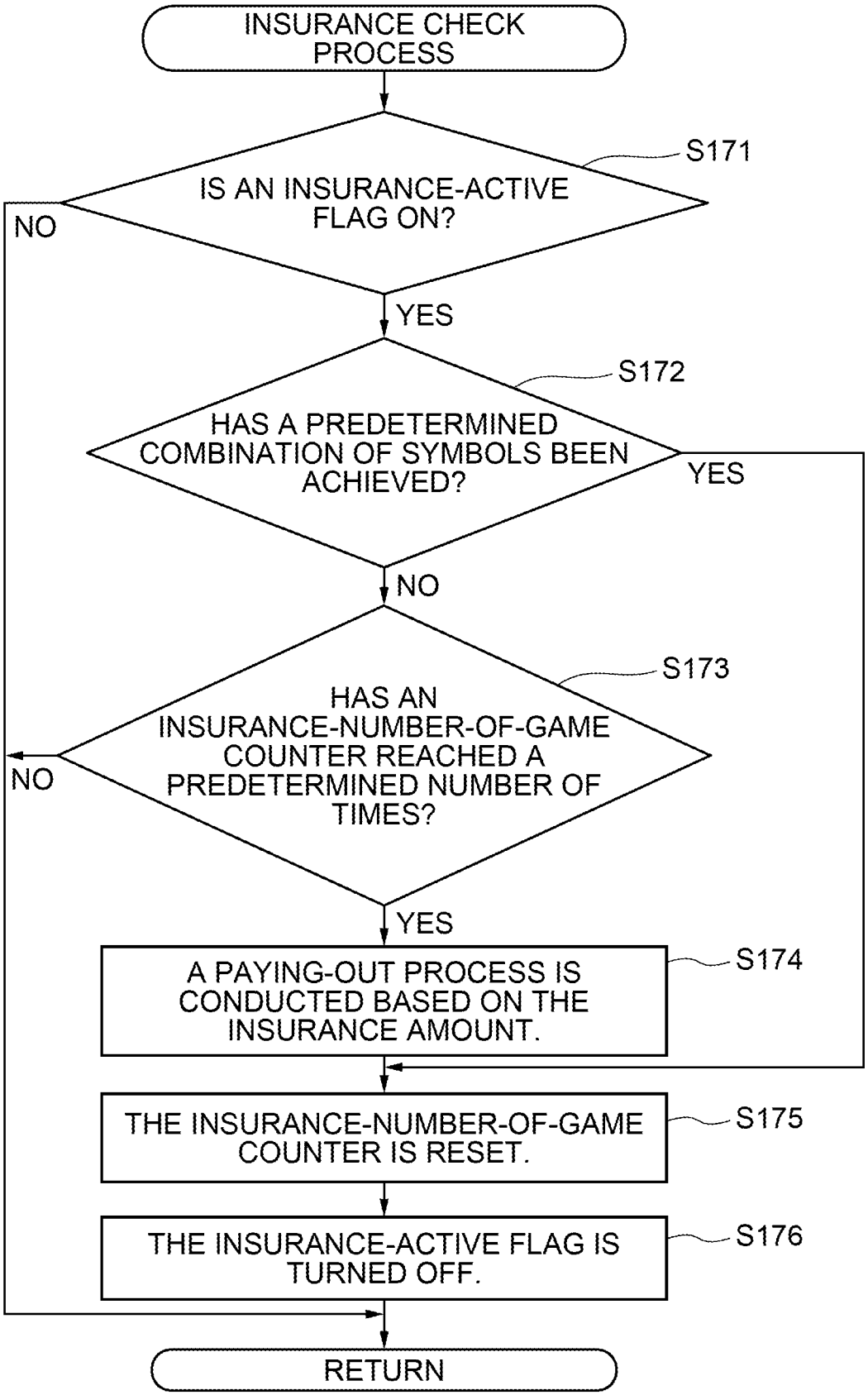
FIG. 28 shows a flowchart of an insurance check process in the slot machine according to the embodiment of the present invention.

After the process at step S22 or upon determining at step S21 that the mystery bonus trigger has not been achieved, the main CPU 71 conducts an insurance check process described later with reference to FIG. 28 (step S23). In this process, it is checked whether or not paying-out by the insurance is conducted.

Next, the main CPU 71 conducts a paying-out process (step S24). The main CPU 71 adds a value stored on the number-of-payout counter to a value stored on a number-of-credit counter provided in the RAM 73. Based on an input on the CASHOUT switch 33S, driving of the hopper 113 may be controlled, and coins in accordance with the value stored on the number-of-payout counter may be discharged from the coin payout opening 15A. In addition, driving of the ticket printer 171 may be controlled, and a ticket having a bar code having stored thereon the value stored on the number-of-payout counter may be issued. After having conducted this process, the main CPU 71 shifts to step S12.

<Coin-In/Start-Check Process>

Next, with reference to FIG. 22, the coin-in/start-check process will be described. FIG. 22 shows a flowchart of the coin-in/start-check process of the slot machine according to the embodiment of the present invention.

First, the main CPU 71 determines whether or not the coin counter 92C has detected inputting of coins (step S41). When determining that inputting of the coins has been detected, the main CPU 71 performs an addition of a value of the number-of-credit counter (step S42). The main CPU 71 may determine whether or not the bill validator 115 has detected inputting of bills in addition to the inputting of the coins, and when determining that the inputting of bills has been detected, a value in accordance with the bills may be added to the value stored on the number-of-credit counter.

After step S42 or upon determining at step S41 that the inputting of the coins has not been detected, the main CPU 71 determines whether or not the value stored in the number-of-credit counter is 0 (step S43). When determining that the value stored on the number-of-credit counter is not 0, the main CPU 71 permits acceptance of an operation of any of the BET buttons (step S44).

Next, the main CPU 71 determines whether or not the operation of any of the BET buttons has been detected (step S45). When any of the BET switches detects that any of the BET buttons has been pressed by a player, based on a kind of the pressed BET button, the main CPU 71 performs an addition of a value stored on a number-of-BET counter provided in the RAM 73 and a subtraction of a value stored on the number-of-credit counter (step S46).

Next, the main CPU 71 determines whether or not the value stored on the number-of-BET counter is a maximum (step S47). When determining that the value stored in the number-of-BET counter is the maximum, the main CPU 71 prohibits updating of the value stored in the number-of-BET counter (step S48). After step S48 or upon determining at step S47 that the value stored in the number-of-BET counter is not the maximum, the main CPU 71 permits acceptance of an operation of the SPIN button (step S49).

After step S49, when determining at step S45 that the operation of any of the BET buttons has not been detected or when determining at step S43 that the value stored in the number-of-credit counter is 0, the main CPU 71 determines whether or not the operation of the SPIN button has been detected (step S50). When determining that the operation of the SPIN button has not been detected, the main CPU 71 shifts to step S41.

Figure 23:
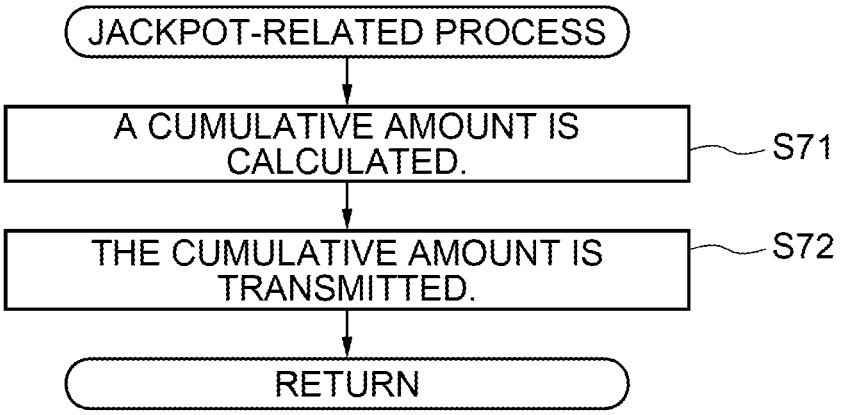
FIG. 23 shows a flowchart of a jackpot-related process in the slot machine according to the embodiment of the present invention.

When determining that the operation of the SPIN button has been detected, the main CPU 71 conducts a jackpot-related process described later with reference to FIG. 23 (step S51). In this process, an amount accumulated in the jackpot amount is calculated and the calculated amount is transmitted to the external control apparatus 200.

Figure 24:
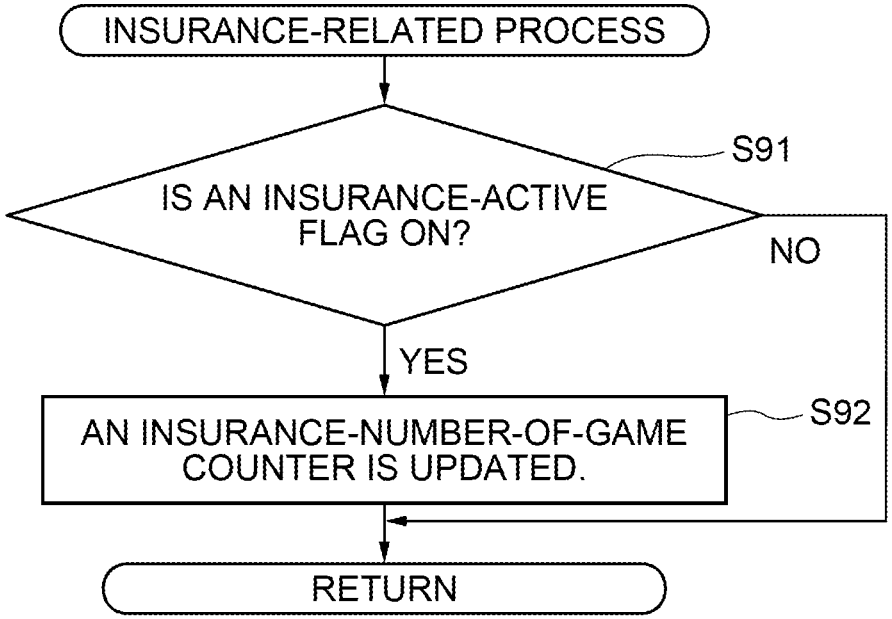
FIG. 24 is a flowchart of an insurance-related process in the slot machine according to the embodiment of the present invention.

Next, main CPU 71 conducts an insurance-related process described later with reference to FIG. 24 (step S52). In this process, counting of the number of games played, which leads to the paying-out by the insurance, is conducted. After conducting this process, the coin-in/start-check process is finished.

<Jackpot-Related Process>

Next, with reference to FIG. 23, the jackpot-related process will be described. FIG. 23 shows a flowchart of the jackpot-related process of the slot machine according to the embodiment of the present invention.

First, the main CPU 71 calculates a cumulative amount (step S71). The main CPU 71 calculates a product of a value stored in the number-of-BET counter and a cumulative rate, thereby obtaining the cumulative amount into the jackpot amount.

Next, the main CPU 71 transmits the calculated cumulative amount to the external control apparatus 200 (step S72). When receiving the cumulative amount, the external control apparatus 200 updates the jackpot amount. After conducting this process, the jackpot-related process is finished.

<Insurance-Related Process>

Next, with reference to FIG. 24, the insurance-related process will be described. FIG. 24 is a flowchart of the insurance-related process of the slot machine according to the embodiment of the present invention.

First, the main CPU 71 determines whether or not an insurance-active flag is on (step S91). The insurance-active flag is set to be on in an insurance selection process described later with reference to FIG. 30 when a player inputs an instruction which makes the insurance active.

When determining that the insurance-active flag is not on, the main CPU 71 finishes the insurance-related process. On the other hand, when determining that the insurance-active flag is on, the main CPU 71 updates a value stored on an insurance-number-of-game counter provided in the RAM 73 (step S92). The insurance-number-of-game counter is a region for storing the number of games played until the paying-out by the insurance is conducted. In the process at step S92, the main CPU 71 adds one to the value stored in the insurance-number-of-game counter. After conducting this process, the insurance-related process is finished.

<Symbol Drawing Process>

Next, with reference to FIG. 25, the symbol drawing process will be described. FIG. 25 shows a flowchart of the symbol drawing process of the slot machine according to the embodiment of the present invention.

First, the main CPU 71 extracts symbol determination random number values (step S111). Next, the main CPU 71 determines symbols scheduled to be stopped of the respective video reels 3 by drawings (step S112). The main CPU 71 conducts the drawings in accordance with the respective video reels 3 and determines any of pluralities of symbols as the symbols scheduled to be stopped. At this time, the respective pluralities of symbols are determined with probabilities which are equal to one another.

Next, the main CPU 71 stores the symbols scheduled to be stopped of the respective video reels 3 in a symbol storage region provided in the RAM 73 (step S113). Next, referring to the symbol combination table (FIG. 20 and the like), the main CPU 71 determines a winning combination based on the symbol storage region (step S114). The main CPU 71 determines whether or not a combination of symbols displayed on a payline by the respective video reels 3 matches any combination of symbols defined in the symbol combination table and determines a winning combination. After conducting this process, the symbol drawing process is finished.

<Symbol Display Control Process>

Next, with reference to FIG. 26, the symbol display control process will be described. FIG. 26 shows a flowchart of the symbol display control process of the slot machine according to the embodiment of the present invention.

First, the main CPU 71 starts the scrolling of the symbol columns of the respective video reels 3 displayed in the symbol display area 4 of the lower side image display panel 141 (step S131). Next, the main CPU 71 stops the scrolling of the symbol columns of the respective video reels 3 based on the above-described symbol storage region (step S132). After conducting this process, the symbol display control process is finished.

<Number-of-Payout Determination Process>

Next, with reference to FIG. 27, the number-of-payout determination process will be described. FIG. 27 shows a flowchart of the number-of-payout determination process of the slot machine according to the embodiment of the present invention.

First, the main CPU 71 determines whether or not a symbol combination is associated with a jackpot (step S151). When determining that the symbol combination is not associated with the jackpot, the main CPU 71 determines the number of a payout corresponding to the winning combination (step S152). For example, when the winning combination in the base game is "BELL", "8" is determined as the number of a payout (refer to FIG. 20). Upon the occurrence of losing, "0" is determined as the number of a payout. Next, the main CPU 71 stores the determined number of a payout in a number-of-payout counter (step S153). After conducting this process, the number-of-payout determination process is finished.

When determining that the combination of symbols is associated with the jackpot, the main CPU 71 notifies the external control apparatus 200 that the jackpot has occurred (step S154). When having received the notification, the external control apparatus 200 transmits to the slot machine 1 the jackpot amount which has been updated until then. At this time, a portion of the jackpot amount (for example, 80%) may be targeted to be paid out, and the remaining thereof (for example, 20%) may be carried over in preparation for the achievement of the next jackpot trigger.

Next, the main CPU 71 receives the jackpot amount from the external control apparatus 200 (step S155). Next, the main CPU 71 stores the received jackpot amount on the number-of-payout counter (step S156). After conducting this process, the number-of-payout determination process is finished.

<Insurance Check Process>

Next, with reference to FIG. 28, the insurance check process will be described. FIG. 28 shows a flowchart of the insurance check process of the slot machine according to the embodiment of the present invention.

First, the main CPU 71 determines whether or not the insurance-active flag is on (step S171). When determining that the insurance-active flag is not on, the main CPU 71 finishes the insurance check process.

When determining that the insurance-active flag is on, the main CPU 71 determines whether or not a predetermined combination of symbols has been achieved (step S172). In the embodiment of the present invention, the predetermined combination of symbols is targeted for the "bonus game trigger", the "jackpot", and the "mystery bonus".

When determining that the predetermined combination of symbols has not been achieved, the main CPU 71 determines whether or not a value stored in the insurance-number-of-game counter has reached a predetermined number of times (for example, 300) (step S173). When determining that the value stored in the insurance-number-of-game counter has not reached the predetermined number of times, the main CPU 71 finishes the insurance check process.

When determining that the value stored in the insurance-number-of-game counter has reached the predetermined number of times, the main CPU 71 conducts the paying-out process based on the insurance amount (step S174). The main CPU 71 adds a predetermined amount (for example, 200) as the insurance amount to a value stored on the number-of-credit counter.

After step S174 or upon determining at step S172 that the predetermined combination of symbols has been achieved, the main CPU 71 resets the value stored on the insurance-number-of-game counter (step S175). Next, the main CPU 71 turns off the insurance-active flag (step S176). After conducting this process, the insurance check process is finished.

<Bonus Game Process>

Next, with reference to FIG. 29, the bonus game process will be described.

FIG. 29 shows a flowchart of the bonus game process of the slot machine according to the embodiment of the present invention.

First, the main CPU 71 determines the number of bonus games (step S191). The main CPU 71 uniformly determines "10" as the number of bonus games. However, the main CPU 71 may extract random number values for determining the number of bonus games, and determines any of a plurality of the numbers of bonus games, for example "50", "70", and "100", by a drawing.

Next, the main CPU 71 stores the determined number of bonus games on a number-of-bonus game counter provided in the RAM 73 (step S192).

Next, as in the process at step S12 described with reference to FIG. 21, the main CPU 71 conducts the one-game-termination-time initialization process (step S193). At this time, the number of paylines and BET per LINE upon initiating the bonus game are maintained. Further, the video reels 3 are changed from the base game reels to the free game reels. Next, the main CPU 71 conducts the symbol drawing process described with reference to FIG. 25 (step S194). At this time, the above-described rewriting process is conducted. Next, as in the process at step S16 described with reference to FIG. 21, the main CPU 71 conducts the presentation effects contents determination process (step S195). Next, the main CPU 71 conducts the symbol display control process described with reference to FIG. 26 (step S196). Next, the main CPU 71 conducts the number-of-payout determination process for the free games (step S197). In the embodiment of the present invention, when the DRAGON symbol 402 or the CHANCE symbol 403 is displayed, a payout amount is determined by a dedicated drawing.

Next, the main CPU 71 determines whether or not the bonus game trigger has been achieved (step S198). When determining that the bonus game trigger has been achieved, the main CPU 71 determines the number of bonus games to be added (step S199). Further, based on a result of the dedicated drawing, the later-described third predictive presentation effects are conducted. In the embodiment of the present invention, when the DRAGON symbols 402 have appeared, the number of the DRAGON symbols 402 which have appeared is determined as the number of bonus games to be added. When the CHANCE symbols 403 have appeared, the number which is three or more is determined as the number of bonus games to be added. This determination is conducted by using a dedicated drawing table. Next, the main CPU 71 adds the determined number of bonus games to a value stored on a number-of-bonus game counter (step S200).

After the process at step S200 or upon determining at step S198 that the bonus game trigger has not been achieved, the main CPU 71 conducts the paying-out process (step S201). In this paying-out process, the main CPU 71 adds the value stored on the number-of-payout counter in the above-described number-of-payout determination process at step S197 to a value stored on a bonus-number-of-payout counter. The bonus-number-of-payout counter is a region for storing the total of the number of payouts determined during the bonus games. Upon finishing the bonus game process, the main CPU 71 adds the value stored on the bonus-number-of-payout counter in the paying-out process, at step S24 described with reference to FIG. 21, to a value stored on the number-of-credit counter provided in the RAM 73. In other words, the total of the number of payouts determined in the bonus games is paid out. Coins may be discharged from the coin payout opening 15A and a ticket having a bar code may be issued.

Next, the main CPU 71 subtracts one from the value stored on the number-of-bonus game counter (step S202). Next, the main CPU 71 determines whether or not the value stored in the number-of-bonus game counter is zero (step S203). When determining that the value stored in the number-of-bonus game counter is not zero, the main CPU 71 shifts to the process at step S193. On the other hand, when determining that the value stored in the number-of-bonus game counter is zero, the main CPU 71 finishes the bonus game process. Upon finishing the bonus game process, the video reels 3 are changed from the free game reels to the base game reels. A state of the changed base game reels is returned to the state thereof upon triggering the free games. Thereafter, the main CPU 71 shifts to the process at step S21 described with reference to FIG. 21.

<Insurance Selection Process>

Figure 30:
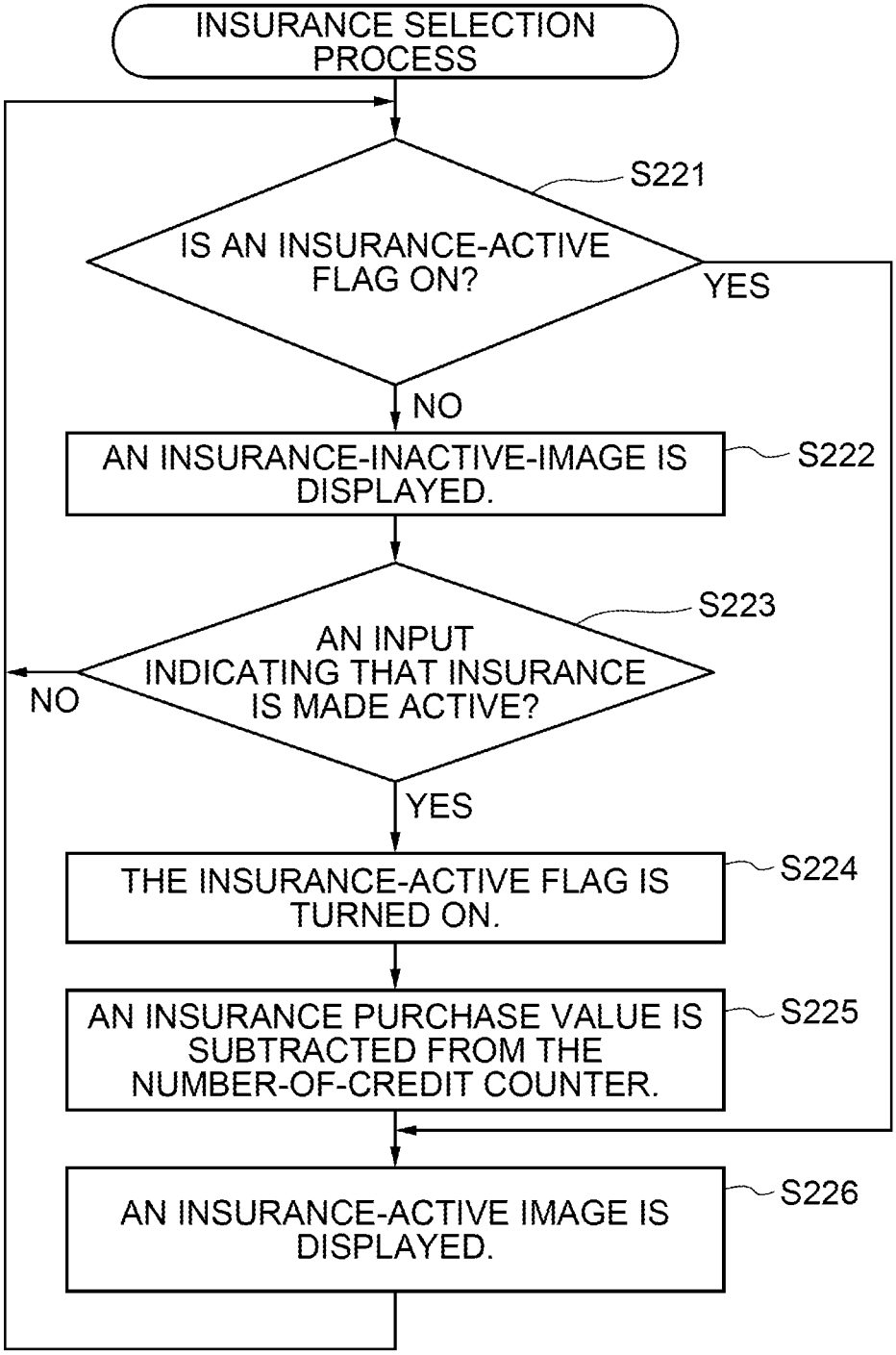
FIG. 30 shows a flowchart of an insurance selection process in the slot machine according to the embodiment of the present invention.

Next, with reference to FIG. 30, the insurance selection process will be described. FIG. 30 shows a flowchart of the insurance selection process of the slot machine according to the embodiment of the present invention.

First, the main CPU 71 determines whether or not the insurance-active flag is on (step S221). When determining that the insurance-active flag is not on, the main CPU 71 displays an insurance-inactive-image (step S222). The main CPU 71 transmits an instruction to display the insurance-inactive-image to the graphic board 130. Based on the instruction, the graphic board 130 generates the insurance-inactive-image and displays the insurance-inactive-image on the lower side image display panel 141. As the insurance-inactive-image, for example, an image indicating "INSURANCE BET $1.00 TOUCH TO BET" is displayed. This image is to prompt a player to make a selection on whether or not the insurance is made active and to notify a player of an amount required to make the insurance active. By touching a predetermined portion on the touch panel 114, a player can input an instruction indicating that the insurance is made active.

Subsequently, the main CPU 71 determines whether or not there is the input indicating that the insurance is made active (step S223). When determining that there is no input indicating that the insurance is made active, the main CPU 71, with the insurance-active flag being kept off, shifts to step S221. On the other hand, when determining that there is the input indicating that the insurance is made active, the main CPU 71 turns on the insurance-active flag (step S224).

Next, the main CPU 71 subtracts an insurance purchase value from a value stored on the number-of-credit counter (step S225). In the embodiment of the present invention, for example, a value corresponding to one dollar is subtracted from the value stored on the number-of-credit counter. After step S225 or upon determining at step S221 that the insurance-active flag is on, the main CPU 71 displays an insurance-active image (step S226). As the insurance-active image, for example, an image indicating "INSURANCE-CONTINUING WIN 200 CREDIT" is displayed. This image is to notify a player that the insurance is active and that upon satisfying an insurance condition, a value of "200" is added to a value stored on the number-of-credit counter. After conducting this process, the main CPU 71 shifts to step S221.

[Image Specification]

The contents of the programs are as described above. Next, with reference to FIG. 31 to FIG. 42, an image specification of the slot machine 1 will be described. Each of FIG. 31 to FIG. 42 is a diagram illustrating the image specification of the slot machine according to the embodiment of the present invention.

As shown in FIG. 31, on the upper side image display panel 131 of the base game screen, a title signboard 501 and a game information area 502 are provided. In the game information area 502, three signboards are displayed so as to be each switched at 10-second intervals. On the lower side image display panel 141 of the base game screen, a meter-related area 503, a 30-line display area 504, and a button/denom. display area 505 are provided. In the meter-related area 503 and the 30-line display area 504, displaying similar to the conventional displaying is conducted. In the button/denom. display area 505, a HELP button, a language switch button, a sound volume button, and a denom. button are provided, and displaying similar to the conventional displaying is conducted.

Figure 32:
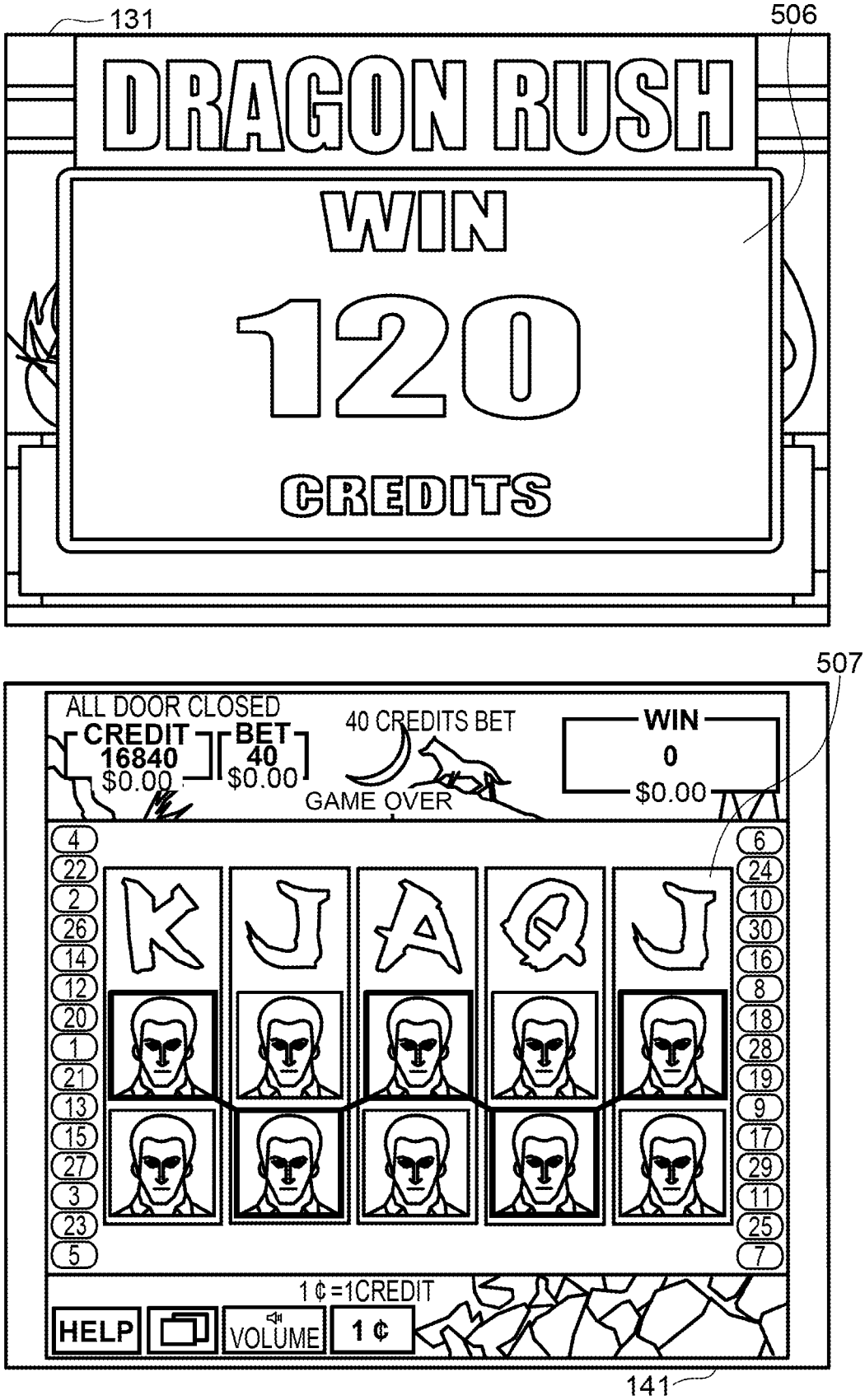
FIG. 32 is a diagram illustrating an image specification of the slot machine according to the embodiment of the present invention.

As shown in FIG. 32, on the upper side image display panel 131 upon the occurrence of a WIN, a TOTAL WIN display area 506 is provided. There are two kinds of the TOTAL WIN display areas 506 which have a silver frame and a gold frame, and three phases of presentation effects for no coins, a small number of coins, and a large number of coins are conducted therein depending on a magnitude of the WIN. On the lower side image display panel 141 upon the occurrence of a WIN, a WIN line 507 is displayed. In this display, a line No. of a line on which the WIN has occurred and a frame of symbols with which the WIN has occurred are clearly specified.

Figure 33A:
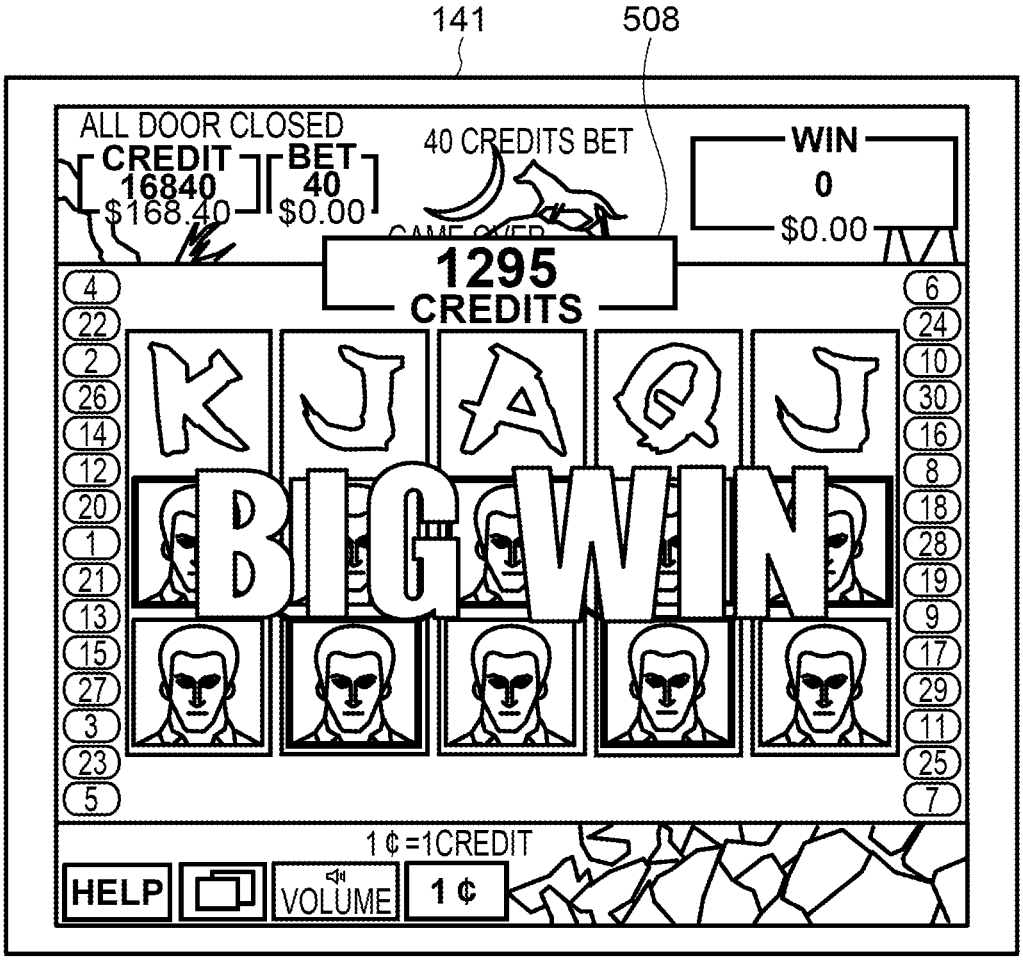
FIG. 33A is a diagram illustrating an image specification of the slot machine according to the embodiment of the present invention.
Figure 33B:
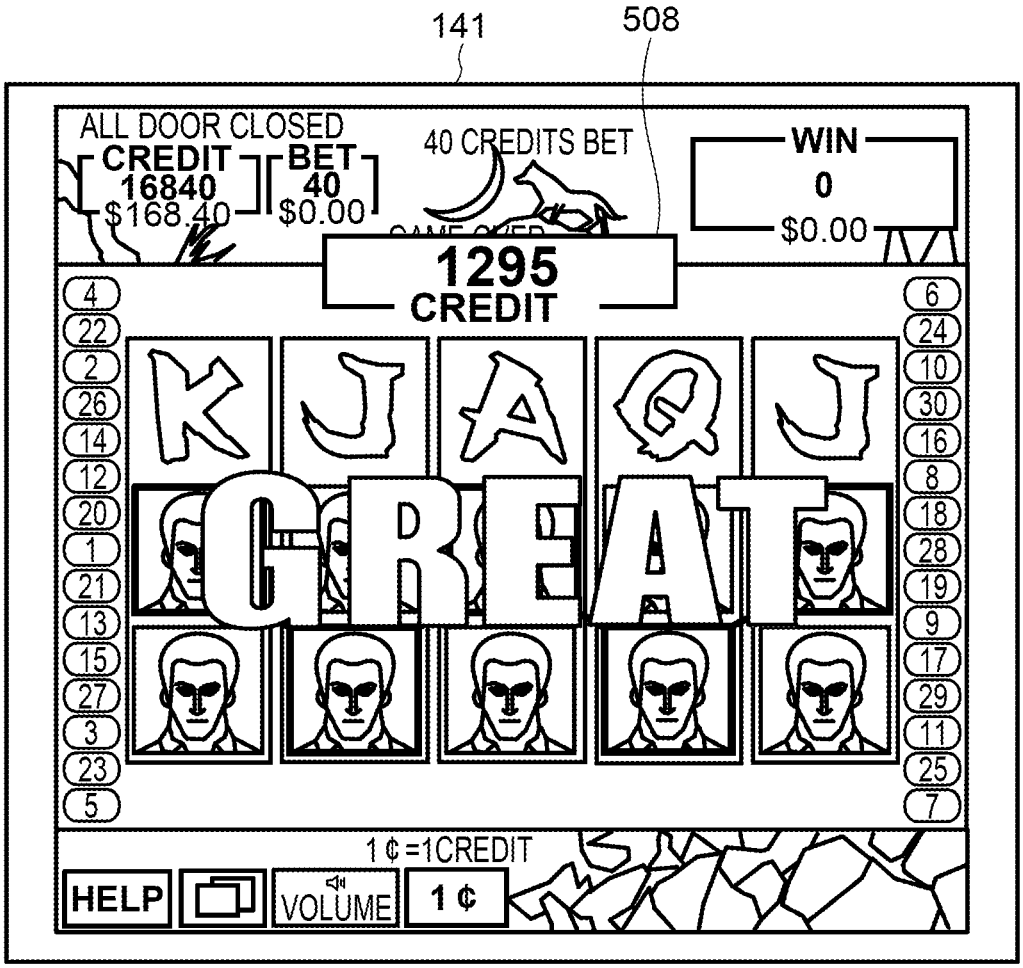
FIG. 33B is a diagram illustrating an image specification of the slot machine according to the embodiment of the present invention.
Figure 33C:
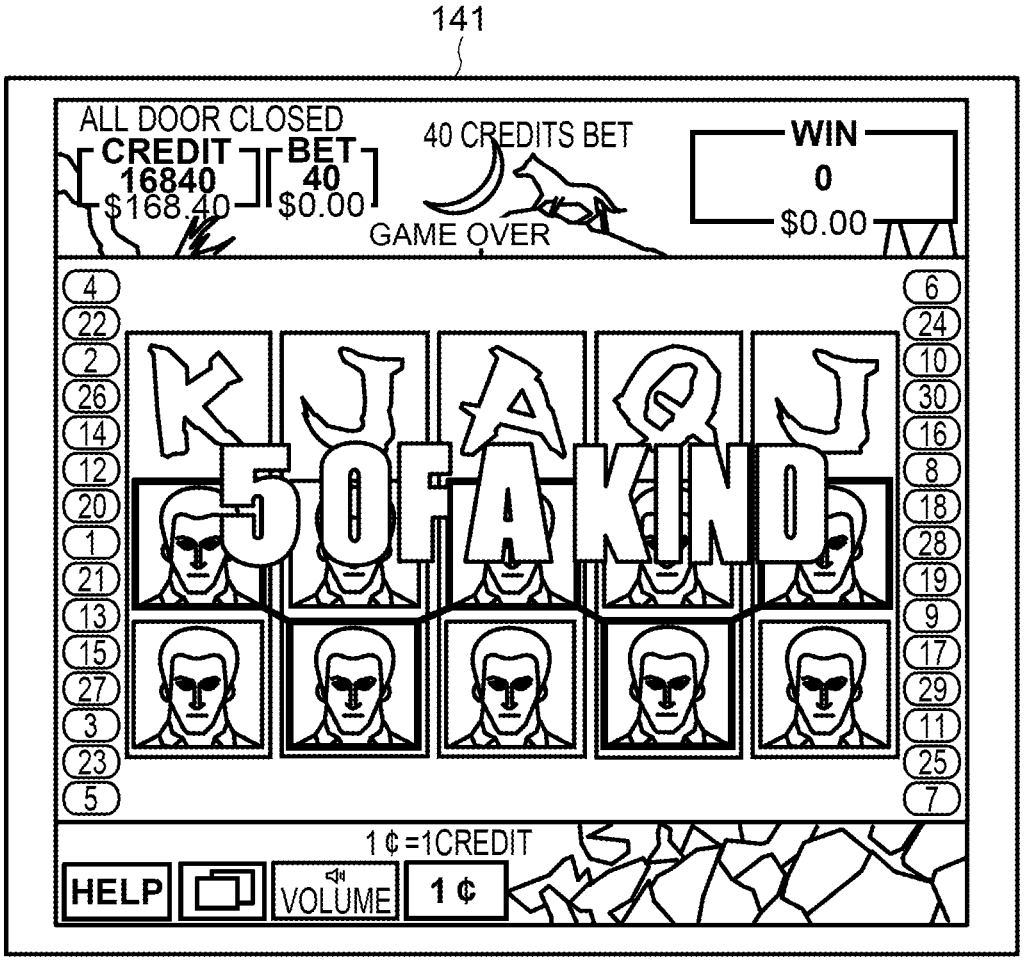
FIG. 33C is a diagram illustrating an image specification of the slot machine according to the embodiment of the present invention.

Further, on the lower side image display panel 141 in a case where a large WIN has occurred, as shown in FIG. 33A to FIG. 33C, "BIG WIN", "GREAT", or "5 OF KIND" is displayed. In addition, as shown in FIG. 33A to FIG. 33C, an increment display area 508 which allows up to five digits to be displayed is provided.

As shown in FIG. 34, on the upper side image display panel 131 and the lower side image display panel 141 upon triggering the free games, presentation effects only by sound are conducted, and no special image presentation effects are conducted.

As shown in FIG. 35, on the upper side image display panel 131 upon introducing the free games, a BONUS WIN display area 509 which allows up to six digits to be displayed and a number-of-FREE GAME display area 510 which allows up to four digits to be displayed are provided. Further, on the upper side image display panel 131, each time the number of played free games is increased, a background and a dragon are changed in three phases.

Figure 36A:
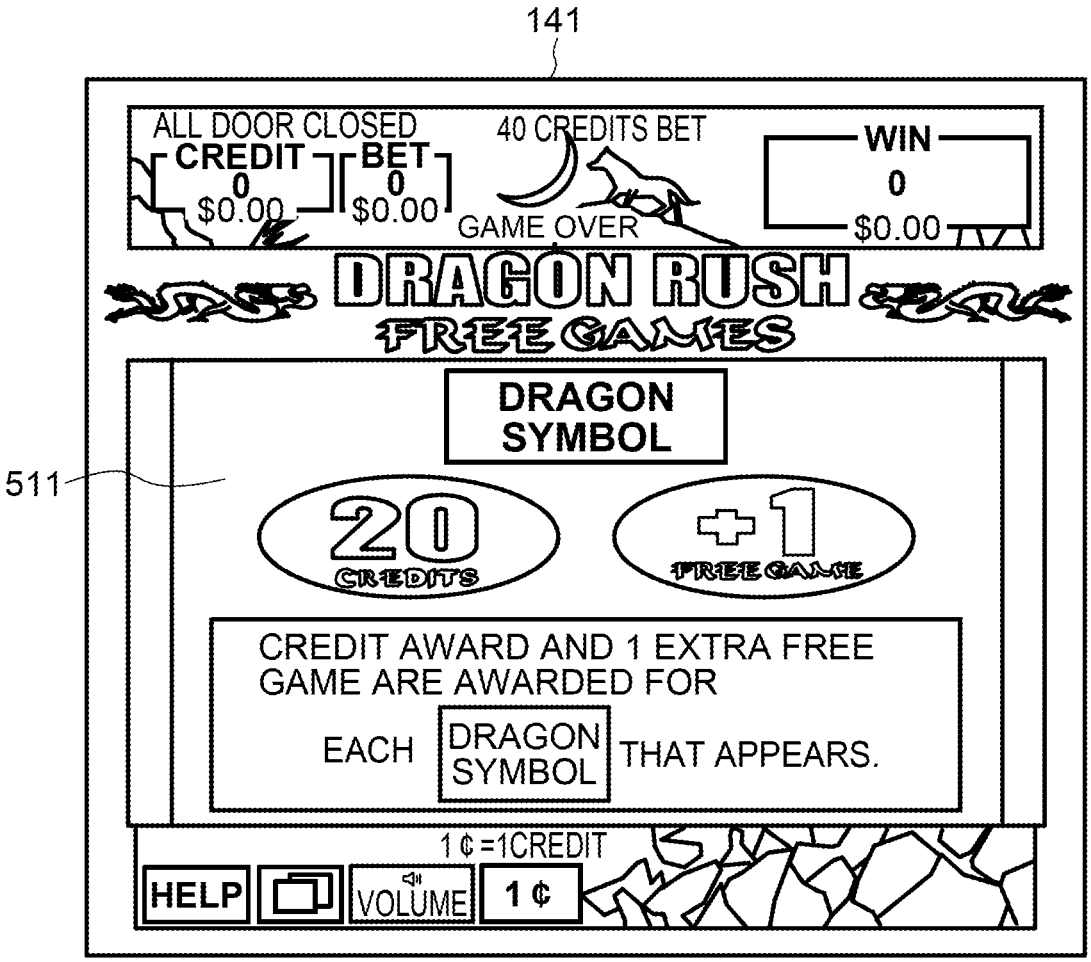
FIG. 36A is a diagram illustrating an image specification of the slot machine according to the embodiment of the present invention.
Figure 36B:
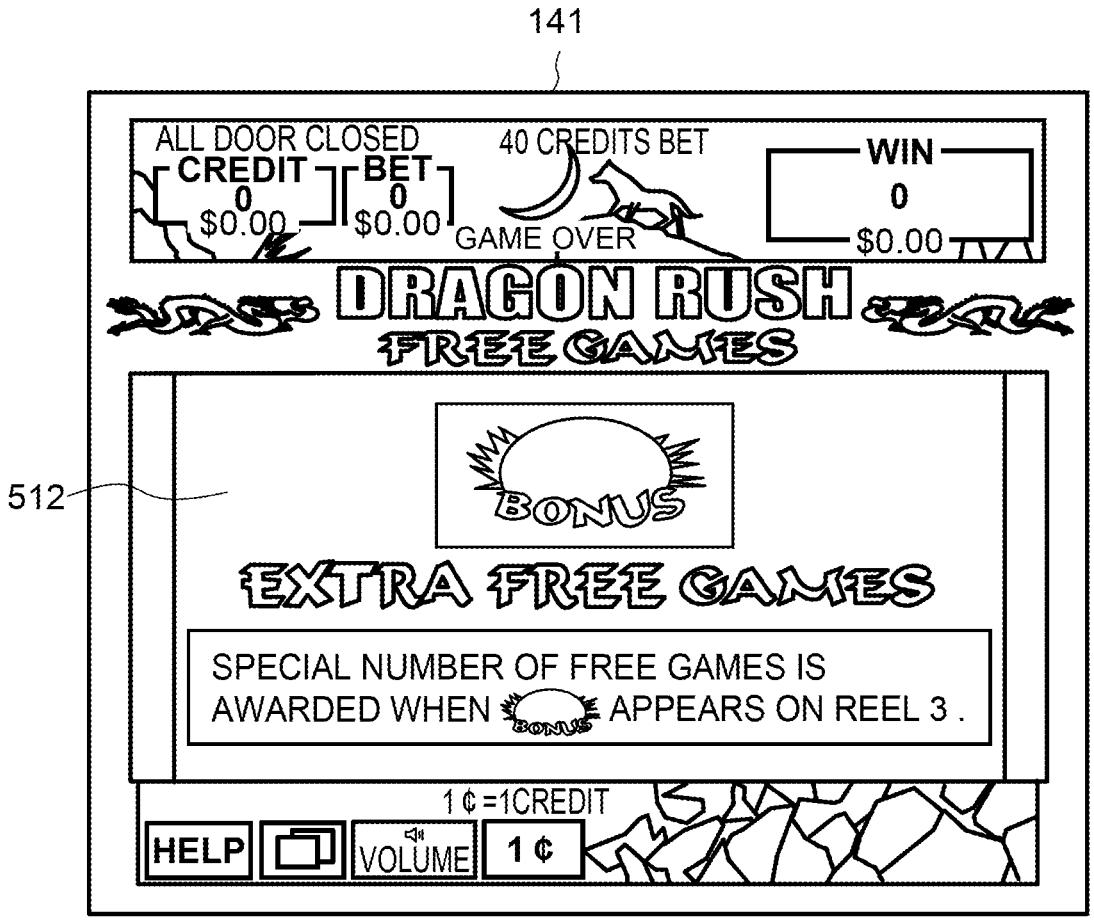
FIG. 36B is a diagram illustrating an image specification of the slot machine according to the embodiment of the present invention.
Figure 36C:
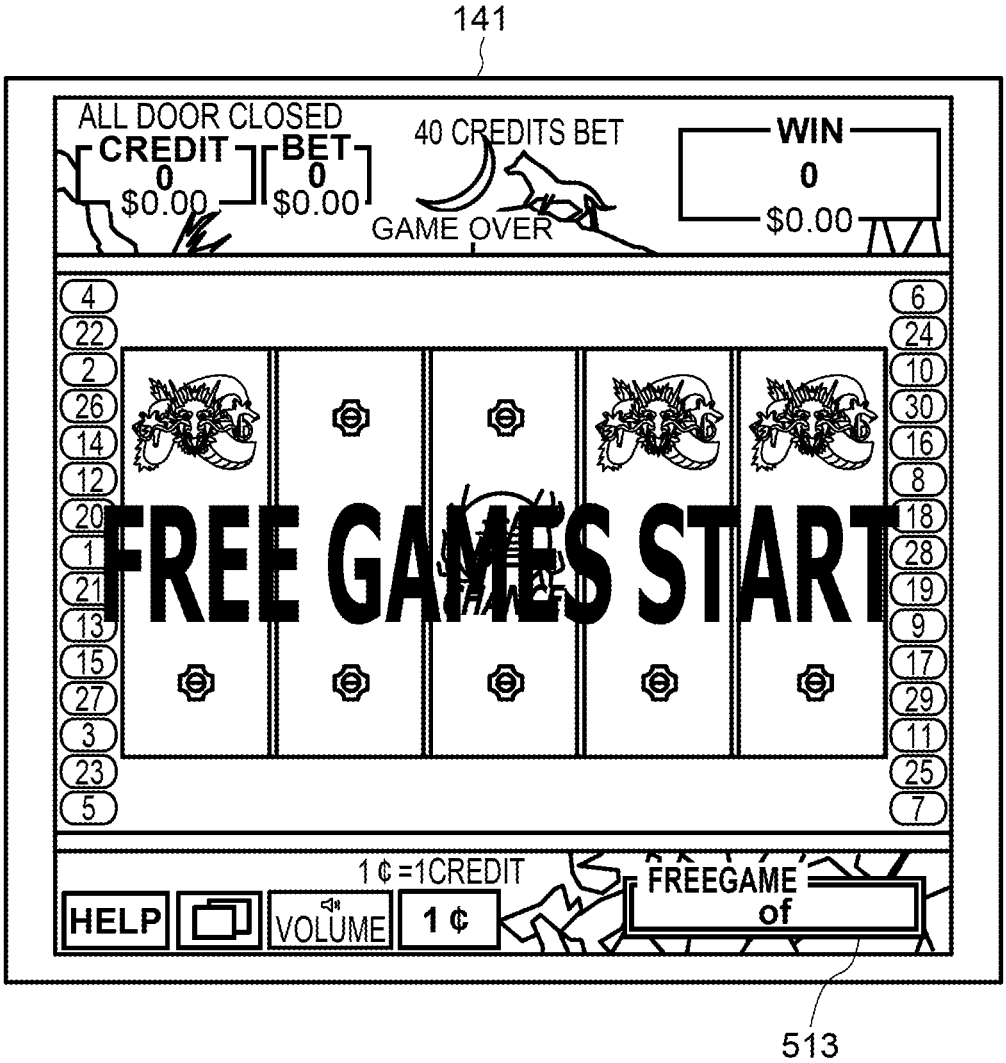
FIG. 36C is a diagram illustrating an image specification of the slot machine according to the embodiment of the present invention.

On the lower side image display panel 141 upon introducing the free games, a name of each of the free games is displayed. Further, as shown in FIG. 36A to FIG. 36C, a display on the lower side image display panel 141 is changed in three phases until each of the free games is started. First, as shown in FIG. 36A, on the lower side image display panel 141, a first explanation signboard 511 is displayed. Next, as shown in FIG. 36B, on the lower side image display panel 141, a second explanation signboard 512 is displayed. Next, as shown in FIG. 36C, on the lower side image display panel 141, "FREE GAMES START" is displayed and a number-of-FREE GAME display area 513 which allows up to four digits to be displayed is provided. In the number-of-FREE GAME display area 513, "FREE GAME" and "BONUS REELS IN PLAY" are displayed.

Figure 37:
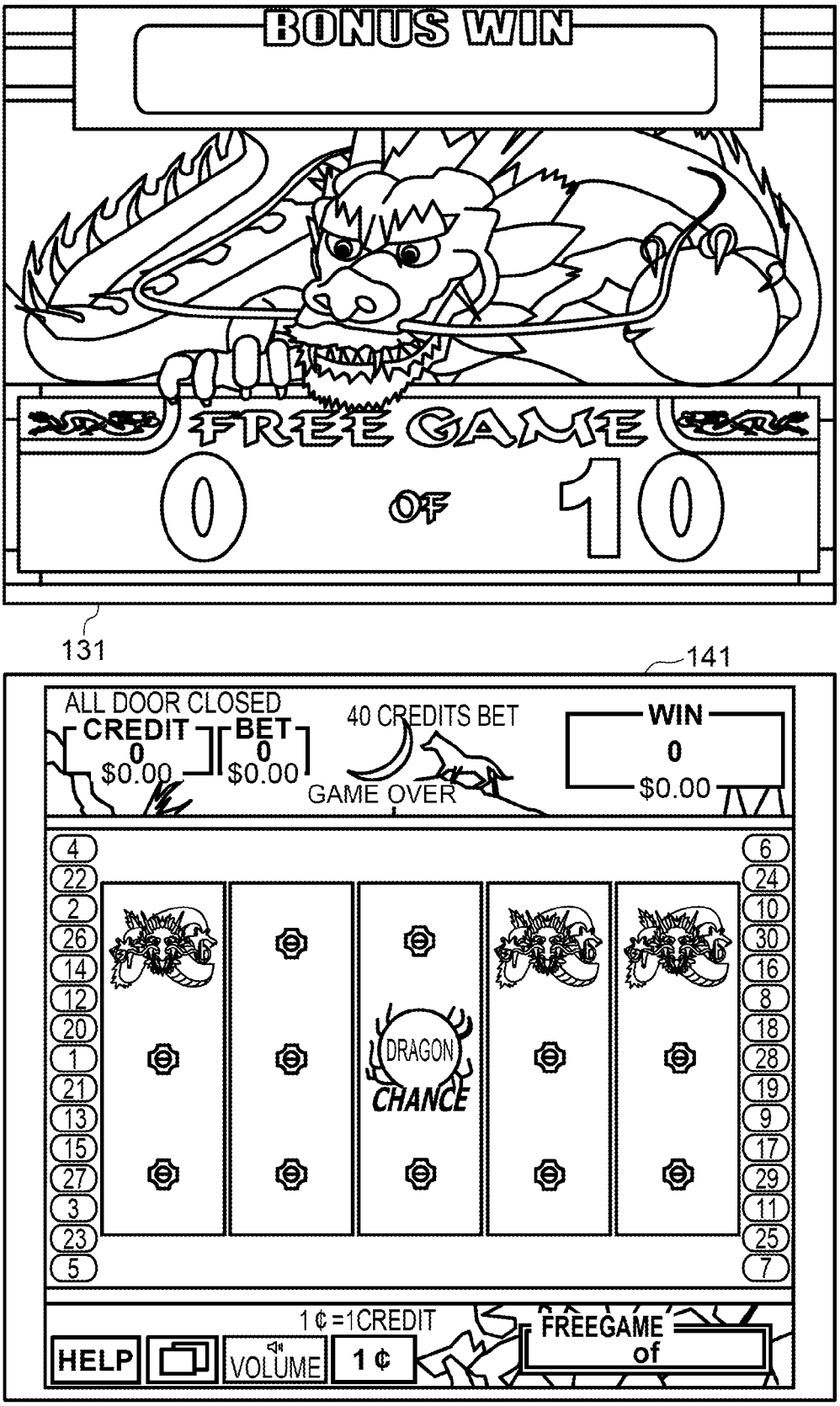
FIG. 37 is a diagram illustrating an image specification of the slot machine according to the embodiment of the present invention.

As shown in FIG. 37, on the lower side image display panel 141 of a normal screen during the free games, a line display is not conducted.

Figure 38:
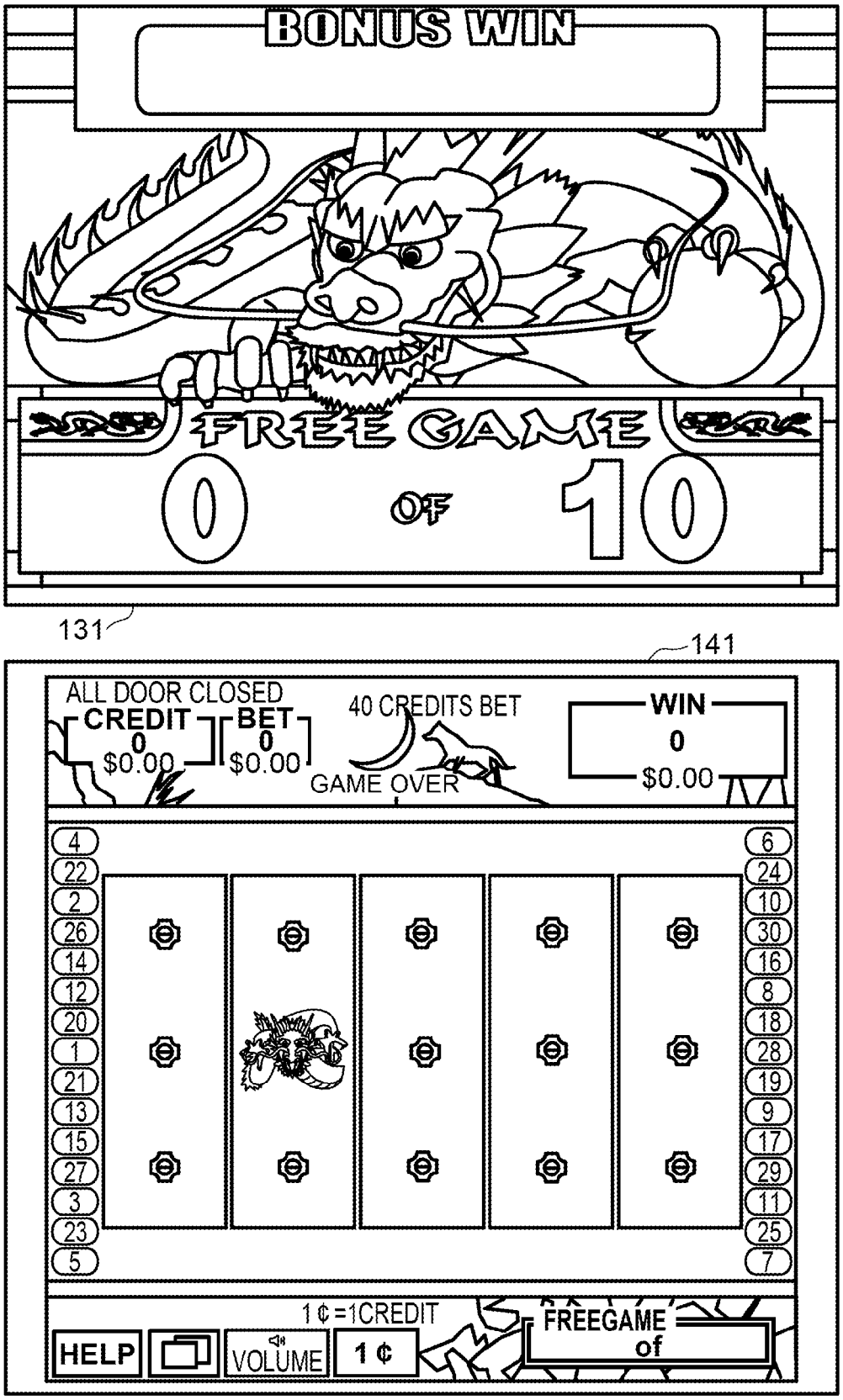
FIG. 38 is a diagram illustrating an image specification of the slot machine according to the embodiment of the present invention.
Figure 39A:
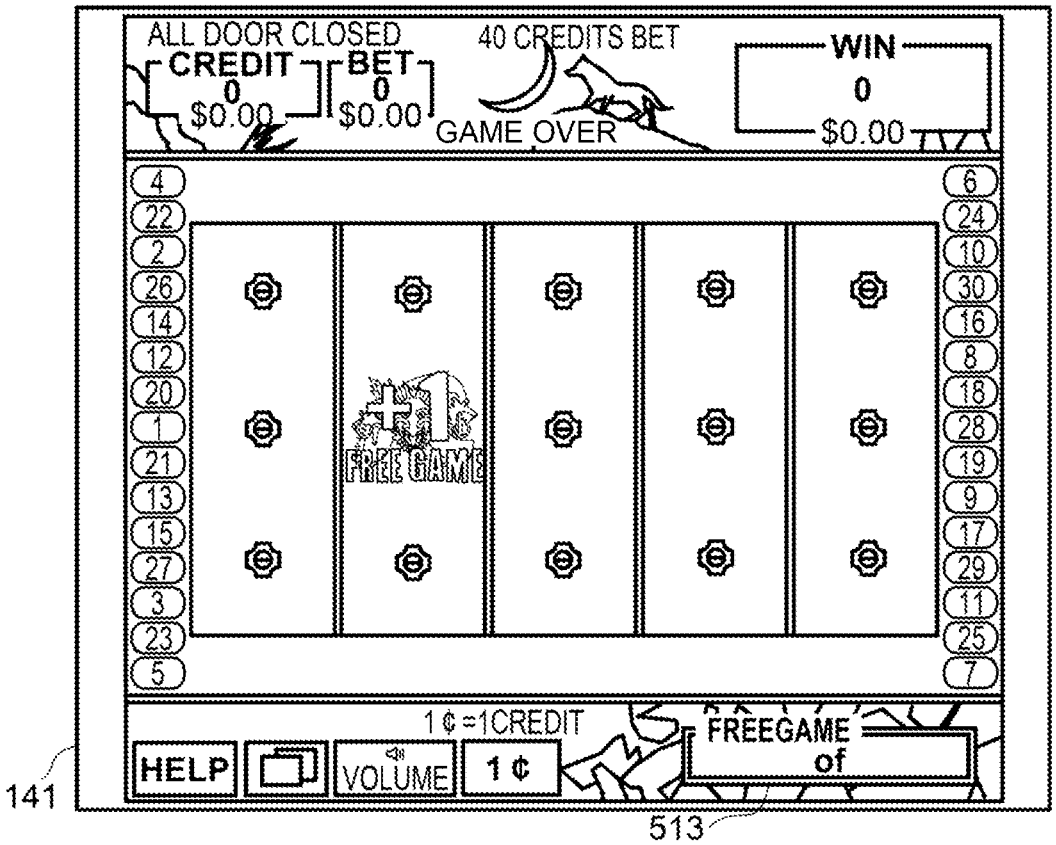
FIG. 39A is a diagram illustrating an image specification of the slot machine according to the embodiment of the present invention.
Figure 39B:
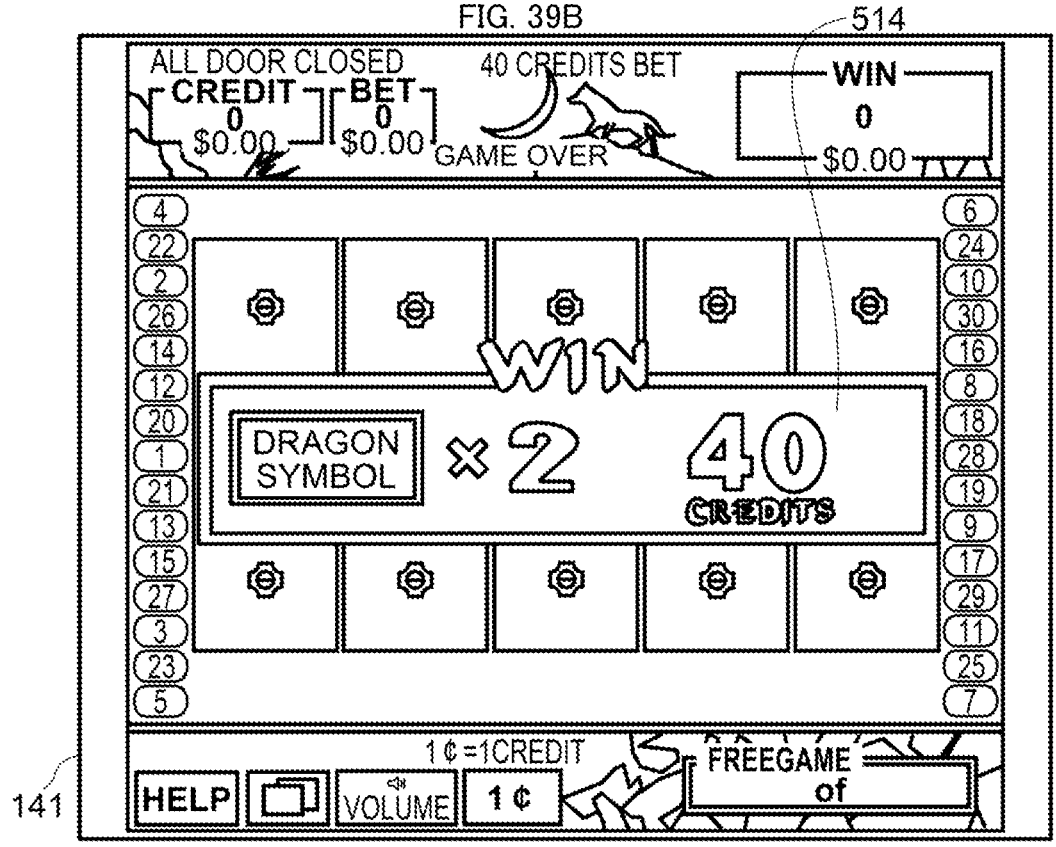
FIG. 39B is a diagram illustrating an image specification of the slot machine according to the embodiment of the present invention.

As on the upper side image display panel 131 and the lower side image display panel 141 shown in FIG. 38, when a SCATTER WIN has occurred during the free games, as shown in FIG. 39A, on the lower side image display panel 141, "+1" is displayed as the number of added free games. The number of added free games is moved to the number-of-FREE GAME display area 513 and added thereto. Next, on the lower side image display panel 141, as shown in FIG. 39B, a free game WIN signboard 514 is displayed. On the free game WIN signboard 514, words "DRAGON SYMBOL", a multiplying factor which ranges from one to five, and WIN credits whose number ranges from two digits up to four digits are displayed.

Figure 40:
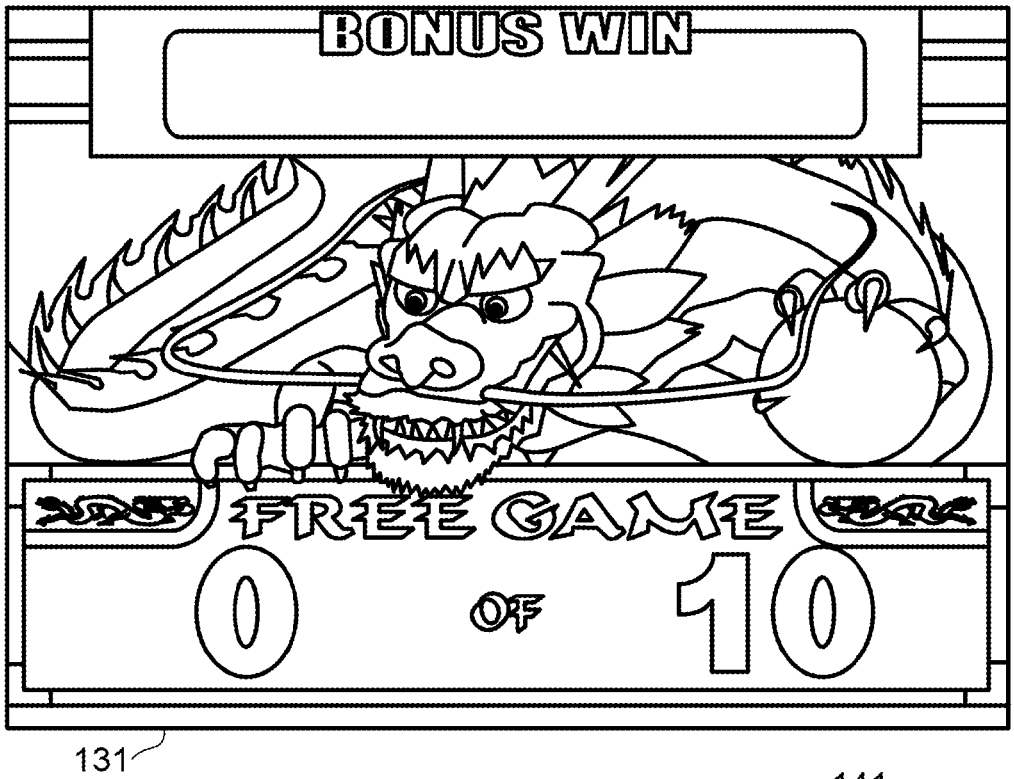
FIG. 40 is a diagram illustrating an image specification of the slot machine according to the embodiment of the present invention.
Figure 41A:
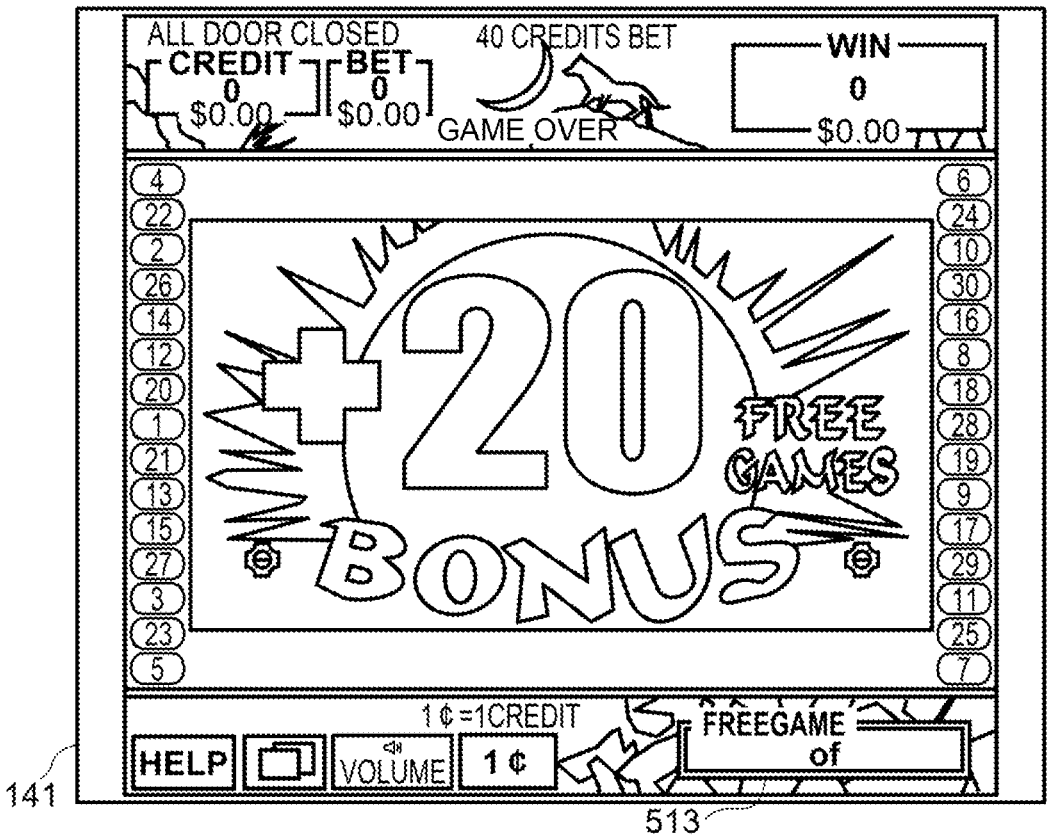
FIG. 41A is a diagram illustrating an image specification of the slot machine according to the embodiment of the present invention.
Figure 41B:
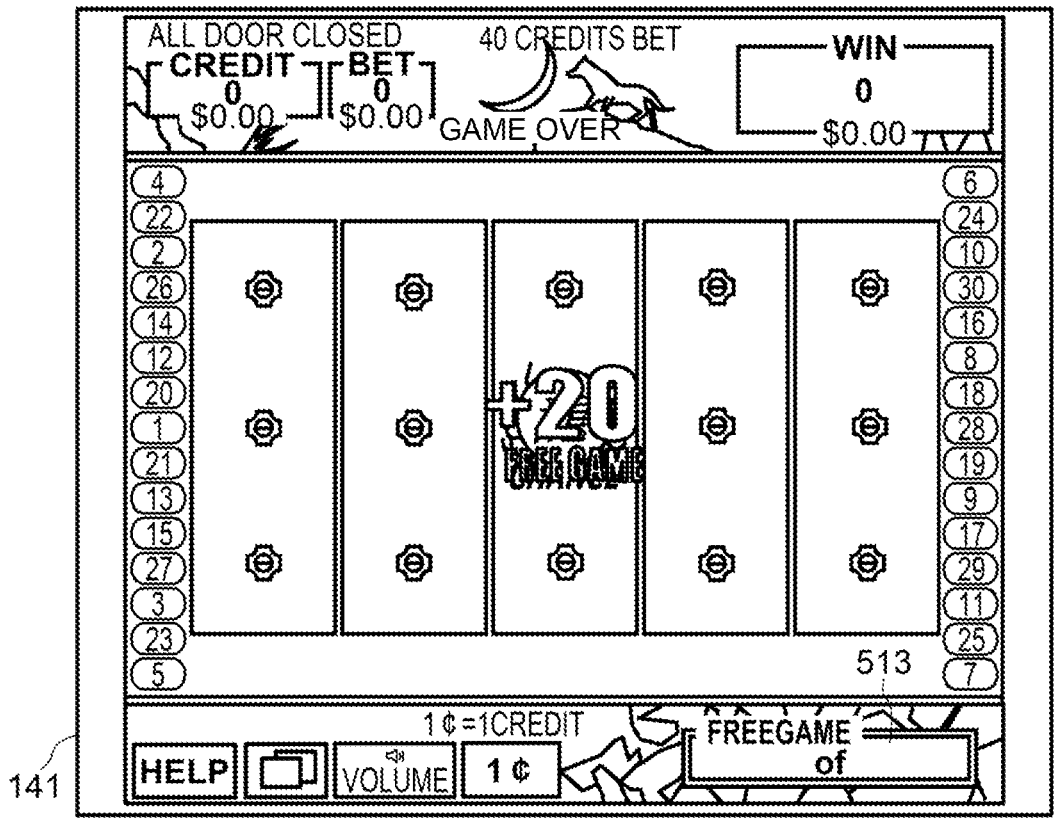
FIG. 41B is a diagram illustrating an image specification of the slot machine according to the embodiment of the present invention.

As on the upper side image display panel 131 and the lower side image display panel 141 shown in FIG. 40, when a ball is stopped and displayed during the free games, on the lower side image display panel 141, as shown in FIG. 41A, an open symbol is displayed and the number of added free games is displayed thereon. This display is conducted by using the whole video reels after stopping and displaying the video reels. There are nine kinds of the numbers of added games: 3, 4, 5, 7, 10, 15, 20, 25, and 30. Further, on the lower side image display panel 141, as shown in FIG. 41B, an action of adding the number of free games is conducted. This adding action is conducted by using the whole video reels. After finishing the adding action, the number of added games is moved to the number-of-FREE GAME display area 513 and added thereto.

Figure 42:
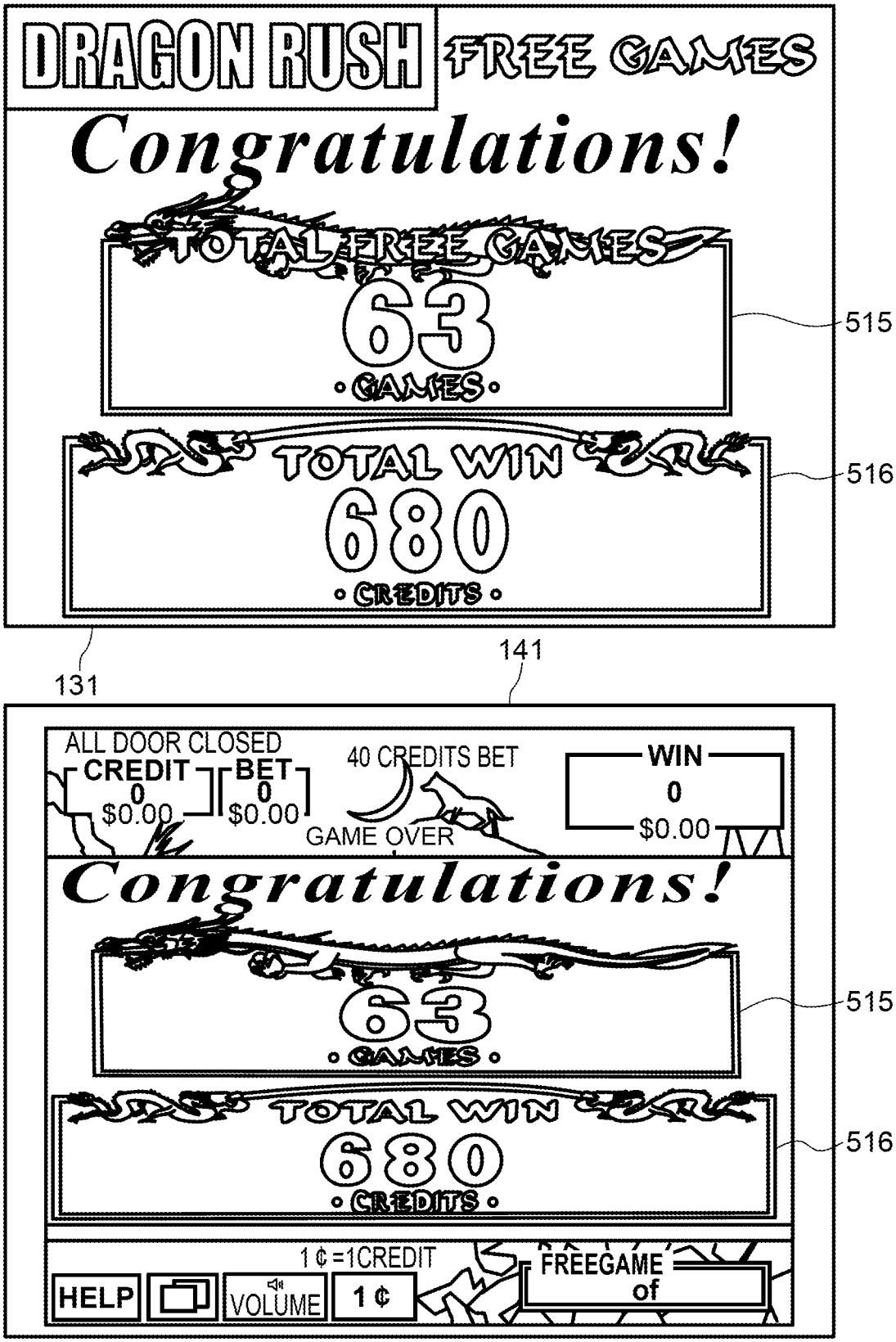
FIG. 42 is a diagram illustrating an image specification of the slot machine according to the embodiment of the present invention.
Figure 43:
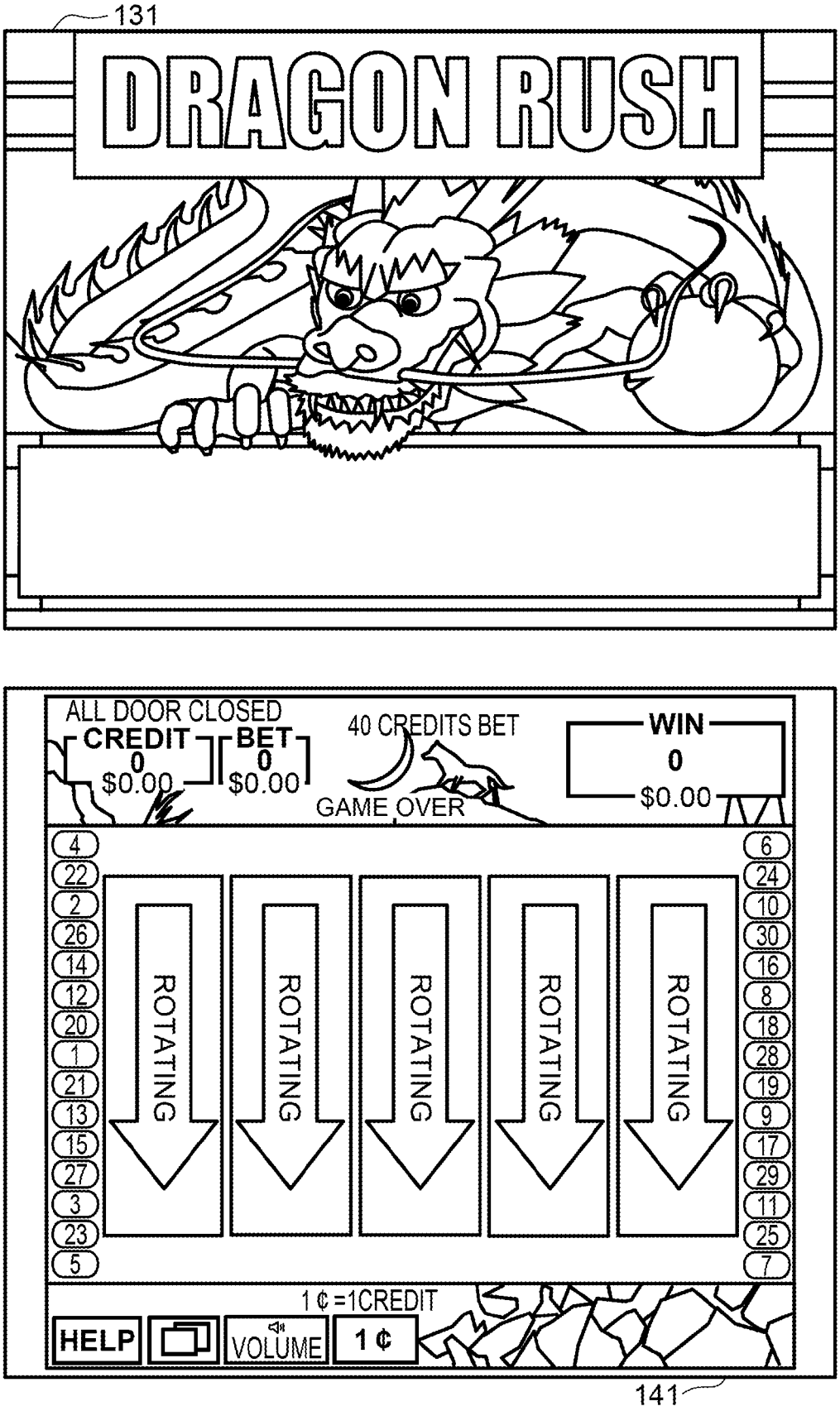
FIG. 43 is a diagram illustrating first predictive presentation effects of the slot machine according to the embodiment of the present invention.

As on the upper side image display panel 131 shown in FIG. 42, when a TOTAL WIN signboard of the free games is displayed, on the upper side image display panel 131, a celebration message "Congratulations!" is displayed. This message is displayed only when the number of games upon finishing the free games is 50 or more. Accordingly, when the number of games upon finishing the free games is in a range of 0 to 49, this message is not displayed. In addition, on the upper side image display panel 131, a TOTAL FREE GAMES display area 515 which allows two up to four digits to be displayed and a TOTAL WIN display area 516 which allows two up to six digits to be displayed are provided.

On the upper side image display panel 131, three kinds of backgrounds are displayed in accordance with the numbers of games upon finishing the free games. When the number of games upon finishing the free games is in the range of 0 to 49, a normal background is displayed. When the number of games upon finishing the free games is in a range of 50 to 99, a goodness background is displayed. When the number of games upon finishing the free games is 100 or more, a rejoicing background is displayed. On the lower side image display panel 141, displaying similar to that on the upper side image display panel 131 is conducted.

[First Predictive Presentation Effects]

The image specification is as described above. Next, with reference to FIG. 43 to FIG. 48, first predictive presentation effects of the slot machine 1 will be described. Each of FIG. 43 to FIG. 48 is a diagram illustrating the first predictive presentation effects of the slot machine according to the embodiment of the present invention.

The first predictive presentation effects are conducted as a harbinger of a free game trigger during the base game. As on the upper side image display panel 131 and the lower side image display panel 141 shown in FIG. 43, while the base game video reels are being scrolled and displayed, the dragon displayed on the upper side image display panel 131 moves irrespective of a game progression. In addition, as on the upper side image display panel 131 and the lower side image display panel 141 shown in FIG. 44, also while a part of the base game video reels is being scrolled and displayed, the dragon displayed on the upper side image display panel 131 moves irrespective of the game progression.

Figure 45:
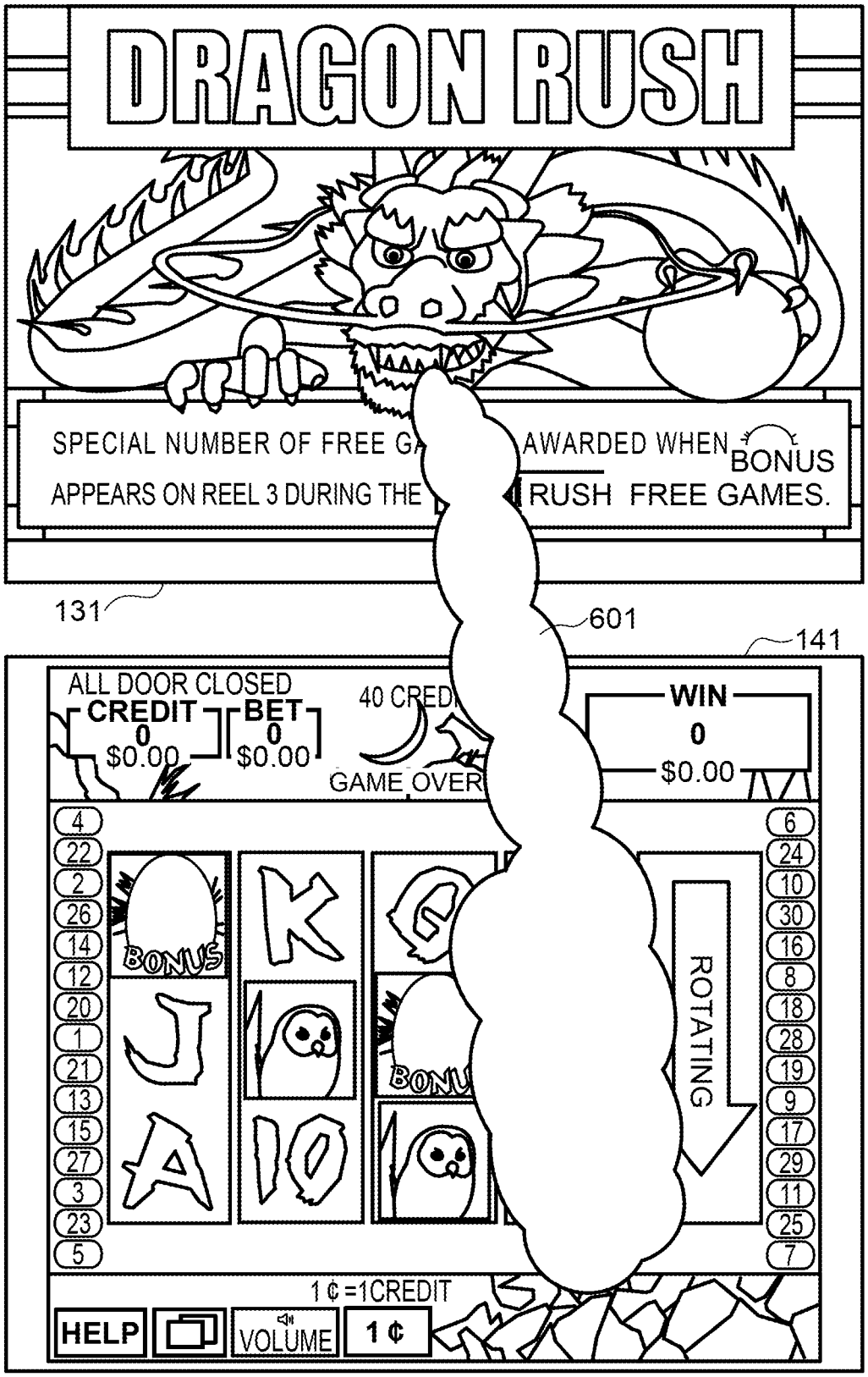
FIG. 45 is a diagram illustrating first predictive presentation effects of the slot machine according to the embodiment of the present invention.

However, as on the upper side image display panel 131 and the lower side image display panel 141 shown in FIG. 45, while only one of the base game video reels is being scrolled and displayed, the video reel being scrolled and displayed is hidden by a flame 601 breathed by the dragon displayed on the upper side image display panel 131. An image of the flame 601 is displayed so as to stretch gradually from the upper side image display panel 131 to the lower side image display panel 141. The dragon displayed on the upper side image display panel 131 moves irrespective of the game progression.

As on the upper side image display panel 131 and the lower side image display panel 141 shown in FIG. 46, the video reel scrolled and displayed, hidden by the image of the flame 601, appears. The dragon displayed on the upper side image display panel 131 moves irrespective of the game progression.

Figure 47:
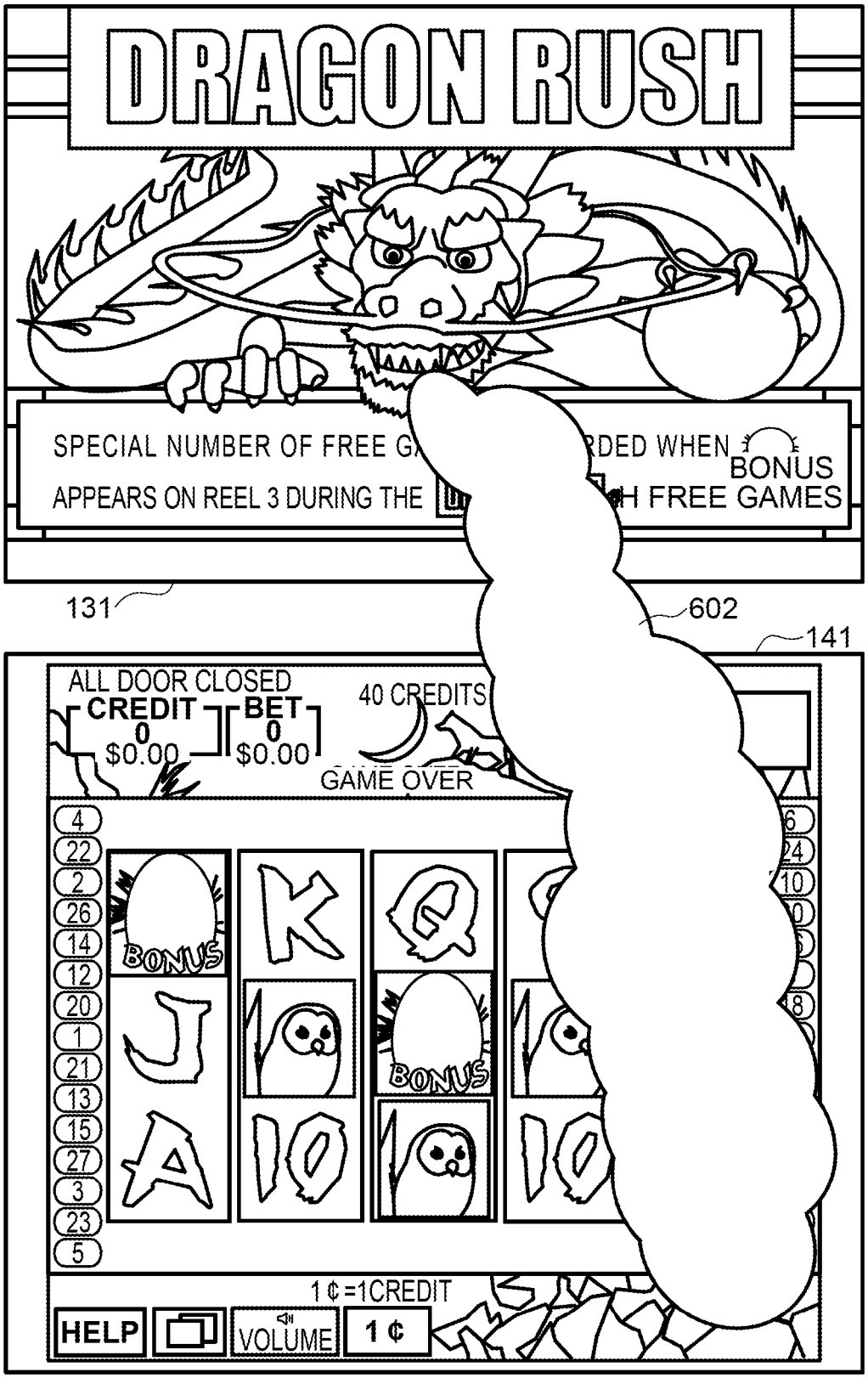
FIG. 47 is a diagram illustrating first predictive presentation effects of the slot machine according to the embodiment of the present invention.
Figure 50:
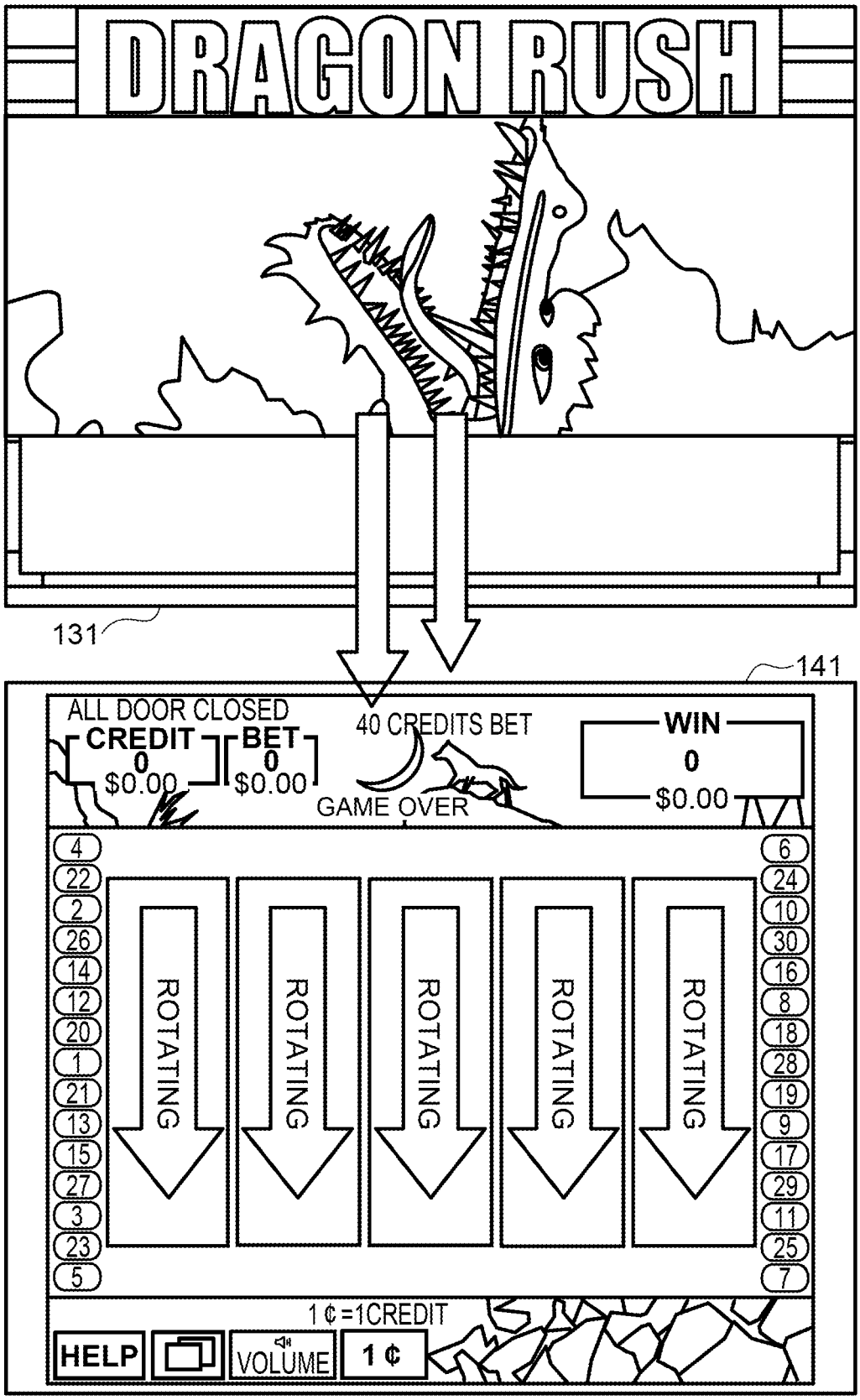
FIG. 50 is a diagram illustrating second predictive presentation effects of the slot machine according to the embodiment of the present invention.

Further, on the upper side image display panel 131 and the lower side image display panel 141 shown in FIG. 47, when the last one of the base game video reels, being scrolled and displayed, comes almost to be stopped and displayed, that video reel immediately before being stopped and displayed is hidden by a flame 602 breathed by the dragon shown on the upper side image display panel 131. An image of the flame 602 is displayed so as to stretch gradually from the upper side image display panel 131 to the lower side image display panel 141. The dragon displayed on the upper side image display panel 131 moves irrespective of the game progression.

As on the upper side image display panel 131 and the lower side image display panel 141 shown in FIG. 48, the video reel stopped and displayed, hidden by the image of the flame 602, appears. The dragon displayed on the upper side image display panel 131 moves irrespective of the game progression.

[Second Predictive Presentation Effects]

The first predictive presentation effects are as described above. Next, with reference to FIG. 49 to FIG. 54, second predictive presentation effects of the slot machine 1 will be described. Each of FIG. 49 to FIG. 54 is a diagram illustrating the second predictive presentation effects of the slot machine according to the embodiment of the present invention.

The second predictive presentation effects are conducted as a harbinger of the free game trigger during the base game. As on the upper side image display panel 131 and the lower side image display panel 141 shown in FIG. 49, while the base game video reels are stopped and displayed, the dragon displayed on the upper side image display panel 131 moves irrespective of the game progression. As on the upper side image display panel 131 and the lower side image display panel 141 shown in FIG. 50, upon starting scrolling and displaying of all of the base game video reels, the dragon displayed on the upper side image display panel 131 starts moving toward the lower side image display panel 141.

Further, as on the upper side image display panel 131 and the lower side image display panel 141 shown in FIG. 51, the dragon has disappeared from the upper side image display panel 131, and on the lower side image display panel 141, a rising dragon screen in which the dragon appears from a lower side is displayed.

Figure 52:
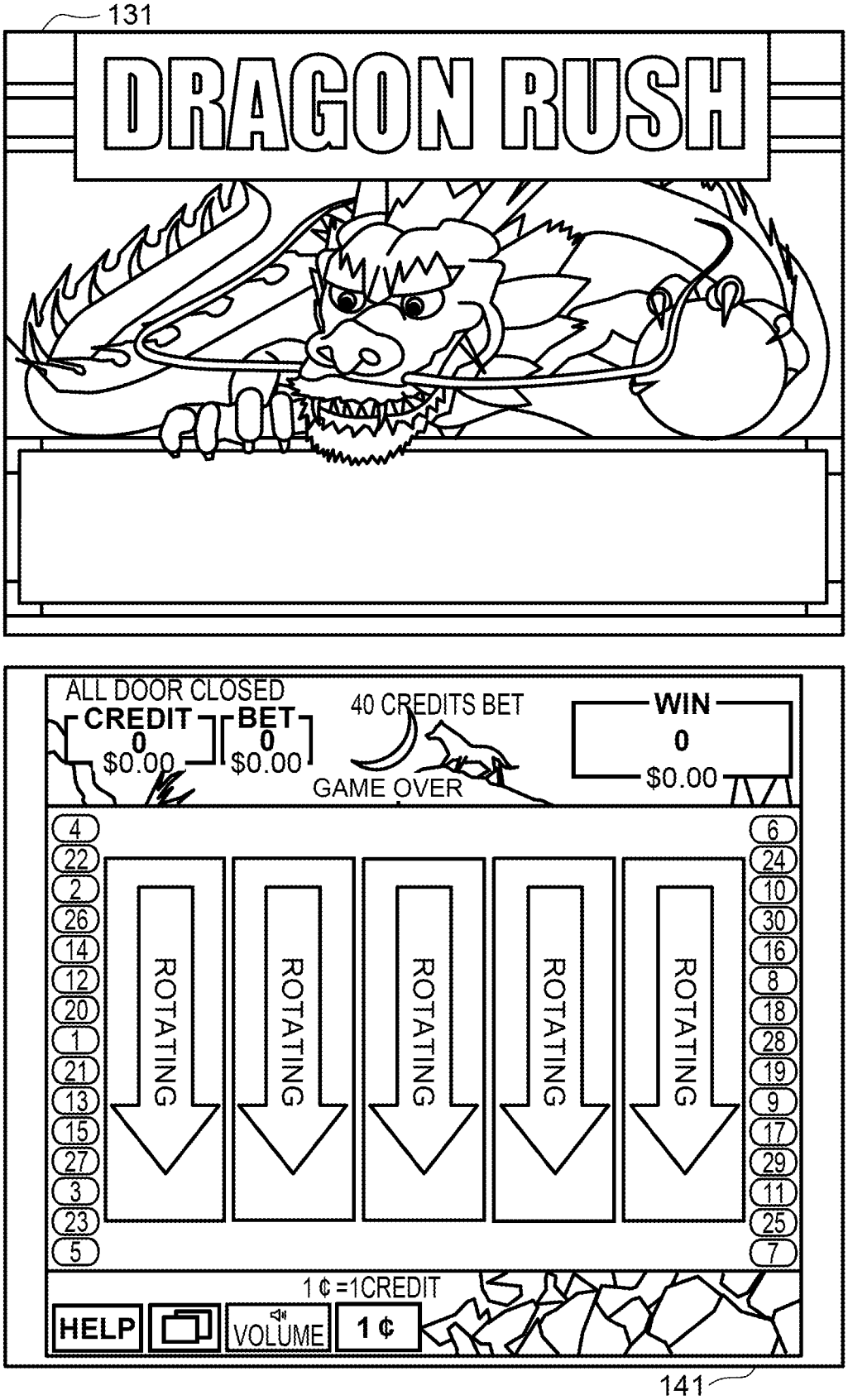
FIG. 52 is a diagram illustrating second predictive presentation effects of the slot machine according to the embodiment of the present invention.
Figure 54:
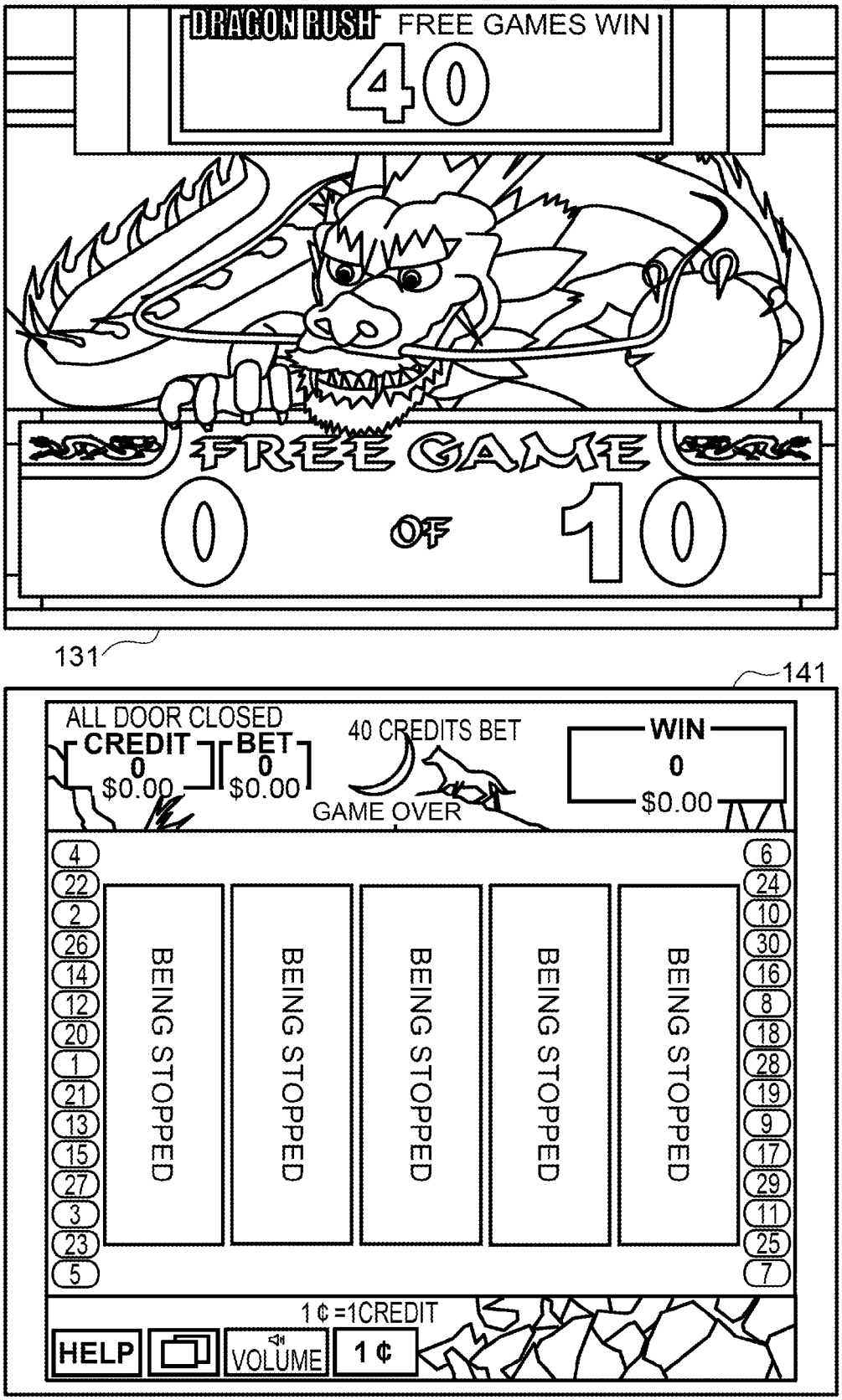
FIG. 54 is a diagram illustrating third predictive presentation effects of the slot machine according to the embodiment of the present invention.

Next, as on the upper side image display panel 131 and the lower side image display panel 141 shown in FIG. 52, the dragon has returned onto the upper side image display panel 131, and on the lower side image display panel 141, the scrolling and displaying of all of the base game video reels are maintained. The dragon displayed on the upper side image display panel 131 moves irrespective of the game progression.

As on the upper side image display panel 131 and the lower side image display panel 141 shown in FIG. 53, on the lower side image display panel 141, all of the base game video reels are concurrently stopped and displayed. The dragon displayed on the upper side image display panel 131 moves irrespective of the game progression.

[Third Predictive Presentation Effects]

The second predictive presentation effects are as described above. Next, with reference to FIG. 55 to FIG. 56, third predictive presentation effects of the slot machine 1 will be described. Each of FIG. 55 to FIG. 56 is a diagram illustrating the third predictive presentation effects of the slot machine according to the embodiment of the present invention.

The third predictive presentation effects are conducted as a harbinger of a retrigger during the free games. As on the upper side image display panel 131 and the lower side image display panel 141 shown in FIG. 54, while all of the free game video reels are stopped and displayed, the dragon displayed on the upper side image display panel 131 moves irrespective of the game progression.

As on the upper side image display panel 131 and the lower side image display panel 141 shown in FIG. 55, upon starting scrolling and displaying of all of the free game video reels, immediately thereafter, a yellow flash is displayed on the frame of the symbol display area 4 of the lower side image display panel 141. While all of the free game video reels are stopped and displayed, the dragon displayed on the upper side image display panel 131 moves irrespective of the game progression.

Figure 56:
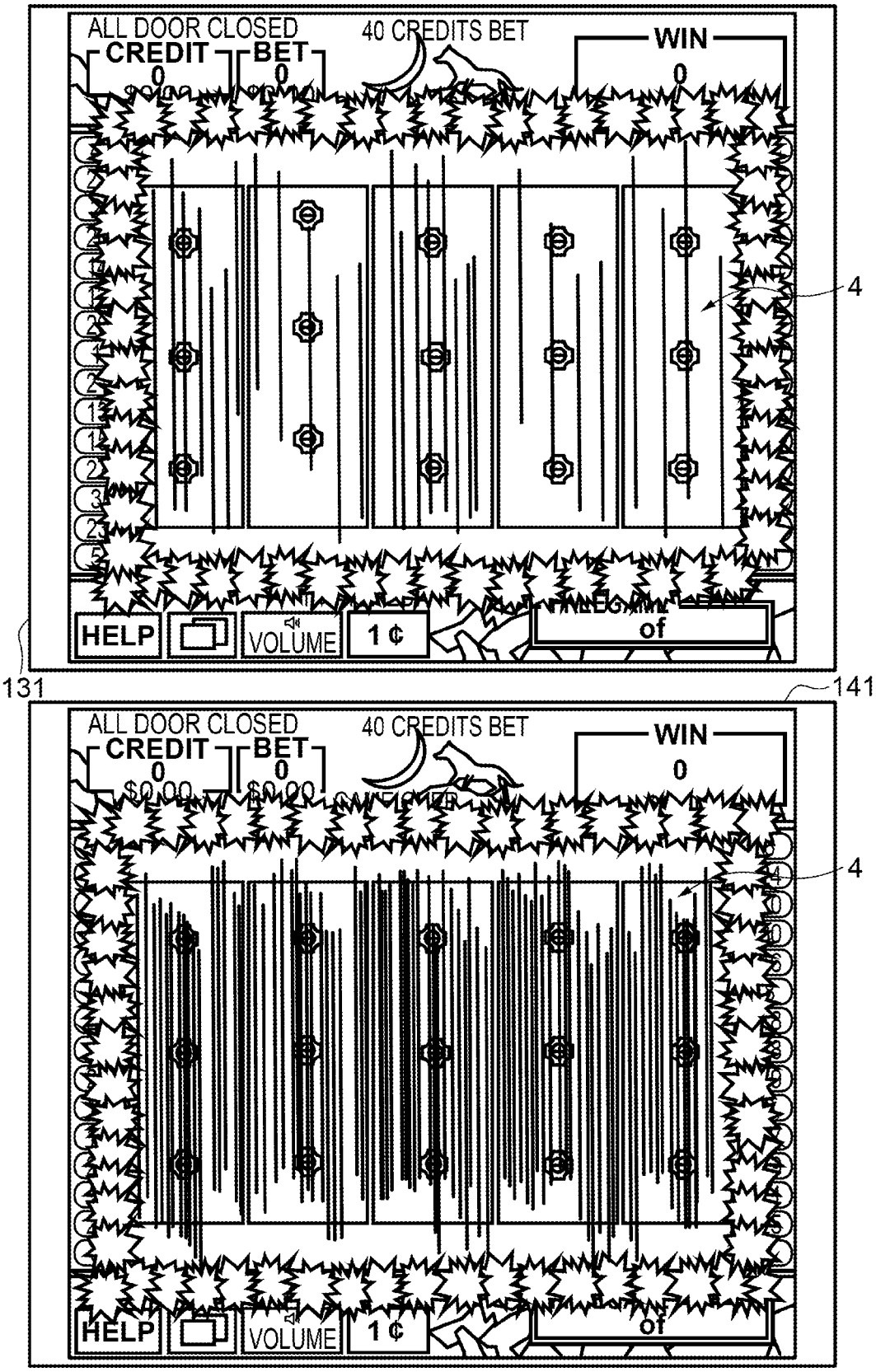
FIG. 56 is a diagram illustrating third predictive presentation effects of the slot machine according to the embodiment of the present invention.

In addition, as shown on an upper side in FIG. 56, on the lower side image display panel 141 upon conducting the third predictive presentation effects, a red flash may be displayed on the frame of the symbol display area 4. Or as shown on an upper side in FIG. 56, on the lower side image display panel 141 upon conducting the third predictive presentation effects, a rainbow flash may be displayed on the frame of the symbol display area 4. Also in this case, the dragon displayed on the upper side image display panel 131 moves irrespective of the game progression.

[Upper Side Image Display Panel Presentation Effects During Free Games]

Figure 57A:
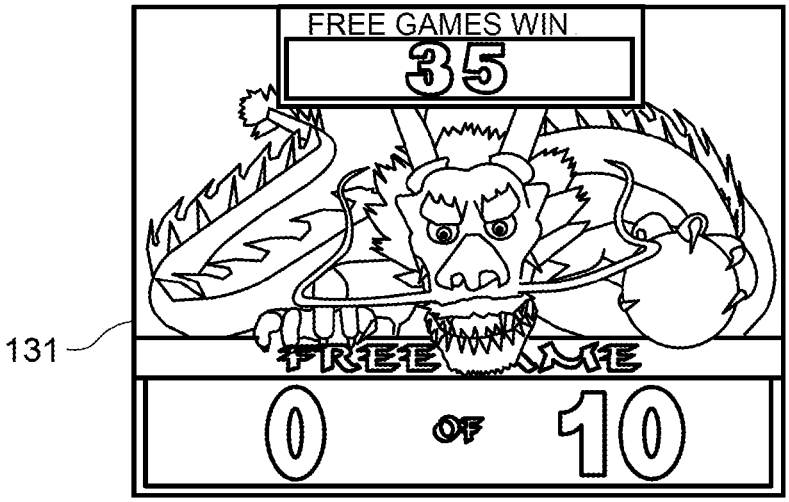
FIG. 57A is a diagram illustrating upper side image display panel presentation effects of the slot machine according to the embodiment of the present invention during the free games.
Figure 57B:
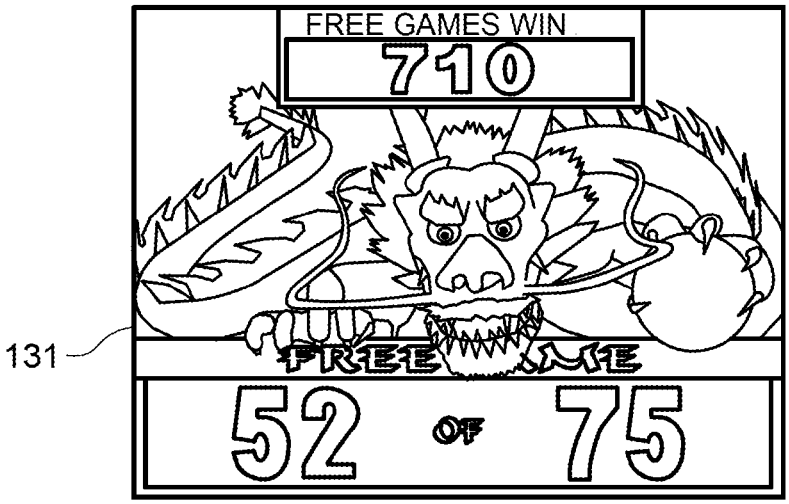
FIG. 57B is a diagram illustrating upper side image display panel presentation effects of the slot machine according to the embodiment of the present invention during the free games.
Figure 57C:
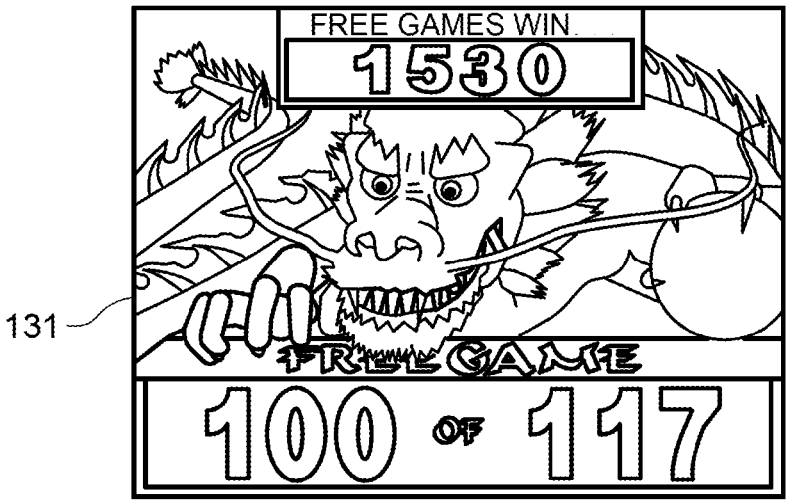
FIG. 57C is a diagram illustrating upper side image display panel presentation effects of the slot machine according to the embodiment of the present invention during the free games.

The third predictive presentation effects are as described above. Next, with reference to FIG. 57A to 57C, upper side image display panel presentation effects of the slot machine 1 during the free games will be described. FIG. 57A to 57C is a diagram illustrating the upper side image display panel presentation effects of the slot machine according to the embodiment of the present invention during the free games.

As on the upper side image display panel 131 shown in FIG. 57A, until the number of free games from starting of free games reaches 49, the dragon displayed on the upper side image display panel 131 is displayed in green. As on the upper side image display panel 131 shown in FIG. 57B, when the number of free games is in a range from 50 to 99, the dragon displayed on the upper side image display panel 131 is displayed in red. As on the upper side image display panel 131 shown in FIG. 57C, when the number of free games is 100 or more, the dragon displayed on the upper side image display panel 131 is displayed in gold.

[GAMBLE Specification]

The one example of the upper side image display panel presentation effects of the slot machine 1 during the free games are as described above. Next, with reference to FIG. 58 to FIG. 64, a GAMBLE specification of the slot machine 1 will be described. Each of FIG. 58 to FIG. 64 is a diagram illustrating the GAMBLE specification of the slot machine according to the embodiment of the present invention.

Figure 58:
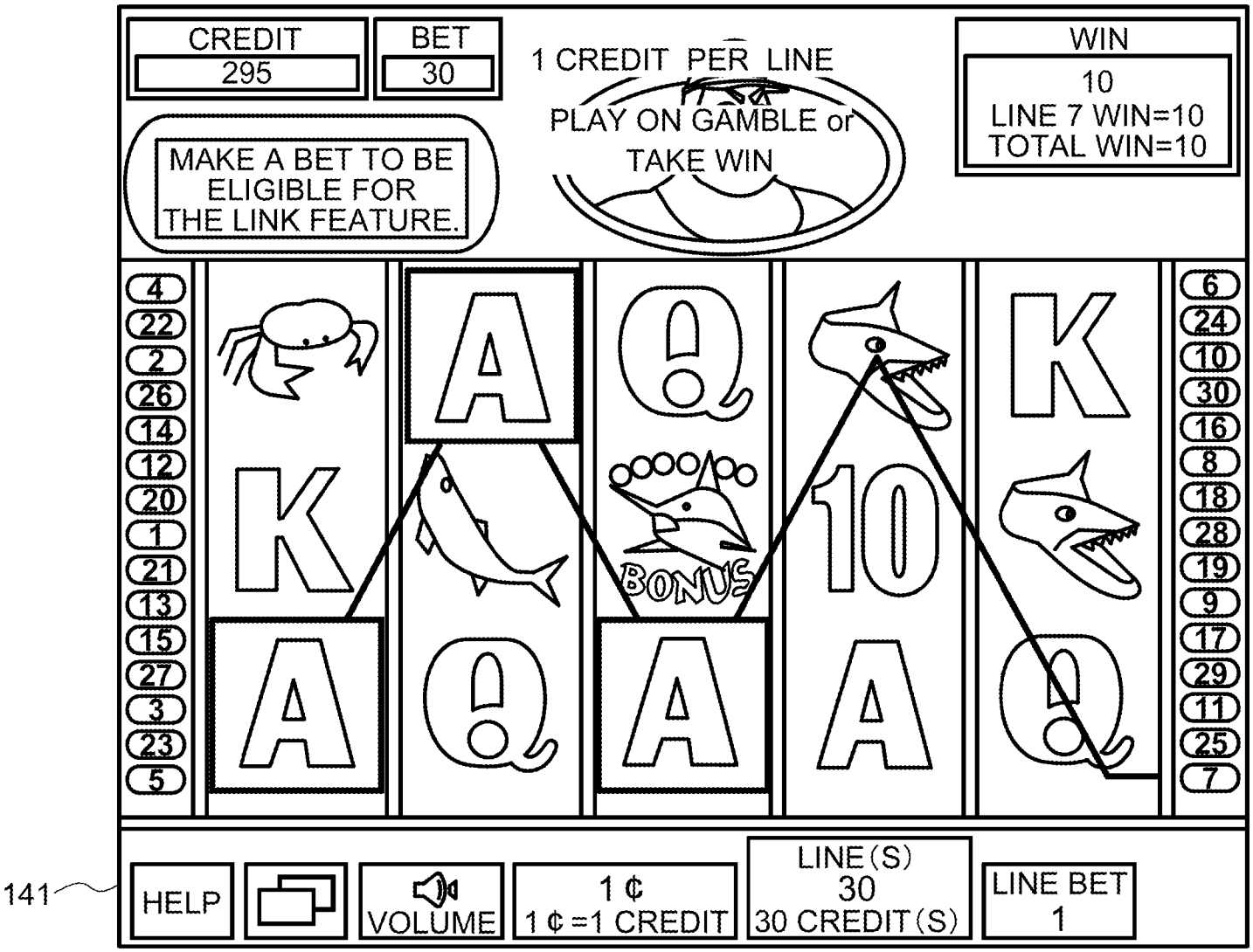
FIG. 58 is a diagram illustrating a GAMBLE specification of the slot machine according to the embodiment of the present invention.
Figure 59:
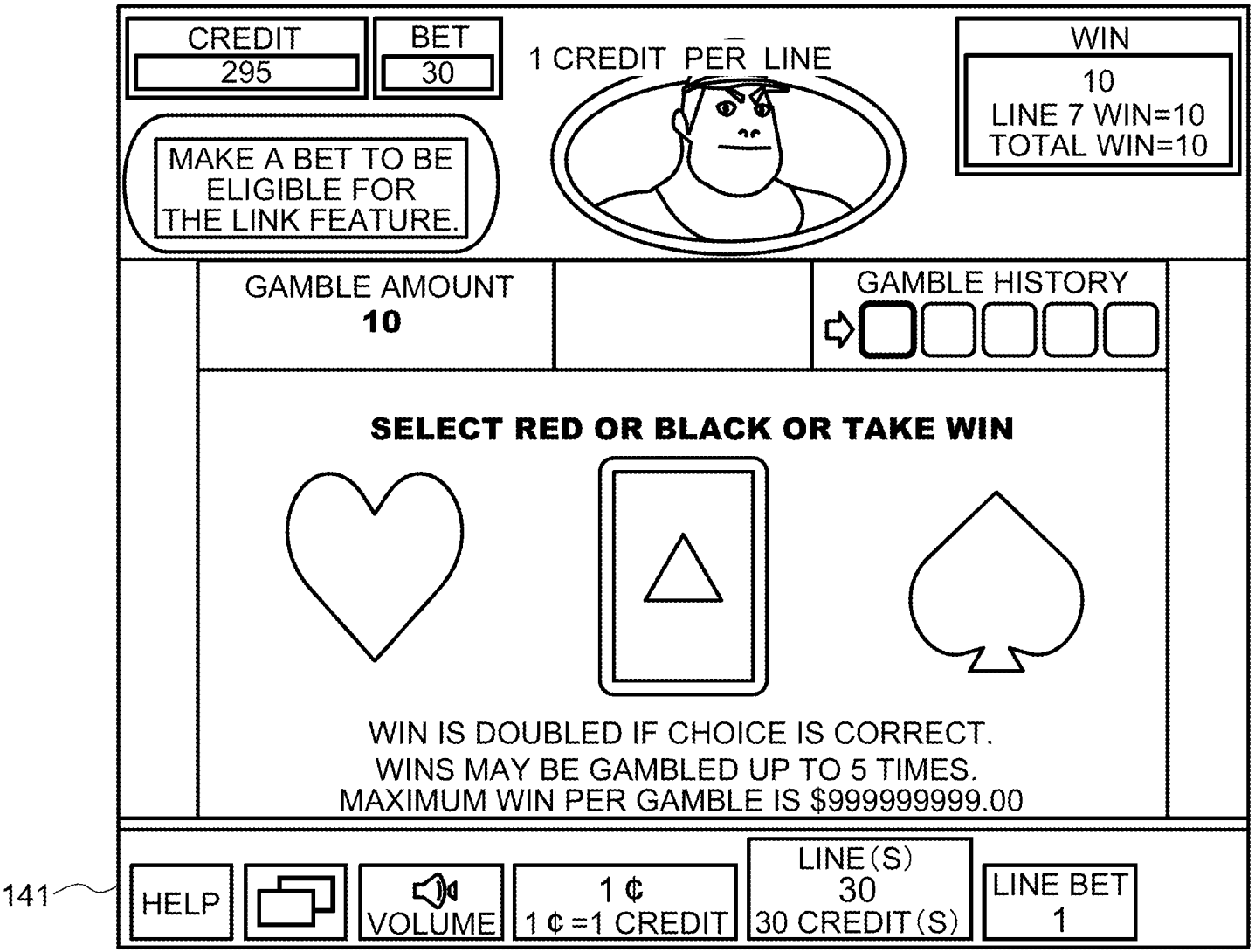
FIG. 59 is a diagram illustrating a GAMBLE specification of the slot machine according to the embodiment of the present invention.

First, when WIN occurs, the lower side image display panel 141 shown in FIG. 58 is changed to the lower side image display panel 141 shown in FIG. 59. In other words, a GAMBLE screen is displayed, and a message "PLAY ON, GAMBLE or TAKE WIN" is erased. On the other hand, a message "SELECT RED OR BLACK OR TAKE WIN is displayed on the lower side image display panel 141.

Figure 60:
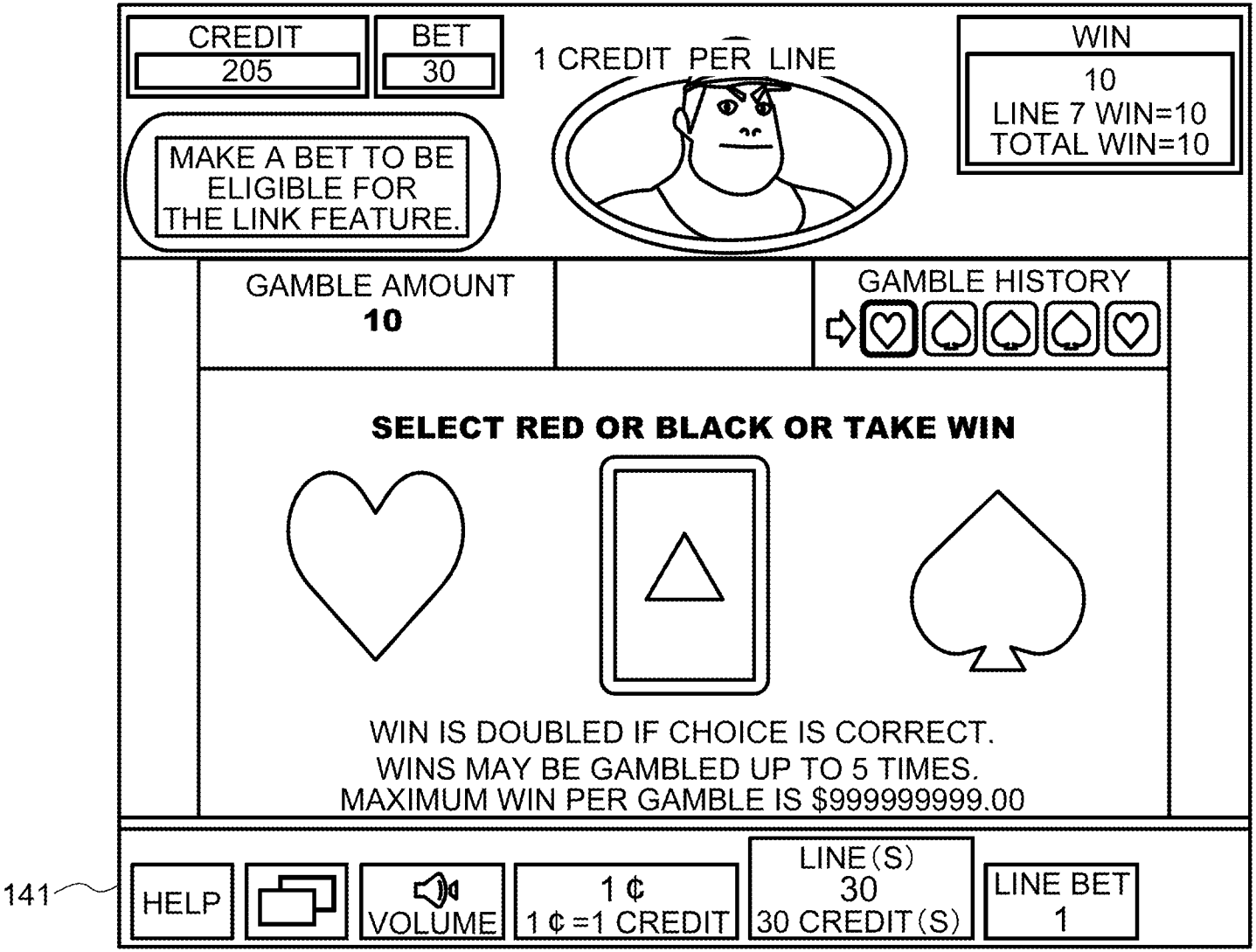
FIG. 60 is a diagram illustrating a GAMBLE specification of the slot machine according to the embodiment of the present invention.

Next, on the lower side image display panel 141 shown in FIG. 60, a bet amount as a "GAMBLE AMOUNT" is displayed on the lower side image display panel 141. Here, a player selects "RED" or "BLACK". When this selection is successful, the lower side image display panel 141 is changed to the lower side image display panel 141 shown in FIG. 63 described later. In contrast to this, when this selection is unsuccessful, the lower side image display panel 141 is changed to the lower side image display panel 141 shown in FIG. 61. When a player selects "TAKE WIN", on the lower side image display panel 141, a WIN value is immediately added to the credit, and an idling state returns.

Figure 61:
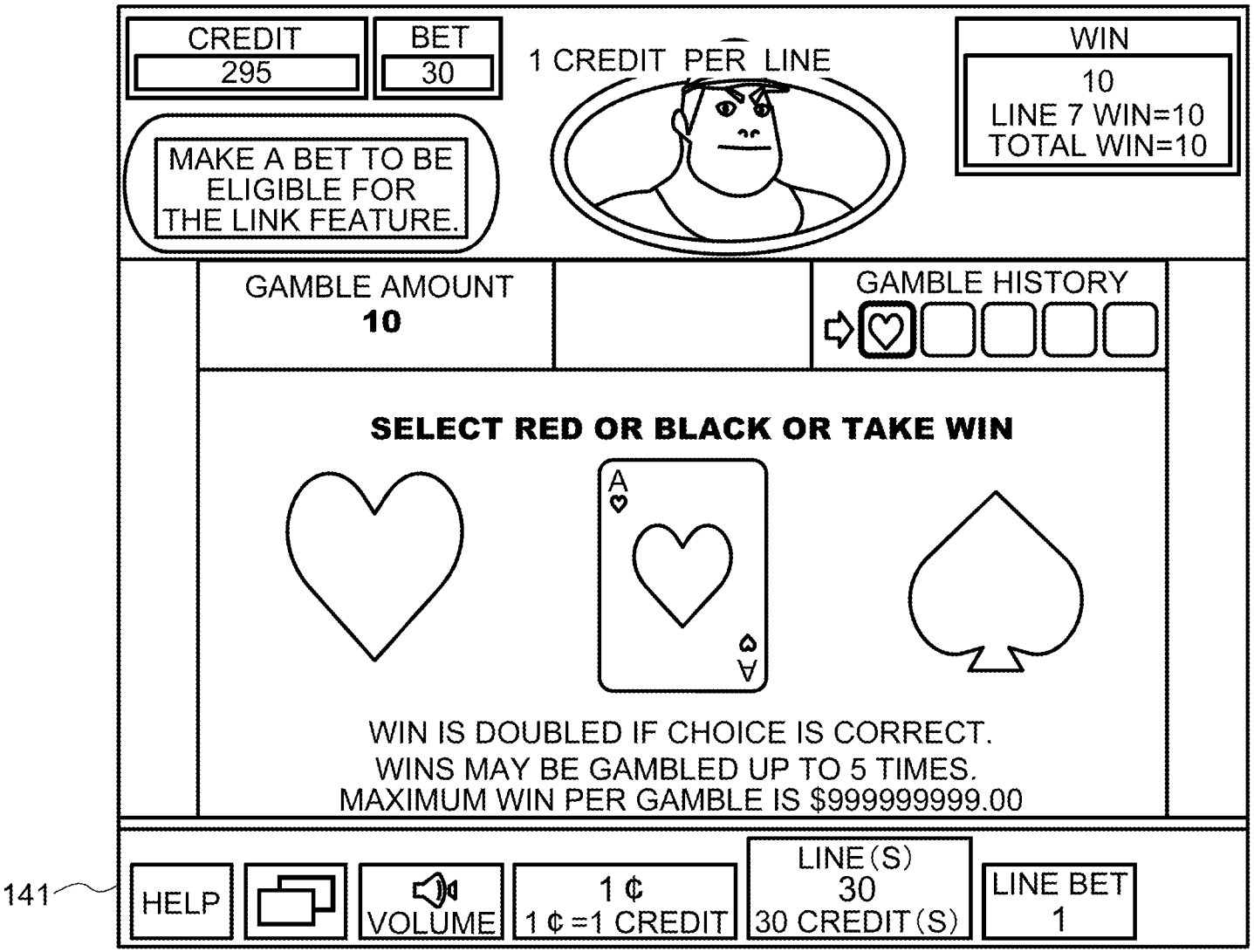
FIG. 61 is a diagram illustrating a GAMBLE specification of the slot machine according to the embodiment of the present invention.
Figure 62:
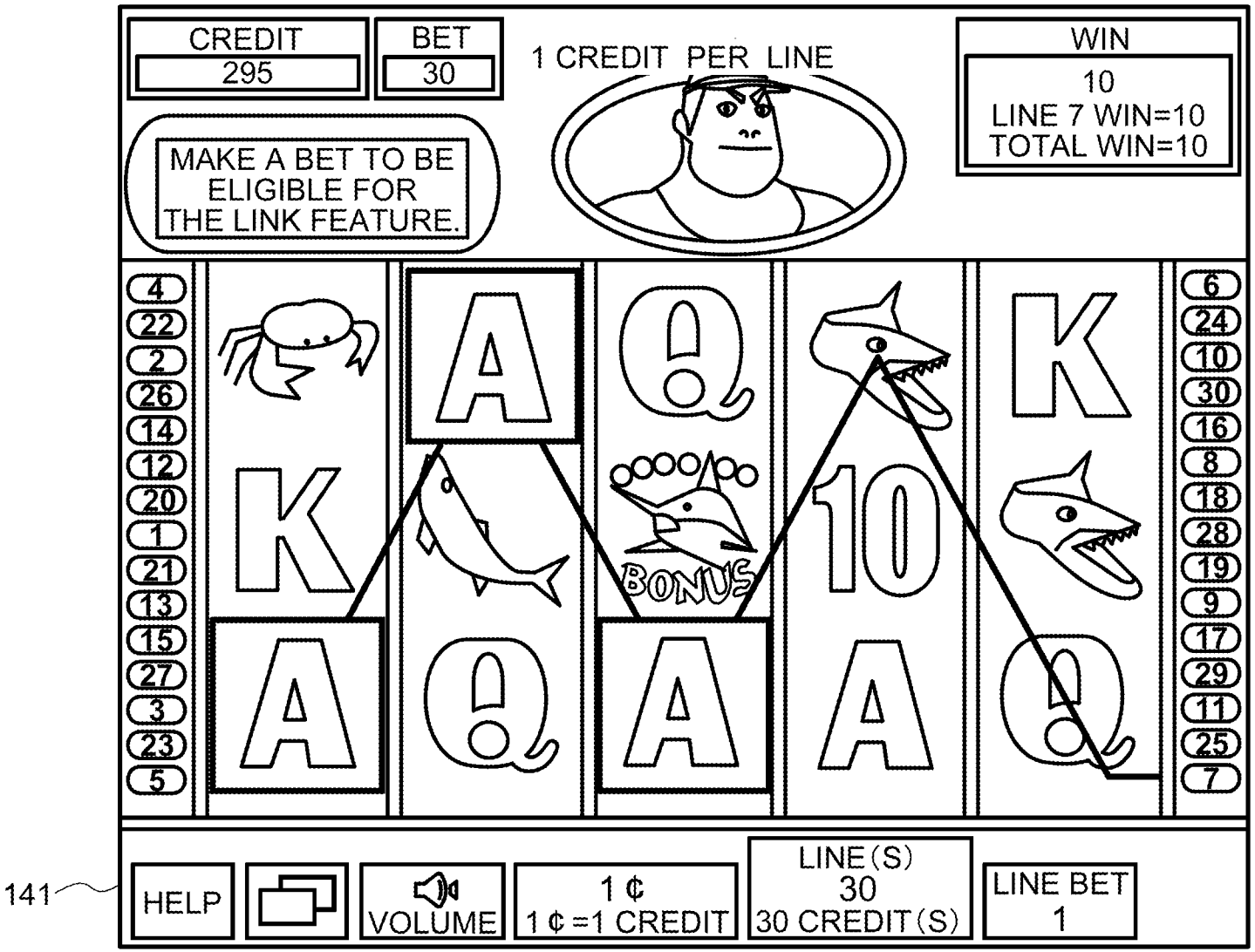
FIG. 62 is a diagram illustrating a GAMBLE specification of the slot machine according to the embodiment of the present invention.

When the player's selection is unsuccessful, on the lower side image display panel 141 shown in FIG. 61, a selection choice ("RED" or "BLACK") which has not been selected becomes dark. In addition, on the lower side image display panel 141 shown in FIG. 61, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, a result of the central card is immediately displayed. At this time point, however, the WIN meter and the GAMBLE AMOUNT meter do not change. Thereafter, chagrin sound is outputted, and 1.2 second after the outputting of the chagrin sound, as shown in FIG. 62, the lower side image display panel 141 is switched to a MAIN GAME screen. Upon switching to the MAIN GAME screen, concurrently, "0 is displayed in the WIN meter.

Figure 63:
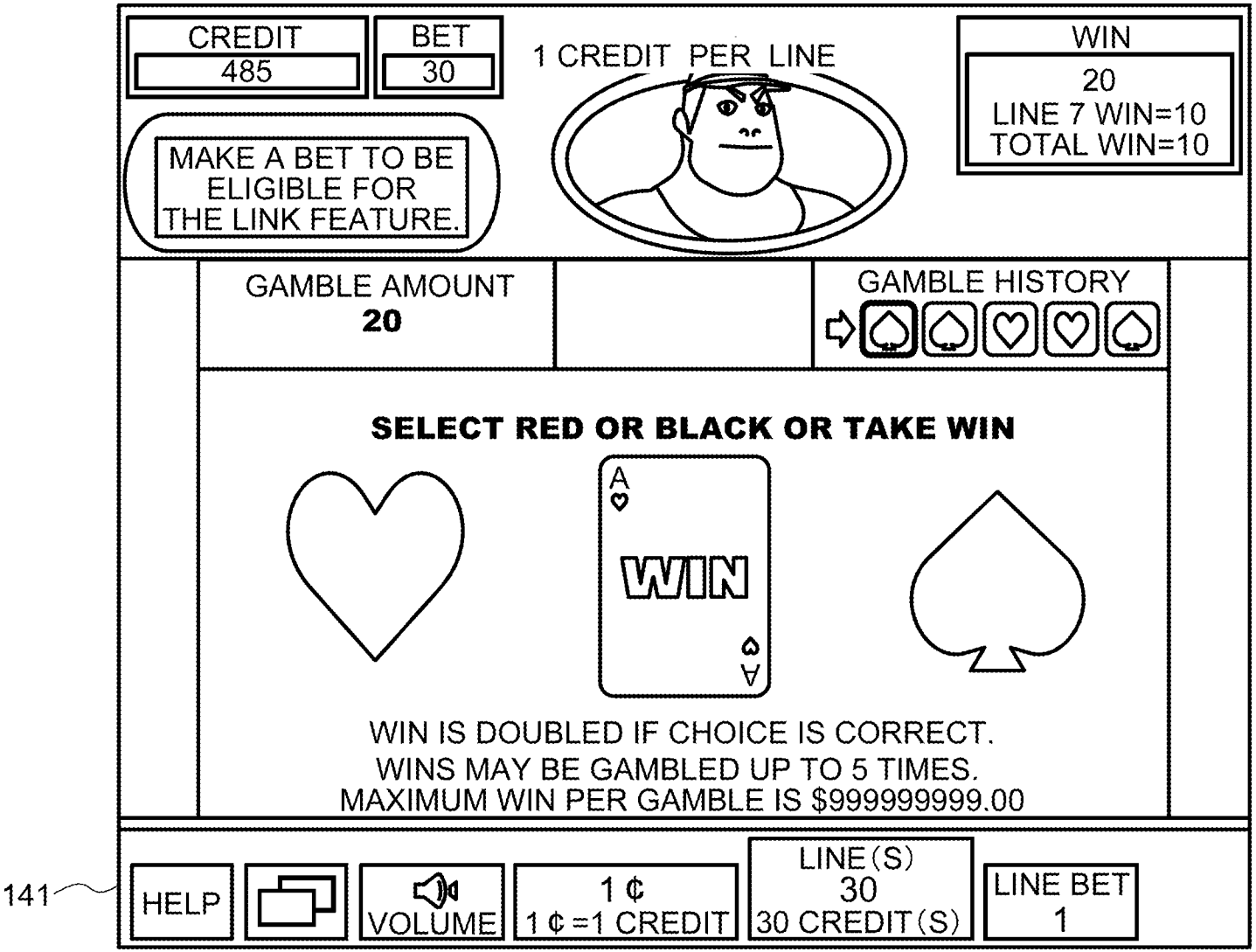
FIG. 63 is a diagram illustrating a GAMBLE specification of the slot machine according to the embodiment of the present invention.
Figure 64:
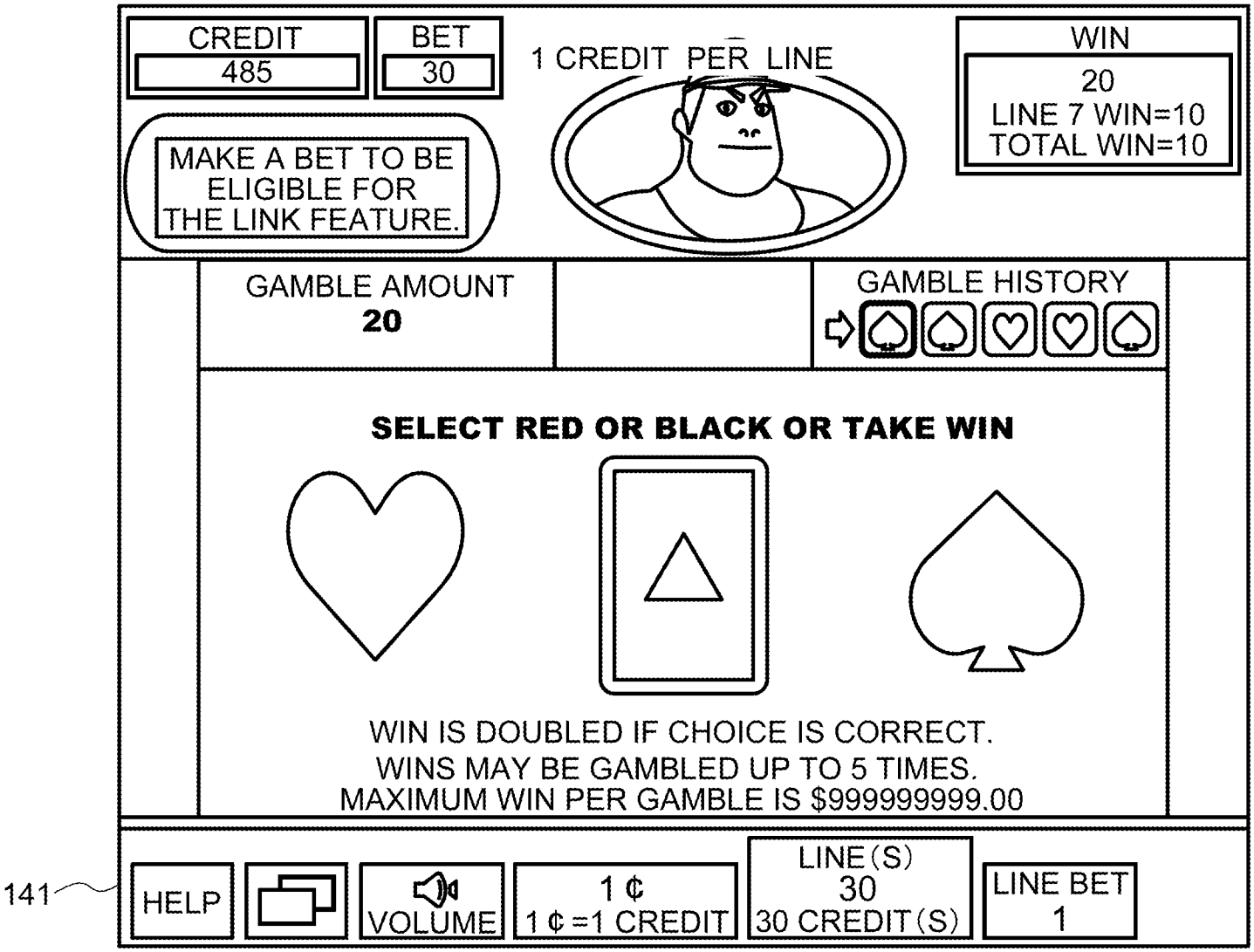
FIG. 64 is a diagram illustrating a GAMBLE specification of the slot machine according to the embodiment of the present invention.

When the player's selection is successful, on the lower side image display panel 141 shown in FIG. 63, a selection choice ("RED" or "BLACK") which has not been selected becomes dark. In addition, on the lower side image display panel 141 shown in FIG. 63, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, as a central card, a normal card and a card having a word WIN are alternately displayed on a one frame-by-one frame basis, and success sound is outputted for 1.2 second. On the WIN meter, a value increased by the GAMBLE result is immediately added. At this point, however, the GAMBLE AMOUNT meter does not change.

Here, when the GAMBLE has been played at the upper limit number of times, a WIN value is immediately added to the credit, and the idling state returns. In contrast to this, when the GAMBLE has not been played at the upper limit number of times, the lower side image display panel 141 is changed to the lower side image display panel 141 shown in FIG. 64. On the lower side image display panel 141 shown in FIG. 64, the central card is displayed face down. Thereafter, the lower side image display panel 141 is changed to the lower side image display panel 141 shown in FIG. 60.

On the MAIN GAME screen on the lower side image display panel 141 shown in FIG. 58 and FIG. 62, to facilitate understanding, symbols which are different from the above-described symbols are also displayed.

[RESIDUAL GAMBLE]

Figure 65:
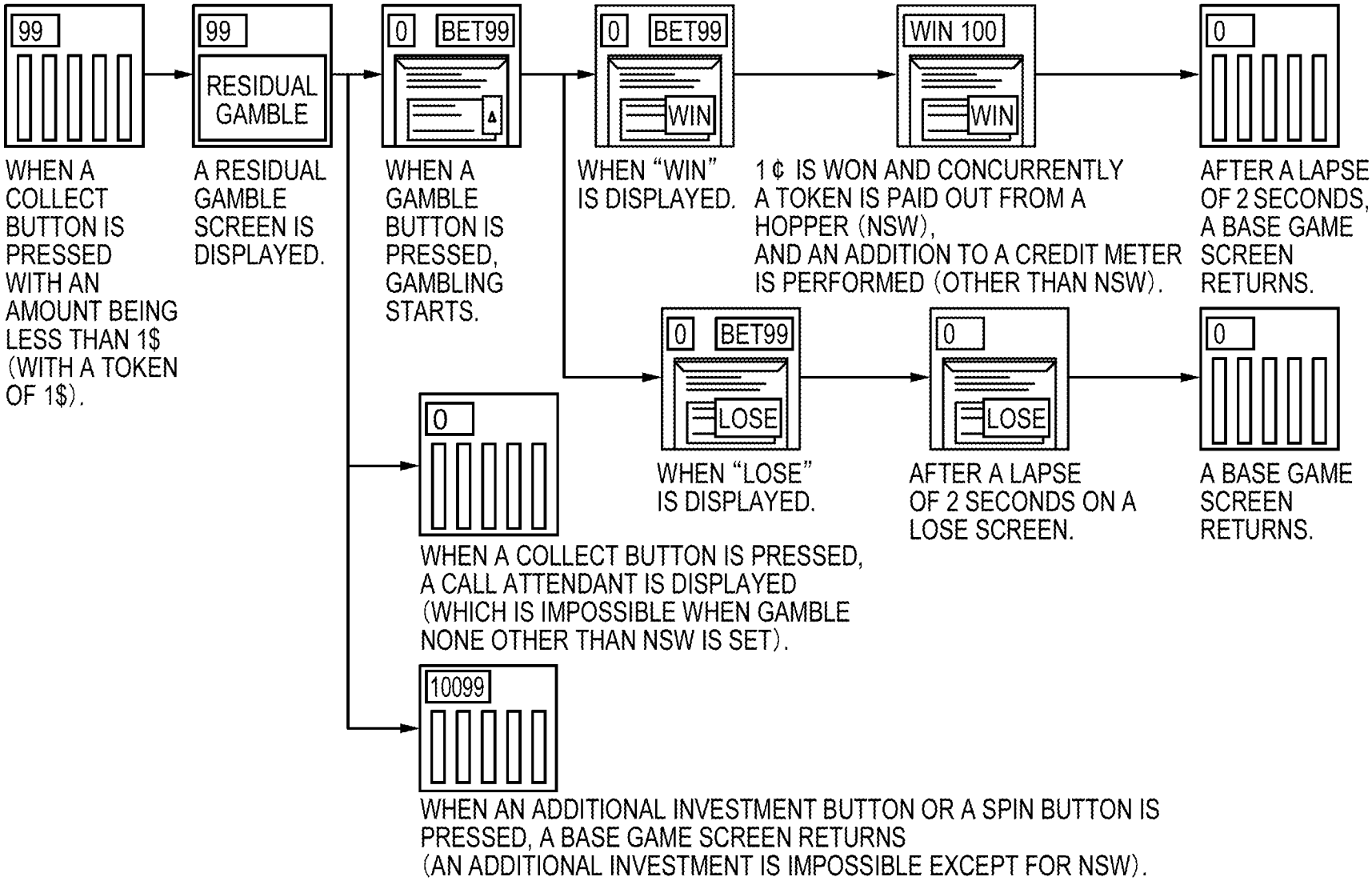
FIG. 65 is a diagram explaining RESIDUAL GAMBLE of the slot machine according to the embodiment of the present invention.
Figure 67:
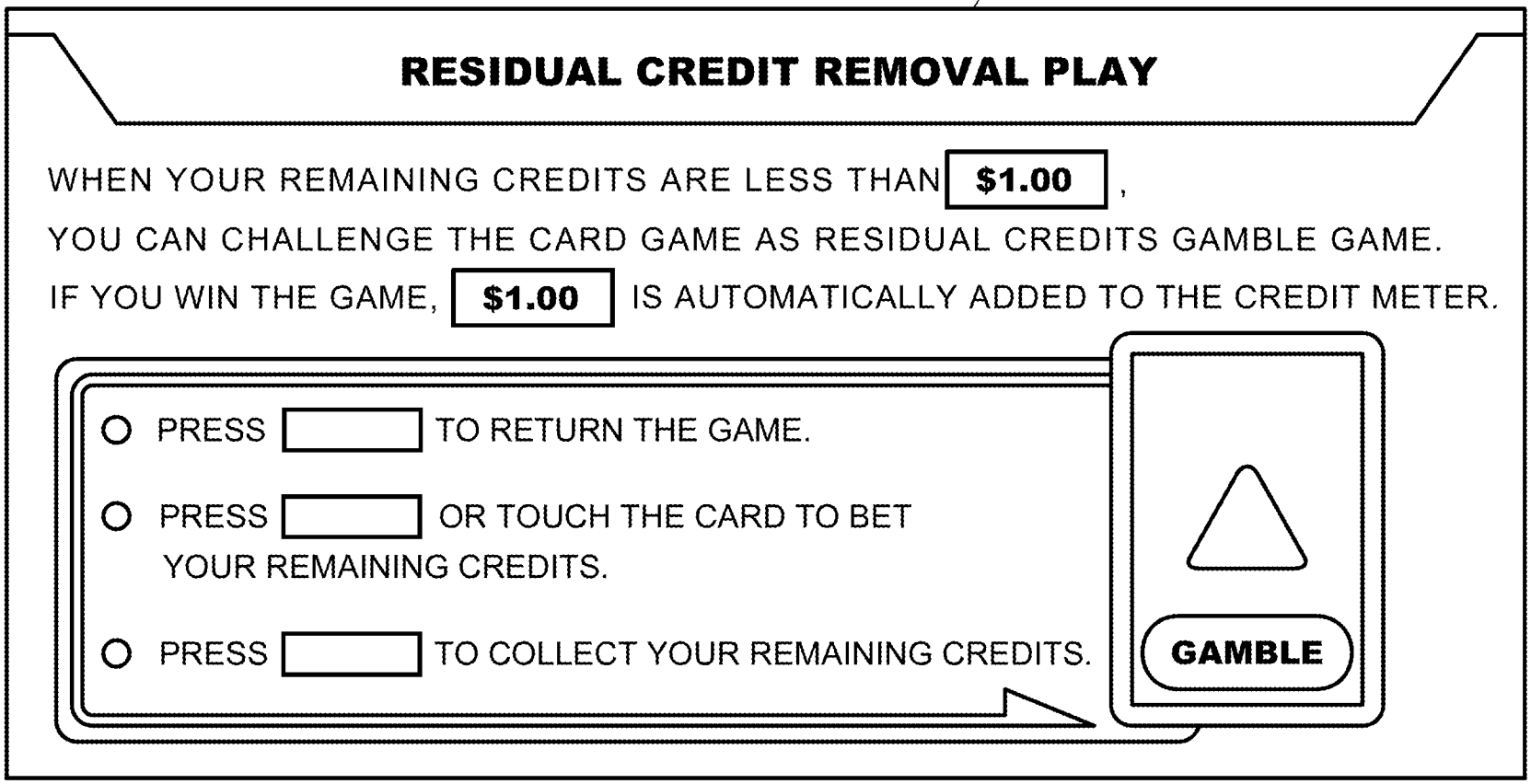
FIG. 67 is a diagram explaining RESIDUAL GAMBLE of the slot machine according to the embodiment of the present invention.
Figure 68:
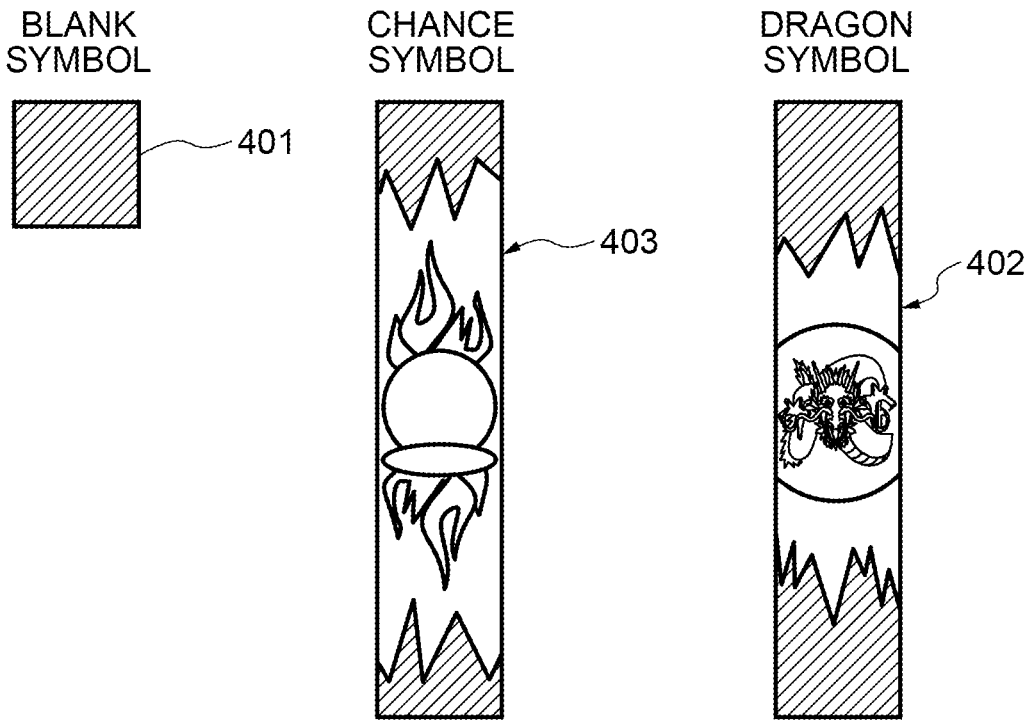
FIG. 68 is a diagram illustrating a problem of the slot machine according to the embodiment of the present invention.
Figure 69:
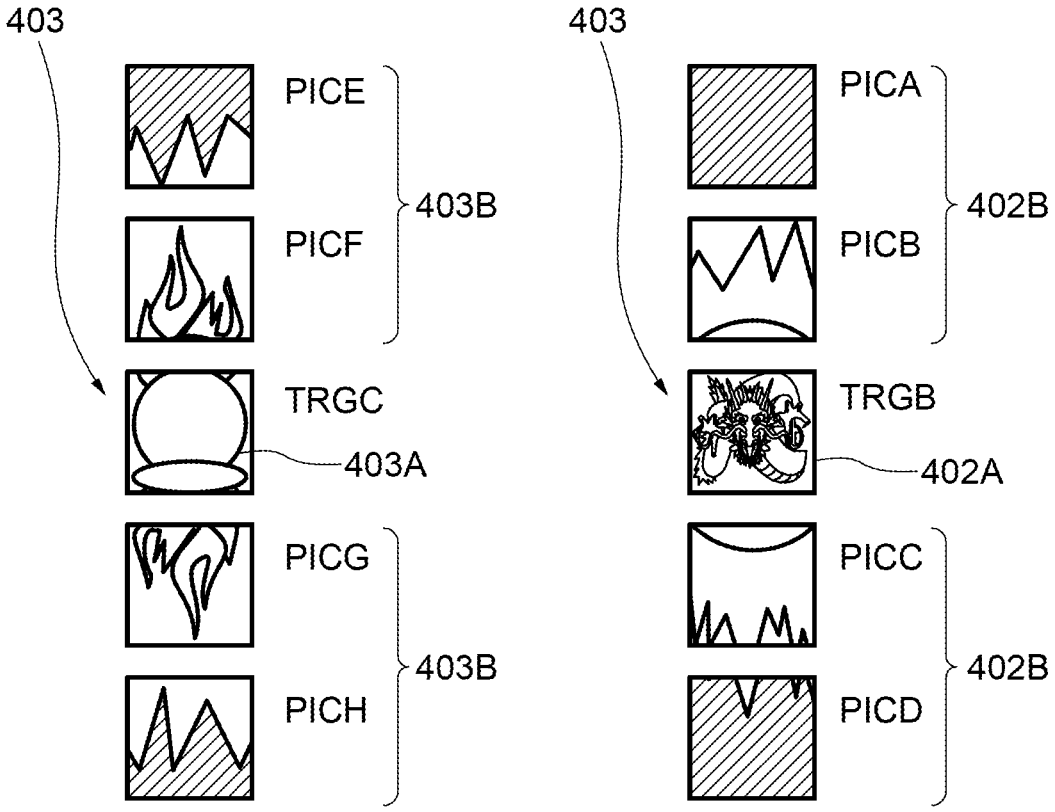
FIG. 69 is a diagram illustrating a problem of the slot machine according to the embodiment of the present invention.
Figure 70:
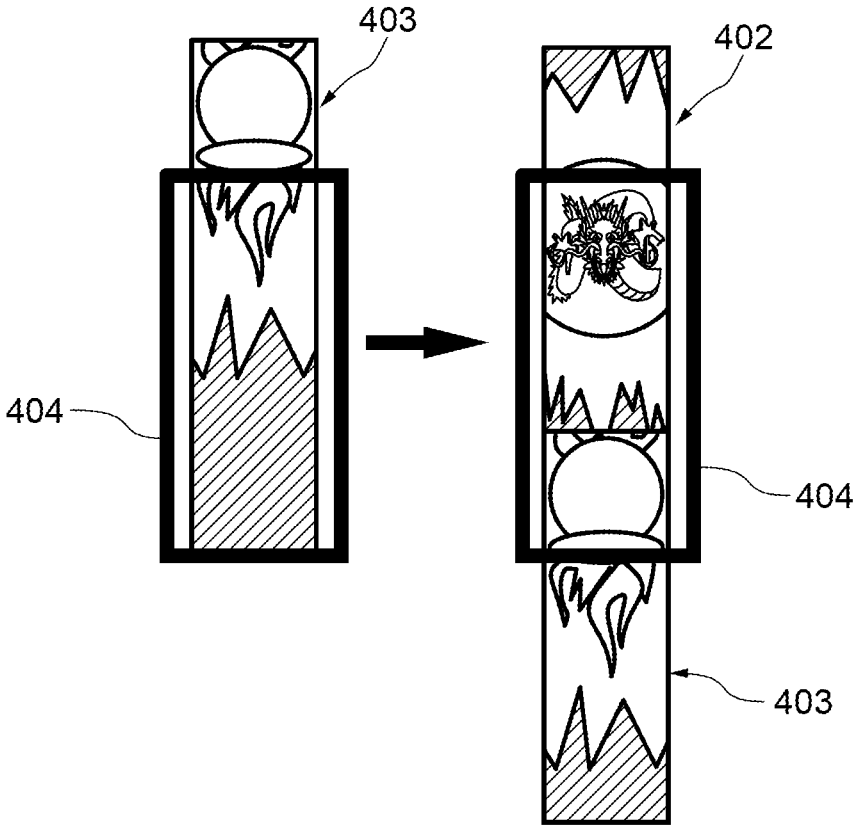
FIG. 70 is a diagram illustrating a problem of the slot machine according to the embodiment of the present invention.
Figure 71:
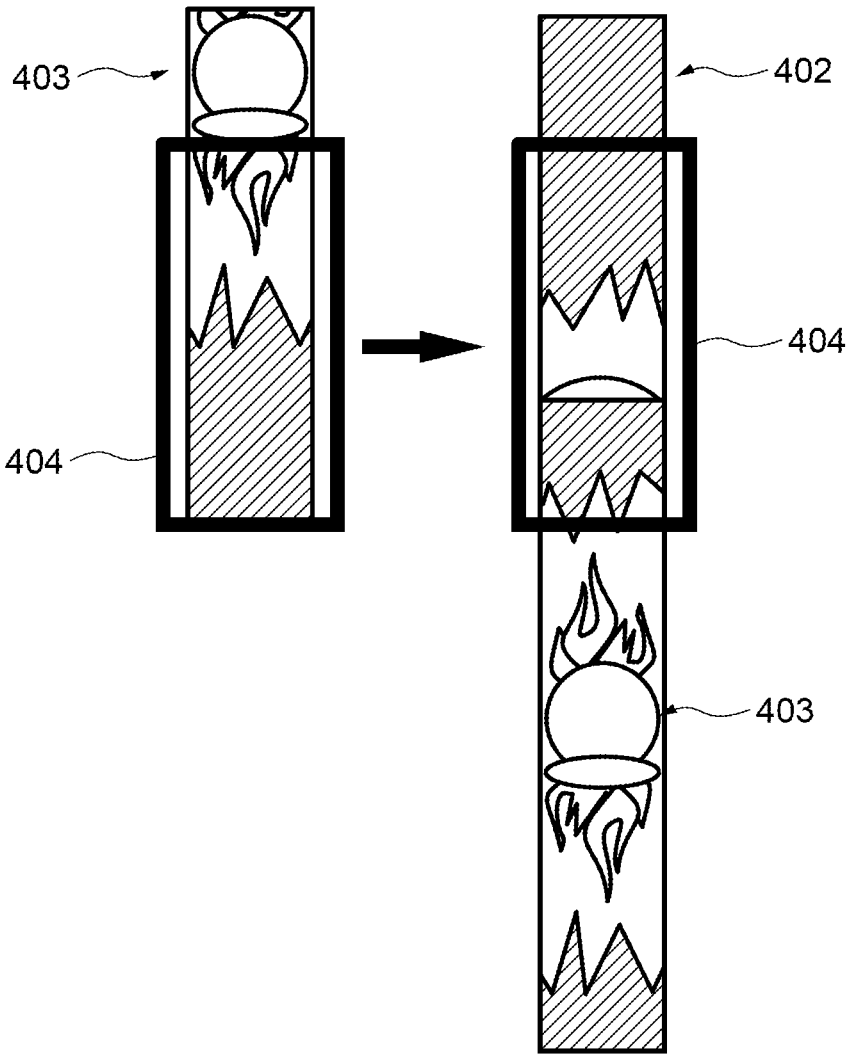
FIG. 71 is a diagram illustrating a problem of the slot machine according to the embodiment of the present invention.
Figure 72:
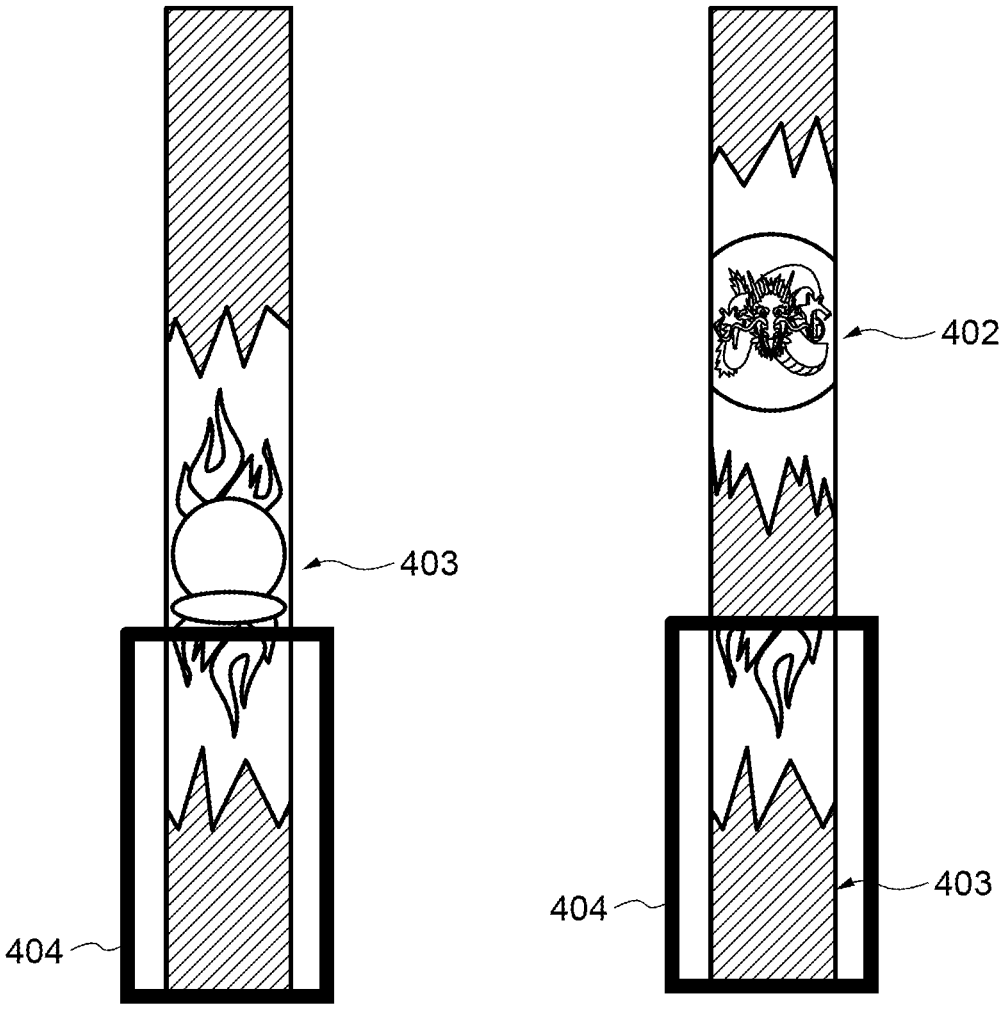
FIG. 72 is a diagram illustrating a problem of the slot machine according to the embodiment of the present invention.

The GAMBLE specification in the slot machine 1 is as described above. Next, with reference to FIG. 65 to FIG. 67, RESIDUAL GAMBLE in the slot machine 1 will be described. Each of FIG. 65 to FIG. 67 is a diagram explaining the RESIDUAL GAMBLE in the slot machine according to the embodiment of the present invention. The RESIDUAL GAMBLE is conducted along a flow shown in FIG. 65 by using a table shown in FIG. 66. At this time, in one scene of the RESIDUAL GAMBLE, on the lower side image display panel 141, an image 501 shown in FIG. 67 is displayed.

REFERENCE SIGNS LIST

1: slot machine
3: video reels
3*a*: first video reel ("REEL 1")
3*b*: second video reel ("REEL 2")
3*c*: third video reel ("REEL 3")
3*d*: fourth video reel ("REEL 4")
3*e*: fifth video reel ("REEL 5")
4: symbol display area
141: lower side image display panel
401 BLANK symbol
402 DRAGON symbol
403 CHANCE symbol

What is claimed is:

1. A slot machine comprising:

a first display for displaying video reels respectively having symbol columns in a scrolling manner and displaying one part of the symbol columns of the video reels in a display frame in a stopped manner by repeating a scrolling display of the video reels and a stopped display of the scrolling display;

a value-addition mechanism by which a player is able to add to the slot machine gaming media to be bet;

an award payout mechanism by which gaming media can be paid out to the player or credited to current credits of the player as an outcome of a slot game; and a processor for, when the one part of the symbol columns is stopped and displayed in the display frame of the first display, conducting a rewriting process to move a position of an arrangement of one part of the symbol columns being present in an upstream direction of the scrolling display outside of the display frame of the first display, based on a position where a next scrolling display of the video reels is stopped, each of the symbol columns including a continuous symbol using as effect spaces symbol arrangement spaces located above a special symbol and symbol arrangement spaces located below the special symbol, a number of the symbol arrangement spaces located above the special symbol and a number of the symbol arrangement spaces located below the special symbols being the same as each other, the processor being programmed to execute, as a result of the player having bet gaming media, a process (1) described below.

(1) A process in which the rewriting process is conducted for a portion of the symbol columns being present upstream of a position where a portion for arranging the continuous symbol in the upstream direction of the scrolling display from the display frame of the first display is allocated.

2. The slot machine according to claim 1, wherein the processor is programmed to execute processes (A) to (B) described below;

(A) A process in which in a case where the one part of the symbol columns is stopped and displayed in the display frame of the first display, when the continuous symbol stopped and displayed in the display frame of the first display is present in the upstream direction of the scrolling display outside of the display frame of the first display, conducted is a delay process in which the rewriting process is conducted for a portion of the symbol column being present further upstream of the continuous symbol in the scrolling display being present in the upstream direction of the scrolling display outside of the display frame of the first display;

(B) A process in which when by conducting the process (A), the continuous symbol comes to be present in the upstream direction of the scrolling display so as to be continuous with the continuous symbol being present in the upstream direction of the scrolling display outside of the display frame of the first display, conducted is another delay process in which the rewriting process is conducted for a portion of the symbol column being present upstream of a position where a portion for arranging the continuous symbol in the upstream direction of the scrolling display from the display frame of the first display is allocated.

3. The slot machine according to claim 2, wherein each of the symbol columns includes a blank symbol in addition to the continuous symbol, and the processor is programmed to execute a process (C) described below;

(C) A process in which in a case where the one part of the symbol columns is stopped and displayed in the display frame of the first display, when the one part of the symbol columns stopped and displayed in the display frame of the first display is constituted of only the blank symbol, the rewriting process is conducted by moving the symbol columns so as to reach a position where a continuous arrangement of the blank symbol is started.

4. The slot machine according to claim 1, wherein the processor is programmed to execute processes (D) to (E) described below;

(D) A process in which the slot game having free games using the video reels is caused to proceed on the first display;

(E) A process in which upon causing the free games to proceed, as the special symbol, used is a character symbol which increases a first predetermined number of times with respect to a number of times of the free games when stopped and displayed in the display frame of the first display or a chance symbol which increases a second predetermined number or more of times with respect to the number of times of the free games when stopped and displayed in the display frame of the first display.

5. The slot machine according to claim 4, comprising a second display being provided so as to neighbor the first display, wherein the processor is programmed to execute a process (F) described below;

(F) A process in which predictive presentation effects of the slot game are conducted such that an image gradually stretching from a character of the character symbol displayed on the second display toward the first display is displayed, with the first display and the second display being in conjunction with each other to gradually stretch the image.

6. The slot machine according to claim 4, comprising the second display being provided so as to neighbor the first display, wherein the processor is programmed to execute a process (G) described below;

(G) A process in which predictive presentation effects of the slot game are conducted such that the image of the character of the character symbol displayed on the second display is moved and displayed onto the second display and the first display.

* * * * *